US006045208A

United States Patent [19]

Hirahara et al.

[11] Patent Number: 6,045,208

[45] **Date of Patent: *Apr. 4, 2000**

[54] INK-JET RECORDING DEVICE HAVING AN ULTRASONIC GENERATING ELEMENT ARRAY

[75] Inventors: Shuzo Hirahara; Tutomu Saito, both of Yokohama; Hitoshi Nagato; Tetsuro Itakura, both of Tokyo; Satoshi Takayama, Kawasaki; Hideki Nukada, Yokohama; Shunsuke Hattori, Kawasaki; Noriko Y. Kudo, Yokohama; Shiroh Saitoh, Kawasaki; Masami Sugiuchi, Yokohama; Yoichi Tokai, Yokohama; Fumihiko Murakami, Yokohama; Hisako Tanaka, Tokyo; Chiaki Tanuma, Yokohama; Mamoru Izumi, Tokyo; Isao Amemiya, Kawasaki; Atsuko Nakamura, Yokosuka; Seizaburou Shimizu, Yokohama; Kumi Okuwada, Kawasaki, all of Japan

[73] Assignee: Kabushiki Kaisha Toshiba, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/501,259

[22] Filed: Jul. 11, 1995

[30] Foreign Application Priority Data

| | | | |
|---|---|---|---|
| Jul. 11, 1994 | [JP] | Japan | 6-158515 |
| Sep. 30, 1994 | [JP] | Japan | 6-238102 |
| Mar. 6, 1995 | [JP] | Japan | 7-045661 |
| Mar. 7, 1995 | [JP] | Japan | 7-047290 |

[51] Int. Cl.[7] ..... B41J 29/38; B41J 2/135; B41J 2/045

[52] U.S. Cl. ..... 347/10; 347/12; 347/15; 347/68; 347/46

[58] Field of Search ..... 347/12, 9, 46, 347/68, 10, 15

[56] References Cited

U.S. PATENT DOCUMENTS

| | | | |
|---|---|---|---|
| 4,308,547 | 12/1981 | Lovelady et al. | 346/140 |
| 4,697,195 | 9/1987 | Quate et al. | 346/140 |
| 4,745,419 | 5/1988 | Quate et al. | 346/140 |
| 4,748,461 | 5/1988 | Elrod | 346/140 |
| 4,751,529 | 6/1988 | Elrod et al. | 346/140 |

(List continued on next page.)

FOREIGN PATENT DOCUMENTS

| | | |
|---|---|---|
| 0 572 241 | 12/1993 | European Pat. Off. . |
| 44 15 771 | 11/1994 | Germany . |
| 2-184443 | 7/1990 | Japan . |

OTHER PUBLICATIONS

IBM Technical Disclosure Bulletin, vol. 16, No. 4, p. 1168; K.A. Krause; Sep., 1973.

IS&T's Eighth International Congress on Advances in Non–Impact Printing Technologies, p. 411–415; B. Hadimioglu, et al.; Sep., 1992.

Patent Abstracts of Japan, vol. 14, No. 460 (M–1032), Oct. 4, 1990, JP–02–184443, Jul. 18, 1990.

*Primary Examiner*—Safet Metjahic
*Assistant Examiner*—Christopher E. Mahoney
*Attorney, Agent, or Firm*—Oblon, Spivak, McClelland, Maier & Neustadt, P.C.

[57] ABSTRACT

An ink-jet recording apparatus records an image onto a recording medium by flying an ink-droplet from an ink surface by a pressure of an ultrasonic beam. The apparatus including an ultrasonic generating element array having a plurality of ultrasonic elements arranged in an array for emitting ultrasonic beams, a driving device for applying a plurality of pulses having different phases from each other, and a converging device for converging the ultrasonic beams by interfering the ultrasonic beams with each other. The generating elements are simultaneously driven and sequentially shifted in an array direction, and the converging device converging the ultrasonic beams in a direction perpendicular to the array direction.

34 Claims, 39 Drawing Sheets

U.S. PATENT DOCUMENTS

| | | | |
|---|---|---|---|
| 4,751,530 | 6/1988 | Elrod et al. | 346/140 |
| 4,751,534 | 6/1988 | Elrod et al. | 346/140 |
| 4,752,790 | 6/1988 | Scardovi | 346/140 |
| 4,782,350 | 11/1988 | Smith et al. | 346/140 |
| 4,797,693 | 1/1989 | Quate | 346/140 |
| 4,801,953 | 1/1989 | Quate | 346/140 |
| 4,959,674 | 9/1990 | Khri-Yakub et al. | 346/140 |
| 5,028,937 | 7/1991 | Khuri-Yakub et al. | 346/140 |
| 5,041,849 | 8/1991 | Quate et al. | 346/140 |
| 5,087,931 | 2/1992 | Rawson | 346/140 |
| 5,111,220 | 5/1992 | Hadimioglu et al. | 346/140 |
| 5,122,818 | 6/1992 | Elrod et al. | 346/140 |
| 5,142,307 | 8/1992 | Elrod et al. | 346/140 |
| 5,191,354 | 3/1993 | Quate | 346/1.1 |
| 5,216,451 | 6/1993 | Rawson et al. | 346/140 |
| 5,229,793 | 7/1993 | Hadimioglu et al. | 346/140 |
| 5,231,426 | 7/1993 | Sweet | 346/140 |
| 5,268,610 | 12/1993 | Hadimioglu et al. | 310/323 |
| 5,277,754 | 1/1994 | Hadimioglu et al. | 156/644 |
| 5,512,922 | 4/1996 | Paton | 347/12 |
| 5,589,864 | 12/1996 | Hadimioglu | 347/46 |
| 5,612,723 | 3/1997 | Shimura et al. | 347/46 |
| 5,629,724 | 5/1997 | Elrod et al. | 347/10 |
| 5,798,779 | 8/1998 | Nakayasu et al. | 347/46 |
| 5,808,636 | 9/1998 | Stearns | 347/46 |
| 5,821,958 | 10/1998 | Lim | 347/46 |

$v = 1500 m/s$
$fd = 100 MHz$
$\lambda = 15 \mu m$
$f = 5 mm$
$N = 32$ ELEMENT
$P = 50 \mu m$
$Rm = (f \cdot m \cdot \lambda)^{\frac{1}{2}}$

| No. | Rm(mm) | Rr(mm) |
|---|---|---|
| 1 | 0.2739 | 0.250 |
| 2 | 0.3873 | 0.400 |
| 3 | 0.4743 | 0.450 |
| 4 | 0.5477 | 0.550 |
| 5 | 0.6124 | 0.600 |
| 6 | 0.6708 | 0.650 |
| 7 | 0.7246 | 0.700 |
| 8 | 0.7746 | 0.750 |
| 9 | 0.8216 | 0.800 |
| 10 | 0.8660 | 0.850 |
| 11 | 0.9083 | 0.900 |
| 12 | 0.9487 | 0.950 |

FIG. 31A

| ELEMENT NUMBER | DRIVING SIGNAL |
|---|---|
| 1 | 0 |
| 2 | π |
| 3 | 0 |
| 4 | π |
| 5 | 0 |
| 6 | π |
| 7 | π |
| 8 | 0 |
| 9 | π |
| 10 | π |
| 11 | π |
| 12 | 0 |
| 13 | 0 |
| 14 | 0 |
| 15 | 0 |
| 16 | 0 |
| 17 | 0 |
| 18 | 0 |
| 19 | 0 |
| 20 | 0 |
| 21 | 0 |
| 22 | π |
| 23 | π |
| 24 | π |
| 25 | 0 |
| 26 | π |
| 27 | π |
| 28 | 0 |
| 29 | π |
| 30 | 0 |
| 31 | π |
| 32 | 0 |

CENTER →

FIG. 31B

PRINT DATA

| | 1 | 2 | 3 | 4 |
|---|---|---|---|---|
| A1 | A1-1 | A1-2 | A1-3 | A1-4 |
| A2 | A2-1 | A2-2 | A2-3 | A2-4 |
| A3 | A3-1 | A3-2 | A3-3 | A3-4 |
| A4 | A4-1 | A4-2 | A4-3 | A4-4 |

RECORDING SIGNAL

| | 1 | 2 | 3 | 4 |
|---|---|---|---|---|
| B1 | A1-1 | | | |
| B2 | A2-1 | A1-2 | | |
| B3 | A3-1 | A2-2 | A1-3 | |
| B4 | A4-1 | A3-2 | A2-3 | A1-4 |
| B5 | A5-1 | A4-2 | A3-3 | A2-4 |
| B6 | A6-1 | A5-2 | A4-3 | A4-4 |

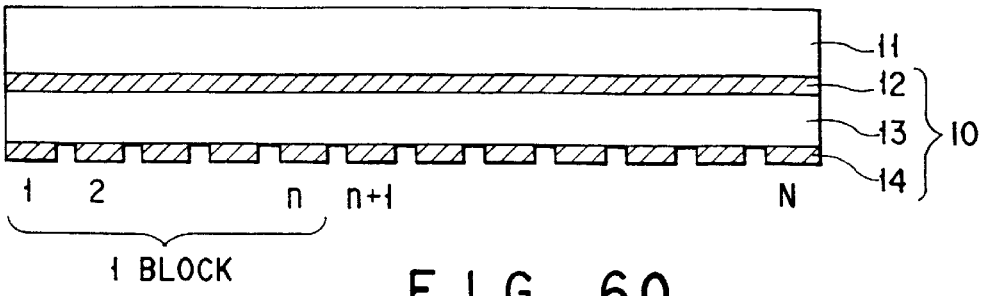
FIG. 60
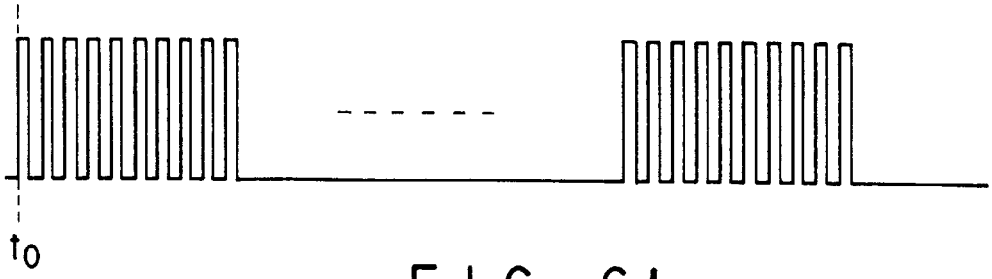
FIG. 61
FIG. 62
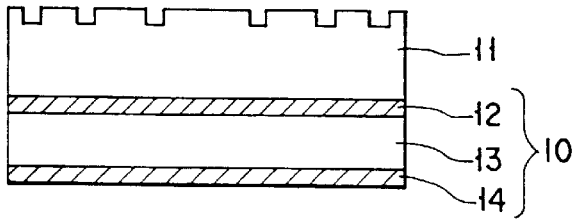
FIG. 63
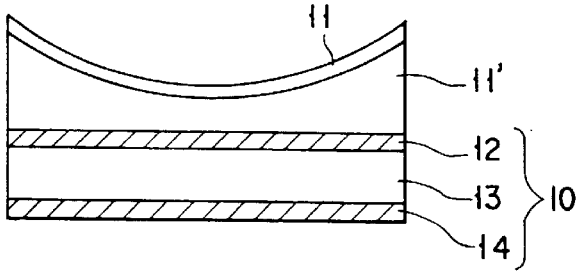
FIG. 64
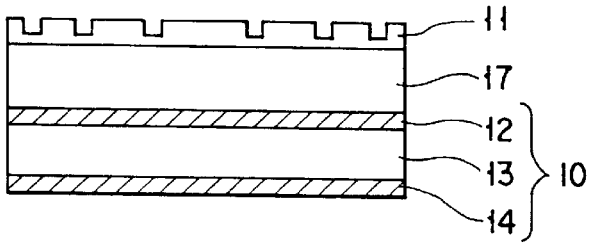

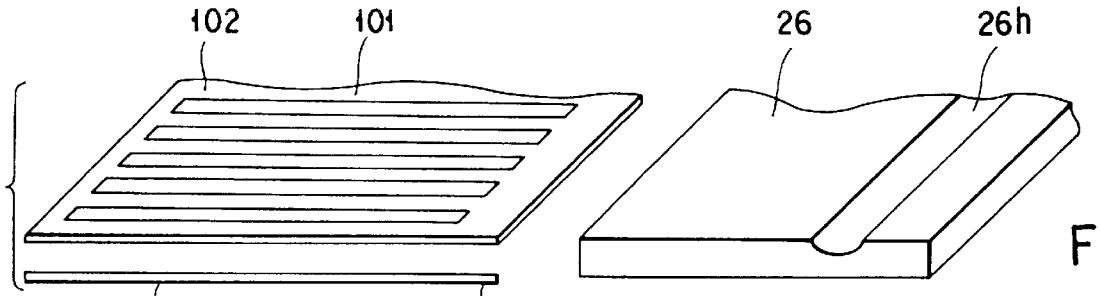
FIG. 75A
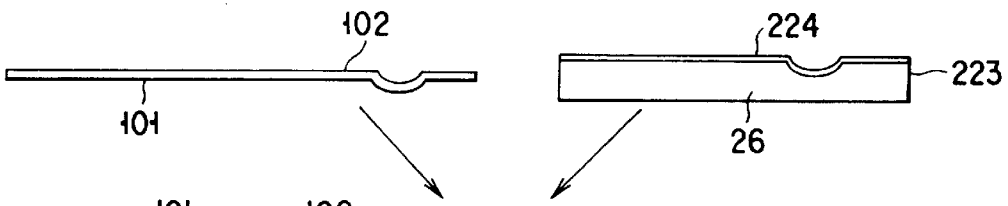
FIG. 75B
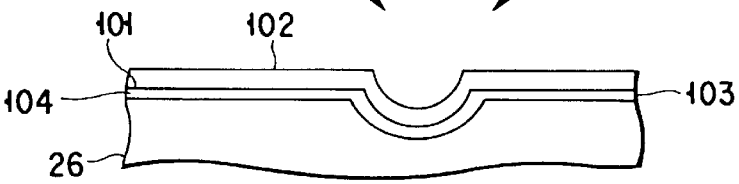
FIG. 75C
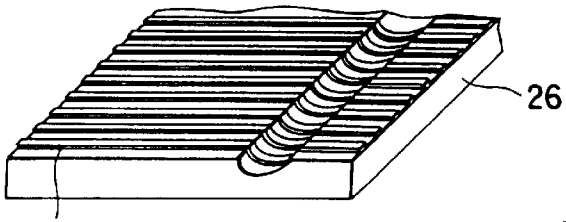
FIG. 75D
FIG. 75E
FIG. 75F

INK-JET RECORDING DEVICE HAVING AN ULTRASONIC GENERATING ELEMENT ARRAY

BACKGROUND OF THE INVENTION

1. Field of the Invention

The present invention relates to an ink-jet recording device which squirts droplets of liquid ink onto a recording medium to record an image, and more particularly to an ink-jet recording device which squirts droplets of liquid ink onto a recording medium by virtue of the pressure generated by ultrasonic beams emitted from piezoelectric elements.

2. Description of the Related Art

A so-called ink-jet printer has been put to practical use. This printer is a recording device which squirts droplets of liquid ink onto a recording medium, thereby to form ink dots thereon and recording an image thereon. It makes less noise than other recording devices. Nor does it require development or fixation of images recorded on the medium. The ink-jet printer is now popular as a device for recording data on ordinary paper. Many techniques for squirting ink-jet printer ink have been proposed to this date. Notable among them are:

(a) To apply the pressure of vapor generated by a heating element to squirt a droplet of ink; and (b) To apply a mechanical pressure pulse generated by a piezoelectric element to squirt a droplet of ink.

An ink-jet printer has a serial scanning head. The head is mounted on a carriage. It records data while moving in the direction (hereinafter referred to as "main-scanning direction") perpendicular to the direction in which recording paper is fed (hereinafter referred to as "sub-scanning direction"). Driven mechanically, the serial scanning head cannot move as fast as desired to accomplish high-speed recording. It is proposed that the serial scanning head be replaced by a line scanning head, because the line scanning head can record data faster since it is as long as a recording sheet is wide and need not move to record data on the recording sheet. However, it is difficult to use a line scanning head, for the following reasons.

In an ink-jet recording system, ink is liable to concentrate locally as the solvent evaporates. The concentrated ink clogs up the fine nozzles arranged in a density which determines the resolution of an image the system can form. If the pressure of vapor is applied to form an ink jet, insoluble matter is likely to accumulate in each nozzle as it thermally or chemically reacts with the ink. If the pressure generated by an piezoelectric element is used to form an ink jet, each ink passage needs to be complex in structure and the ink is liable clog the passage.

Nozzle clogging occurs at low frequency in a serial scanning head which has tens of nozzles to a hundred and odd nozzles. In a line scanning head having as many nozzles as several thousands, nozzle clogging takes place so frequently as to reduce the reliability of the head seriously.

Furthermore, a conventional ink-jet recording device does not help to increase the resolution of images recorded. If vapor pressure is used, the device can hardly produce an ink droplet having a size of 20 $\mu$m or less (which will form on recording paper a dot having a size of about 50 odd $\mu$m). To use pressure generated by a piezoelectric element, the recording head needs to have a complex structure and cannot be made by the existing manufacturing technology so as to record high-resolution images.

Various systems have been proposed which squirt ink droplets from a mass of ink, using the pressures of ultrasonic beams generated by an array of thin-film piezoelectric elements. Each is known as "nozzleless system" which has neither nozzles for forming dots on recording paper nor partitions for the ink passages. The nozzleless system can reliably prevent ink clogging and remedy nozzle clogging, if any. Moreover, the system can record high-resolution images since it form tiny ink droplets and squirts them stably.

The nozzleless system, however, needs to comprise a plurality of piezoelectric element arrays arranged in a staggered fashion. Only one piezoelectric element array does not suffice to record high-resolution images. This is because ultrasonic beams are applied to ink, after converged by acoustic lenses larger than pixels (e.g., lenses having a size 30 times as large as the size of pixels). The nozzle system with piezoelectric element arrays arranged in a staggered fashion is, however, disadvantageous in that the ink periodically changes in concentration and that adjacent dots shift with respect to one another.

The piezoelectric element arrays arranged in a staggered fashion may be replaced by a linear piezoelectric array which emits ultrasonic beams such that the beams interfere with one another in an ink reservoir and converge at a point, thereby achieving so-called phased array scanning.

One of phased array scanning technique is known as "linear scanning," in which the ultrasonic beams from a piezoelectric element are converged at a point in an ink layer. Linear scanning cannot be performed without many drive-signal sources capable of generating element-driving signals which have accurately controlled different phases. The linear scanning is employed in ultrasonic diagnosis apparatus. When the linear scanning is utilized in an ink-jet recording device, there will arise a problem.

The size of an ink droplet squirted when a pressure built up by ultrasonic beams is applied to liquid ink greatly depends on the frequency of the ultrasonic beams. For the ink-jet recording device to record images having a sufficient resolution, the ultrasonic elements must be driven by signals of a high frequency ranging from tens of magahertzes to hundreds of magahertzes, high frequency of the drive signals. To achieve phased array scanning by use of the such high-frequency signals, a drive circuit needs to delay the drive signals with high accuracy in the order of nanosecond ($10^{-9}$ second), in view of the difference in length among the lines for supplying the signals from the drive circuit to the piezoelectric elements.

In the case where a sector electronic scanning is performed by using the phased array, i.e., acoustic beams are applied into liquid ink to accomplish phased array scanning, an ink droplet may fail to fly perpendicular to a recording medium if the ultrasonic beams are converged at a point other than the desired point. If ink droplets fly slantwise to the medium, ink dots will be formed on the medium at different pitches. This has been proven by experiments in which acoustic beams were converged, forming a single beam whose axis was inclined at a few degrees to the perpendicular to the surface of liquid ink.

To form ink dots at a regular pitch, the phases of the signals for driving piezoelectric elements must be controlled with high accuracy. In other words, the signal for driving a piezoelectric element needs to differ in phase very minutely from the signal for driving the immediately adjacent piezoelectric element. In order to control the phases of the drive signals so accurately, it is necessary to use a drive circuit complicated and thus expensive and a memory for storing a great amount of phase-correcting data.

The piezoelectric elements used to perform phased array scanning are discrete members made by cutting a piezoelectric layer. When the layer with a limited length is divided into many discrete piezoelectric elements juxtaposed at a small pitch, in order to record images of high resolution, the elements will be narrow and will likely to be broken. Consequently, the piezoelectric element array cannot be manufactured at high yield.

Assume that the piezoelectric elements are juxtaposed at a sufficiently small pitch to form ink dots in a high density. Then, noise will be generated due to the cross talk between the adjacent piezoelectric elements. The cross-talk noise greatly hinders the convergence of the ultrasonic beams emitted from the elements.

The cross-talk noise between the elements forming either end portion of the piezoelectric element array differs in magnitude from the cross-talk noise between the elements forming a middle portion of the array. This is because no discrete electrodes are provided for the elements forming either end portion, or less discrete electrodes are provided for them than for the other elements. The cross-talk noise between the elements forming either end portion must be controlled differently from the cross-talk noise between the other elements. The method of controlling the cross-talk noise is unavoidably complicated.

When phased array scanning is carried out to converge ultrasonic beams, forming a single beam which reach at a point in the surface of liquid ink, the axis of the single beam inevitably inclines to the ink surface, not extending perpendicular thereto. As a consequence, an ink droplet may fail to fly in a path perpendicular to the ink surface. To make matters worse, the ultrasonic beams are attenuated as they are reflected by the glass walls of the ink reservoir, decreasing the efficiency of squirting ink droplets. To prevent the reflection of beams, the piezoelectric element array may be processed to have a curved beam- emitting surface. If the array is so processed, the yield of the piezoelectric element array will lower.

An ink-jet printer is known which has an acoustic lens for converging the ultrasonic beams from the piezoelectric element array, at a point in the surface of liquid ink. The lens is a bulk lens with a convex surface having a predetermined radius of curvature or a Fresnel lens (designed on the Fresnel diffraction theory) for shifting the phase of one beam with respect to another. When used in combination with an acoustic lens, the piezoelectric element array need not have a curved beam-emitting surface and can, therefore, be made easily. However, the ultrasonic beams are attenuated as they travel through the acoustic lens, and each beam is partly reflected at the interface between the lens and the liquid ink. The ultrasonic energy applied to the ink is less than required to squirt an ink droplet. The drive signals applied to the piezoelectric elements of the array must have an energy high enough to compensate for the inevitable energy loss of the ultrasonic beams.

The piezoelectric element array may be formed into a curved beam-emitting surface so that the beams they emit may converge at a point in the surface of the ink, rendering it unnecessary to use an acoustic lens. In this case, the signals for driving the element need not have a high voltage, but the step of processing the array reduces the yield of the array.

As described above, a piezoelectric element array having a curved beam-emitting surface is used, or a piezoelectric element array having a flat beam- emitting surface is used together with an acoustic lens, in order to achieve phased array scanning, thereby to converge the ultrasonic beams in a plane perpendicular to the axis of the array (i.e., the main scanning direction). If the a piezoelectric element array having a curved beam-emitting surface is used, the yield of the array will decrease. If a flat piezoelectric element array is used together with an acoustic lens, the signals for driving the piezoelectric elements must have a high energy.

So-called sector electronic scanning is known which is one type of phased array scanning. In the sector electronic scanning, the piezoelectric elements juxtaposed and spaced in the main-scanning direction are driven by signals delayed with respect to one another. The elements emit ultrasonic beams which differ in phase. The beams are converged at a point is near the surface of liquid ink, whereby an ink droplet fly from that point.

The sector electronic scanning is advantageous in that the point from which an ink droplet flies can be changed, regardless of the pitch at which the piezoelectric elements are juxtaposed. However, accurate delay times must be imparted to the drive signals so that the elements may emit ultrasonic beams which converge at a desired point. Accurate delay times can be imparted to the signals by nothing but a drive circuit which is complicated and which is hence very expensive. Without such a drive circuit, the sector electronic scanning cannot be accomplished. Furthermore, when the ultrasonic beams converge at a point other than the point located right above the midpoint of the array, forming a single ultrasonic beam, the axis of the single beam inclines to the ink surface. An ink droplet will fly a path inclined to the recording medium, forming an ink dot at a position off the desired position on the recording medium.

(1) In the ink-jet recording technique, wherein piezoelectric element arrays arranged in staggered fashion are used to apply ultrasonic beams to ink to squirt an ink droplet, the ink periodically changes in concentration and that adjacent dots shift with respect to one another. Further, since the high-frequency signals for driving the piezoelectric elements must be phase-controlled accurately, phased array scanning cannot be effected without a drive circuit which is complicated and expensive.

(2) In order to form ink dots at a desired pitch on a recording medium, the signal for driving a piezoelectric element needs to differ in phase very minutely from the signal for driving the immediately adjacent piezoelectric element. To control the phases of the drive signals so accurately, it is necessary to use a drive circuit complicated and thus expensive and a memory for storing a great amount of phase-correcting data.

(3) With the ink-jet recording device which performs phased array scanning to apply ultrasonic beams at a point in liquid ink, squirting an ink droplet onto a recording medium, the piezoelectric elements can hardly arranged at a small pitch to record high-resolution images if each element comprises a discrete piezoelectric layer. If the elements are arranged at such a small pitch by all means, the yield of the device will lower.

SUMMARY OF THE INVENTION

The object of the present invention is to provide the following improved ink-jet recording devices:

(1) An ink-jet recording device which comprises a linear array of ultrasonic generating elements and which can record images having a desired resolution.

(2) An ink-jet recording device which comprises an array of ultrasonic generating elements, which can squirt ink droplets in parallel paths spaced apart at regular intervals in the direction in which the beam generating elements are juxtaposed.

(3) An ink-jet recording device which operates in acoustic-wave mode and can squirt ink droplets in parallel paths spaced apart at regular intervals, by compensating periodical changes in ink concentration and preventing adjacent ink dots from shifting with respect to one another.

(4) An ink-jet recording device which comprises an array of ultrasonic generating elements for emitting ultrasonic beams to liquid ink, thereby to squirt an ink droplet onto a recording medium, and which can easily record images having a high resolution.

(5) An ink-jet recording device which comprises an array of ultrasonic generating elements for emitting ultrasonic beams to liquid ink, thereby to squirt an ink droplet onto a recording medium, and in which the cross-talk noise between the beam generating elements is small.

(6) An ink-jet recording device which comprises an array of ultrasonic generating elements for emitting ultrasonic beams to liquid ink, thereby to squirt an ink droplet onto a recording medium, and in which the ultrasonic beams are efficiently converged at a point in the ink surface, thereby to squirt an ink droplet with high efficiency.

(7) An ink-jet recording device which comprises an array of ultrasonic generating elements for emitting ultrasonic beams to liquid ink, thereby to squirt an ink droplet onto a recording medium, the elements having a flat beam-emitting surface and serving to converge the ultrasonic beams with high efficiency.

(8) An ink-jet recording device which comprises an array of ultrasonic generating elements for emitting ultrasonic beams to liquid ink, thereby to squirt an ink droplet onto a recording medium, and in which the ultrasonic beams are efficiently converged at a point in the ink surface and a path in which the ink droplet flies can be controlled accurately.

(9) An ink-jet recording device which comprises an array of ultrasonic generating elements for emitting ultrasonic beams to liquid ink, thereby to squirt an ink droplet onto a recording medium, and in which the array has a curved beam-emitting surface and discrete electrodes are provided on the curved beam-emitting surface, whereby the array functions like an acoustic lens to converge the ultrasonic beams with high efficiency.

(10) An ink-jet recording device which comprises an array of ultrasonic generating elements for emitting ultrasonic beams to liquid ink, which can form ink droplets on a recording medium at a pitch less than the pitch at which the beam generating elements are juxtaposed, and which has a simple circuit for driving the beam generating elements.

(11) An ink-jet recording device which comprises an array of ultrasonic generating elements for emitting ultrasonic beams to liquid ink, and in which the beam generating elements have a discrete electrode each, and the electric coupling and acoustic coupling between any two adjacent discrete electrodes are equal to those between any other two adjacent discrete electrodes, thus reducing the cross-talk noise between the between the beam generating elements and ultimately converging the ultrasonic beams with high efficiency.

(12) An ink-jet recording device in which ultrasonic beams can be efficiently converged at a point near the surface of ink, first in a plane extending in the main-scanning direction and further in a plane extending perpendicular to the main-scanning direction, and which can easily record images having a high resolution.

An ink-jet recording device according to a first aspect of the present invention comprises ultrasonic generating element array which has at least one ultrasonic element arranged in array for emitting ultrasonic beams; driving means for applying a plurality of pulses having different phases each other to converging ultrasonic beams by interfering the plurality of ultrasonic beams with each other emitted from the ultrasonic generating elements of a part of the ultrasonic generating element array, which are simultaneously driven, with sequentially shifting the ultrasonic generating elements simultaneously driven to an array direction; and converging means for converging each of the plurality of ultrasonic beams in a direction of perpendicular to the array direction. In this ink-jet recording device, the driving means includes a shift register for transferring an input image data, a latch for temporarily storing an image data parallel output from the shift register, and data selector/driver for selecting one of a plurality of pulse series, which have different phases, input from a plurality of common signal line corresponding to the image data temporarily stored in the latch and for driving the ultrasonic generating element according to the corresponding pulse series. The driving means has a first driving mode for simultaneously driving the ultrasonic generating elements to converge ultrasonic beams emitted from the ultrasonic generating element at a first point of a surface of the ink along center axis of the ultrasonic generating elements perpendicular to a ultrasonic generating surface of the ultrasonic generating elements, and a second driving mode for simultaneously driving the ultrasonic generating elements to converge ultrasonic beams emitted from regions divided into at least right region and left region of the ultrasonic generating element s at a second point different from the first point of center axis.

An modification of the ink-jet recording device further comprising ultrasonic generating element array which has a plurality of ultrasonic elements arranged in array for emitting ultrasonic beams; driving means for applying a plurality of pulses having different phases each other to converging ultrasonic beams by interfering the plurality of ultrasonic beams with each other emitted from the at least one ultrasonic generating element; and converging means for converging the plurality of ultrasonic beams in a direction of perpendicular to an array direction, wherein the converging means includes Fresnel zone plate having a plurality of parallel sprite patterns extending in a same direction to the first direction and for converging the ultrasonic beams emitted from the ultrasonic generating elements into the ink.

The drive circuit for driving the ultrasonic generating elements, thereby to perform linear electronic scanning is simple in structure. A compact ink-jet head can be manufactured by mounting the drive circuit on a head substrate. If provided with such a compact ink-jet heat, the ink-jet recording device can be modified into a line-scanning ink-jet recording device which can operate at high speed and which can record high-resolution images.

The modification of the ink-jet recording device according to the first aspect of the invention has a linear Fresnel zone plate (also known as "Fresnel diffraction grating" or "Fresnel lens"), used in place of a cylindrical lens. The linear Fresnel zone plate is used as an acoustic lens which has no large depressions or projections and no curved surfaces and therefore involves but a small aberration. It has been made by in-surface process in which photolithography can be reliably performed in the sub-scanning direction (i.e., the direction at right angles to the main-scanning direction).

The linear Fresnel zone plate consists of two types of strips which are alternately arranged side by side, symmetrically with respect to the midpoint of the plate. Each strip of the first type allows passage of waves, whereas each strip of the second type prohibits passage of waves or shift the waves by half the wavelength. Thus, the focal length of the linear Fresnel zone plate does not change as that of a bulky cylindrical lens, even if ultrasonic beams are applied slantwise with respect to the axes of the strips.

Unlike a bulky cylindrical lens which has depressions and projections, each having a curved surface, the linear Fresnel zone plate can be flat. It can be manufactured by reliable process such as photolithography. It can converge ultrasonic beams with high accuracy.

In the ink-jet recording device according to the first aspect of the invention,

More specifically, an annular (or, disc-shaped) array may be used which consists of annular ultrasonic generating elements. The elements are concentric and divided into two groups. To impart a phase difference of 180° (i.e., π) to the ultrasonic beam emitted from any annular element of the first group and the ultrasonic beam emitted from the adjacent annular element of the second group, it suffices to polarize the elements of the first group in one direction and those of the second group in the opposite direction, to provide one electrode on the entire annular array and to apply a drive voltage to this electrode.

Instead, a linear array may be used which consists of strip-shaped ultrasonic generating elements. The elements are juxtaposed and divided into two groups. To impart a phase difference of 180° to the ultrasonic beam emitted from any strip-shaped element of the first group and the ultrasonic beam emitted from the adjacent strip-shaped element of the second group, it suffices to polarize the elements of the first group in one direction and those of the second group in the opposite direction.

According to the present invention it is possible to converge ultrasonic beams by imparting a phase difference of 180° to the ultrasonic beam emitted from any strip-shaped element of the first group and the ultrasonic beam emitted from the adjacent strip-shaped element of the second group. In other words, the ultrasonic beams can efficiently be converged at a point in the ink surface, without using an acoustic lens or an ultrasonic generating element array which can perform the function of a lens.

(1) The drive means supplies a first drive signal to the ultrasonic generating elements of the first group, and a second drive signal which is opposite in phase to the first drive signal, to the ultrasonic generating elements of the first group.

When the array is driven in the first drive mode, the phases of the ultrasonic beams emitted from the first-group elements coincide with the phases of the ultrasonic beams emitted from the second-group elements coincide at the surface of the ink. As the elements of both groups are repeatedly driven, each time n elements, where n is less than the number of all elements, ink dots can be formed on a recording medium at the same pitch as the ultrasonic generating elements are juxtaposed, forming the array.

When the array is driven in the second drive mode, the phases of the ultrasonic beams emitted from the first half of the simultaneously driven signals coincide at a point on a vertical line passing the midpoint of the group of the simultaneously driven elements, while the phases of the ultrasonic beams emitted from the second half of the simultaneously driven elements coincide at a different on the vertical line. An ink droplet can fly from a point off the vertical line. The distance between this point and the vertical line depends on the ratio of the distance between the two points on the vertical line to the thickness of the ink layer. Thus, the position at which an ink droplet may fly can be changed, regardless of the pitch at which the ultrasonic generating elements are juxtaposed. This makes it possible to record a high-resolution image.

The drive means can be of simple structure since it needs only to supplies different signals, which are opposite in phase, to the array of ultrasonic generating elements.

(2) Fresnel zone plate, which has a plurality of parallel sprite patterns extending in a same direction to the array direction of the ultrasonic generating elements and for converging the ultrasonic beams emitted from the ultrasonic generating elements into the ink, is provided.

The ink-jet recording device according to the first aspect of the invention comprises may comprise a Fresnel zone plate and an ultrasonic-wave interference layer, as well as an array of ultrasonic generating elements. The elements are driven, emitting ultrasonic beams. The interference layer converges the ultrasonic beams in a first plane extending along the axis of the array. The Fresnel zone plate converges the beams in a second plane intersecting with the first plane at right angles.

In the ink-jet recording devices according to the first aspect of the invention piezoelectric layer has at least one gap to cross the array direction of the ultrasonic generating element array.

The piezoelectric layer may be completely divided by the gaps or may have notches extending thicknesswise or widthwise. The number K of gaps provided is preferably, $N/2 \geqq K \geqq N/n$, where N is the number of all piezoelectric-beam generating elements and n is the number of the elements driven simultaneously.

As mentioned above, the piezoelectric layer of the array is divided by a gaps or has notches, which are arranged in the lengthwise direction of the array. The gaps or notches shield the cross talk between the adjacent ultrasonic generating elements. Cross-talk noise is therefore reduced effectively.

An ink-jet recording device according to a second aspect of the present invention comprises at least one ultrasonic generating element for emitting at least one ultrasonic beam; and matching means mounted on the ultrasonic generating element and including matching layer for acoustically matching between the ultrasonic generating element and the ink. The matching means further includes means for converging the ultrasonic beams in a direction perpendicular to an ultrasonic generating surface of the ultrasonic generating elements. Backing material arranged between the ultrasonic generating element and the electrode are further provided.

This device is characterized by the converging/matching means having an acoustic matching member. The acoustic matching member has grooves formed based on the Fresnel ring theory for converging ultrasonic beams in a plane extending in the sub-scanning direction which intersects at right angles to the main-scanning direction. The converging/matching member has a thickness t, which is given as:

$$t=\lambda m\times(2n+1)/4 \quad (1)$$

where n is an integer greater than 0 and λm is the wavelength of the ultrasonic beams traveling in the member. The speed of the beams in the member is preferably an integral multiple of the speed of the beams in the liquid ink.

Assume the converging/matching member has the following thickness t:

$$t=\lambda m\times n/2 \quad (2)$$

In this case, the ultrasonic beams are totally reflected at the interface between the lens and the ink. Consequently, virtually no beams are applied into the ink.

The grooves made in the surface of the converging/matching member have a thickness d, which is given as:

$$d=1/\{2\times(1/\lambda i-1/\lambda m)\} \quad (3)$$

where λi is the wavelength of the ultrasonic beams propagating in the liquid ink. If λm is substantially an integral multiple of λi, each thick portion and each thin portion of the member satisfy the equation (1), whereby acoustic matching is provided. As a result, the ultrasonic beams are effectively emitted into the ink from the thick and thin portions of the member, and an ink droplet flies onto a recording medium.

To converge the ultrasonic beams, one of the methods described above may be combined with one of the methods described later. Among these methods are a method utilizing the delay of such as quadratic function, a method using a Fresnel zone plate and a method of driving elements in groups.

The acoustic matching layer is provided directly on the array of ultrasonic generating elements. The grooves designed based on the Fresnel ring theory and arranged parallel to the main-scanning direction converge the ultrasonic beams in a plane extending in the sub-scanning direction. The beams are thereby emitted into the ink, without being reflected by the thick portions or thin portions of the converging/matching member. Thus, the beams are converged at the surface of the ink, whereby an ink droplet is effectively squirted from the ink surface.

The ink-jet recording device according to the second aspect of the invention is characterized by the backing material which is provided on that surface of the ultrasonic generating elements array which faces away from the ink reservoir means. The backing material suppresses residual vibration of each ultrasonic generating element and helps to achieve efficient application of ultrasonic beams into the ink. An ink droplet can therefore be squirted in a correct path onto a recording medium. Preferably, the backing material is made of material whose acoustic impedance is $3\times10^6$ kg/m$^2$s or more. It is desirable that the member have an attenuation coefficient a which satisfies the relation of $a\times2t\times f<-20$ dB, where t is the thickness of the member and f is the frequency of the ultrasonic beams.

The backing material can be dispensed with since the wiring board on which the ink-jet head and the drive circuit can suppress residual vibration of each ultrasonic generating element and helps to achieve efficient application of ultrasonic beams into the ink. Without the backing material, the ink-jet recording device will be more simple in structure.

An ink-jet recording device according to a third aspect of the present invention comprises ultrasonic generating element array which has a plurality of ultrasonic elements arranged in array for emitting ultrasonic beams; driving means for selecting a predetermined number of continuous ultrasonic generating element group to be simultaneously driven from the ultrasonic generating element array, when a first ultrasonic generating element group has partial ultrasonic generating elements arranged at a center of array direction of the ultrasonic generating element group and a second ultrasonic generating element group has at least partial ultrasonic generating elements arranged at both side of the array direction of the first ultrasonic generating element group, for supplying two-phase driving signal of opposite phases to the first and second ultrasonic generating element groups with shifting a position of the ultrasonic generating element groups and repeating the driving signal supply operation. Another ink-jet recording apparatus according to the third aspect of the invention comprises ink holding means for holding a liquid ink to keep a predetermined surface; ultrasonic generating element array arranged in a predetermined pitch and for converging ultrasonic beams onto the liquid ink by a predetermined driving signal and for emitting ultrasonic beams moving along the liquid surface; and driving means for selecting a predetermined number of continuous ultrasonic generating element group to be simultaneously driven from the ultrasonic generating element array, for determining to assign each ultrasonic generating element of the ultrasonic generating element group one of a first region obtained by Fresnel diffraction equation in which ultrasonic should pass and a second region in which phase of the ultrasonic should shift in half wave length, and when a first group is assigned by the first region and a second group is assigned by the second region, for supplying two-phase driving signal of opposite phases to the first and second groups with shifting a position of the ultrasonic generating element groups and repeating the driving signal supply operation. Control means for controlling whether or not the driving means output the two-phase driving signal on the basis of an image signal to be recorded and/or means for controlling time period of output the two-phase driving signal by the driving means on the basis of an image signal of a pixel corresponding to the ultrasonic generating element group are further provided. The control means arranged corresponding to each ultrasonic generating element of the ultrasonic generating element array, and for inputting the two-phase driving signal and non-driving signal and controlling to provide corresponding ultrasonic element by selecting one of driving signal and non-driving signal of one of phases of the two-phase driving signal on the basis of select information of the ultrasonic generating element group according to the image signal to be recorded and a select information of two-phase driving signal. The driving means includes means for alternatively set a number of ultrasonic element in the ultrasonic generating element group to even-number or odd-number in array direction of a ultrasonic generating element of the ultrasonic generating element array. A total number of ultrasonic generating elements of the ultrasonic generating element array is a number which a number of ultrasonic generating elements in the ultrasonic generating element group is added to at least a number of pixels of a single line to be recorded.

This third ink-jet recording device has an array of ultrasonic generating elements arranged in a row and spaced at equal intervals. Linear electronic scanning is accomplished by repeatedly driving the elements in groups, with drive signals of two types which differ in phase. The groups are defined by rounding the widths of individual elements and the pitch at which the elements are juxtaposed, based on the principle of a Fresnel zone plate. Due to the linear electronic scanning, the ultrasonic beams converge at a desired point in the surface of the ink, and the axis of the beam formed of the converged beams extends in a desired direction with respect to the ink surface. Ink droplets of the same size are therefore are squirted in parallel paths onto the recording medium. As a result, ink dots of the same size are formed on the medium, which are spaced at equal intervals along the axis of the ultrasonic generating element array.

As described above, only two types of drive signals are used to achieve linear electronic scanning. The driving circuit, therefore, need not be so complicated as one required in the conventional ink-jet recording device wherein the signals for driving the ultrasonic generating elements must be accurately phase-controlled in order to effect phased array scanning. In accordance with the input image signals, the drive circuit supplies the first or second type of a drive signal to each ultrasonic generating element.

An odd number of adjacent elements and an even number of adjacent elements may be alternately driven, the elements of each group driven simultaneously. In this case, there will be formed on the recording medium ink dots which are arranged at twice the pitch at which ink dots are arranged if the elements are repeatedly driven, each time an odd or even number of elements.

The number of all ultrasonic generating elements constituting the array is the sum of the number of elements which are arranged over a distance equal to the maximum recording width and the number of elements which should be simultaneously driven to squirt an ink droplet.

All ultrasonic generating elements of the array may be divided into a plurality of groups, and the groups may be driven at the same time to increase the recording speed. In this case, two sets of pixel signals are supplied to two control means controlling the two groups (first and second groups) of elements to be simultaneously driven, respectively, so that some of the ultrasonic beams emitted from the first group of elements overlap the some of the ultrasonic beams emitted from the second group of elements.

The ink-jet recording device can record a 2-dimensional image on a recording medium by carrying out main scanning (i.e., linear electronic scanning) and sub-scanning. The sub-scanning is achieved by moving the recording medium in the direction at right angles to the main-scanning direction. The main scanning may be performed by driving groups of ultrasonic generating elements, one by one, while the sub-scanning is continuously carried out. In this case, data items representing as many lines as the element groups are stored in a memory, and are read and supplied to the control means, one by one, thereby recording one line extending in the main-scanning direction.

As described above, the ink-jet recording device can perform linear electronic scanning. More precisely, drive signals of two type, i.e., 0°-phase signals and 180°-phase signals, drive the ultrasonic generating elements, whereby ultrasonic beams are converged electronically. As phased array scanning is repeated, ink droplets sequentially fly onto the recording medium, forming a line of ink dots on the medium. Two or more arrays of elements need not be arranged in staggered fashion in order to record an image of high resolution. Without staggered arrays, the ink-jet recording device generates no image noise and hardly involves ink-clogging. Furthermore, since ink droplets fly in parallel paths when phased array scanning is carried out, they will form ink dots spaced apart at regular intervals. Having no lenses having a curved surface, the ink-jet recording device can be manufactured by a reliable and high-precision in-surface process such as photolithography, and can perform phased array scanning or linear array scanning accompanied by no aberration-related problems—unlike an ink-jet recording device which has a bulky acoustic lens with a curved surface.

An ink-jet recording device according to a fourth aspect of the present invention comprises ultrasonic generating element array which has a plurality of ultrasonic elements arranged in array for emitting a plurality of ultrasonic beams; driving means for selecting a predetermined number of continuous ultrasonic generating element groups to be simultaneously driven from the ultrasonic generating element array, for supplying driving signal to each of the ultrasonic generating element groups with shifting a position of the ultrasonic generating element groups and repeating the driving signal supply operation; and a plurality of control means arranged corresponding to each of the ultrasonic generating element groups for controlling whether or not the driving means output the driving signal to the ultrasonic generating element groups on the basis of an corresponding image signals of pixels of the ultrasonic generating element groups, wherein the control means inputs an image signals corresponding to a plurality of ultrasonic generating elements overlapping two ultrasonic generating element groups, when the ultrasonic generating element group overlaps two ultrasonic generating element groups of the ultrasonic generating element array. Memory means for storing at least the image signal of the same number of line as a number of the ultrasonic generating element group and transfer means for transferring and shifting by single line image signals corresponding to each of the ultrasonic generating element group of the same line stored in the memory means are further provided.

With the device according to the fourth aspect of the invention it is possible to perform linear electronic scanning by supplying drive signals of two types, which differ in phase, to the array of ultrasonic generating elements. In other words, signals for driving the ultrasonic generating elements need not be phase-controlled accurately. The drive circuit can be far simpler in structure. Moreover, the delay of the drive signals, occurring in the drive circuit or in wires connecting the circuit to the ultrasonic generating elements, does not affect the quality of images the device will record. It is unnecessary to take particular measures to eliminate such delay of drive signals. The device according to the fourth aspect can be provided as a line-scanning ink-jet recording device which operates at high speed, records high-resolution images and is yet inexpensive.

An ink-jet recording device according to a fifth aspect of the present invention comprises ultrasonic generating element array having at least one ultrasonic generating element for generating ultrasonic from the plurality of ultrasonic generating elements and comprised of a plurality of ultrasonic generating means for emitting a plurality of ultrasonic beams; and driving means having a first driving mode for simultaneously driving an ultrasonic generating means comprised of even-numbered the ultrasonic generating means to converge an ultrasonic beams emitted from the ultrasonic generating means to a center of the ultrasonic generating means, and second driving mode for simultaneously driving an ultrasonic generating means comprised of odd-numbered the ultrasonic generating means to converge an ultrasonic beams emitted from the ultrasonic generating means to a center of the ultrasonic generating means.

The device according to the fifth aspect can operate in two modes. In the first mode, an even number of ultrasonic generating elements, included in the array, are simultaneously driven. In the second mode, an odd number of ultrasonic generating elements, included in the array, are simultaneously driven. In either mode, the ultrasonic beams emitted from the elements simultaneously driven emit converge at a point located right above the midpoint of the group formed of the elements. Thus, the point at which the beams converge in the first mode is spaced from the point at which the beams converge in the second mode, by half the pitch at which the ultrasonic generating elements are juxtaposed.

Hence, when the ultrasonic generating elements are driven, alternately in the first mode and the second mode, ink droplet fly from the ink surface in parallel paths which are spaced at half the pitch at which the elements are juxtaposed. The ink-jet recording device according to the fifth aspect can record images in a resolution twice as high as the conventional device wherein the ultrasonic generating elements are repeatedly, each time a predetermined number of elements.

The pattern of setting the phases of the signals for driving an even number of elements simultaneously can be made identical to the pattern of setting the phases of the signals for driving an odd number of elements simultaneously. If the phase-setting patterns are the same, it is easy for the drive circuit to delay the drive signals with respect to one another.

Furthermore, ultrasonic generating elements of any group may be simultaneously driven by signals in alternately opposite phases, thereby to emit ultrasonic beams whose phases comply with the Fresnel diffraction theory. In this case, the drive circuit can be more simple than otherwise.

An ink-jet recording device according to a sixth aspect of the present invention comprises ultrasonic generating element array arranged in a predetermined pitch and for converging ultrasonic beams onto the liquid ink by a predetermined driving signal and for emitting ultrasonic beams moving along the liquid surface; driving means for simultaneously driving adjacent plurality of ultrasonic generating elements in the ultrasonic generating elements with a predetermined delay time and shifting a position of the ultrasonic generating element groups; and acoustic lens or Fresnel zone plate for converging ultrasonic beams emitted from the ultrasonic generating means to a surface of the liquid ink in a direction perpendicular to the array direction.

The acoustic lens incorporated in the device according to the seventh embodiment is made of material in which sound speed is faster than in ink, such as glass or resin. The lens has a concave surface so as to converge the beams emitted from the ultrasonic generating elements at a point in the surface of the ink. Alternatively, the lens may have a Fresnel diffraction pattern consisting of strips arranged along the axis of the array of ultrasonic generating elements. The lens is designed such that its thickest portion has a thickness t which is given as:

$$t<D^2/\lambda$$

where D is the aperture of the lens and $\lambda$ is the wavelength of the ultrasonic beams passing through the lens.

The ultrasonic beams are converged in a first plane extending along the beam generating element array by imparting appropriate delay times to the signals for driving the adjacent elements at the same time. The beams are further converged in a second plane intersecting with the first plane by means of the acoustic lens. The inventors hereof have found that an ink droplet flies most efficiently when the single beam formed of the beams thus converged has substantially the same width in both the first plane and the second plane. To attain this desirable condition in the device according to the sixth aspect, the aperture of the acoustic lens is less than the length of the group of the ultrasonic generating elements which are driven simultaneously.

More precisely, the delay times for the signals to drive the adjacent elements simultaneously are set in accordance with the ratio of the sound speed in the lens to the sound speed in the ink and also with the refraction angle (Snell laws) of the beams traveling from the lens into the ink, so that the simultaneously driven elements emit ultrasonic beams which converge in the first plane at a point in the ink surface. Further, the thickest portion of the acoustic lens has a thickness t which is less than $D^2/\lambda$ so that the ultrasonic beams travel straight through the lens. The beams emanating from the acoustic lens are refracted at the interface between the lens and the ink at an angle determined by the sound speed in the lens and the sound speed in the ink. Finally, the ultrasonic beams converge at a point near the surface of the ink.

The width the beam formed on the converged beams has at the convergence point depends on the aperture and focal length of the acoustic lens if the frequency of the beams remains unchanged and the properties of the beam-transmitting media remain constant. As described above, the ultrasonic beams travel straight through the acoustic lens. Hence, the width the beams formed of these beams has in the second plane at the ink surface is determined by the thickness of the ink layer and the aperture of the lens. On the other hand, the width the beam has in the first plane at the ink surface is determined by the sum of the thickness of the lens and the that of the ink layer and also by the length of the group formed of the simultaneously driven elements. It is therefore possible to reduce the width the beams formed of these beams has in the second plane.

It is more desirable that the beam formed of the converged ultrasonic beams have the same width in both the first plane and the second plane, so that an ink droplet may fly from the surface of the ink with the highest efficiency. This results in the secondary advantage that the ink droplet is virtually spherical and forms a circular ink dot on a recording medium.

To make an effective use of the directivity the acoustic beams have, it is important to take some measures. First, the sound-wave sources (i.e., oscillators or wave-generating elements) and the ink reservoir are so arranged that the sound-wave beams may converge of themselves at the surface of the ink. Second, n sound-wave sources ($n \geqq 4$) are juxtaposed, forming an array. Third, the n sound-wave sources are repeatedly driven in groups, each time m adjacent ones ($3 \leqq m < n$), whereby the m sound-wave sources emit sound-wave beams which converge at one point in the ink surface. Fourth, the grouping of the sound-wave sources is changed, thereby shifting the point in the ink surface, where the sound-wave beams converge.

In the ink-jet head according to this invention, the sound-wave sources arranged in the form of an array are repeatedly driven in groups by a control unit or by signals, emitting sound waves. The sound waves converge propagate in specific directions with respect to the ink surface and converge at a specific point in the ink surface. As the sound-wave sources are repeatedly driven in groups, ink droplets of the same size fly sequentially from the ink surface onto a recording medium in parallel paths. As a result, ink dots uniform in ink concentration and spaced apart at regular intervals are formed on the medium, recording a high-quality image. Capable of effecting electronic focusing, the ink-jet head according to the invention can easily be modified into a linear-array head. Not requiring a plurality of arrays located in staggered fashion to form ink dots in high density, the ink-jet head generates but very little image noise.

The ink droplets squirted through slit-like nozzles also have the same size and fly in parallel paths. The ink dots uniform in ink concentration and spaced apart at regular intervals will therefore be formed on the medium, recording a sharp and clear-cut image. Now will the nozzles be clogged with ink. In addition, when the ink-jet head effects phased array scanning, ink droplets fly in parallel paths spaced at regular intervals, rendering it unnecessary to correct or control the paths of ink droplets. In view of this, the head can well perform the function of a linear nozzle head. The ink-jet recording device according to the present invention is simple and compact and is easy to maintain.

The array of ultrasonic generating elements comprises a piezoelectric layer having a uniform thickness, a common electrode provided on one surface of the piezoelectric layer, and discrete electrodes provided on the opposite surface of the piezoelectric layer. Although the piezoelectric layer is not divided into strips, its portions contacting the discrete electrodes can be driven independently. To manufacture the array, it suffices to perform dry or wet etching to provide the discrete electrodes. Dicing process need not be carried out to form the discrete electrodes. The etching, dry or wet, does not develop cracks in the piezoelectric layer, making it possible for the layer to be much broader than it is thick. Broader than it is thick, the piezoelectric layer can vibrate in its thickness direction, without resonating in the width direction. Therefore, the array can be manufactured at high yield and can squirt ink droplets inform in size. Since the piezoelectric layer is thin, the individual piezoelectric elements can be driven with high-frequency drive signals to squirt very tiny ink droplets so that a high-resolution image may be recorded on a recording medium.

To converge ultrasonic beams in a plane extending to the array, it is better to divide an electrode layer into discrete electrodes than to divide not only the electrode layer but also a piezoelectric layer into strips, in order to reduce the pitch at which the piezoelectric elements are juxtaposed, constituting the array. Since the pitch is reduced, the grating lobes have far less amplitudes than the main lobe or are prevented to occur, and would not cause unnecessary ink droplets to fly from the ink surface. The ink-jet recording device can therefore record high-quality images.

Another ink-jet recording device according to the present invention comprises a substrate and a piezoelectric element array. The substrate has a curved surface, on which the array is provided. To be more precise, the array comprises discrete electrodes mounted on the curved surface of the substrate, a piezoelectric layer provided on the discrete electrodes, and a common electrode provided on the piezoelectric layer.

The method of manufacturing the array will be described. First, a trough-like groove is made in the supper surface of a block-shaped substrate. The curved bottom of the groove has a prescribed curvature. Next, strip-shaped discrete electrodes are juxtaposed in the trough-like groove at a predetermined pitch. A piezoelectric layer having a prescribed thickness is formed on the discrete electrodes by sputtering or the like. Finally, a common electrode is formed on the piezoelectric layer, also by sputtering or the like.

The discrete electrodes may be formed in two alternative methods. In the first method, a patterned metal foil is bonded to the trough-like groove by means of anode bonding. The patterned foil is a high-precision one, which can be prepared by performing photolithography on a metal foil. During the anode bonding, heat and an electric field is applied to the substrate made of glass and the patterned metal foil, and the patterned foil is bonded to the glass due to an electrostatic force, without being deformed. In the second method, a metal foil, not patterned, is bonded to the trough-like groove by hot-pressing or the like, a patterned resin mask is formed on the foil, and the foil is patterned by photolithography using the resin mask.

Since the discrete electrodes are curved and formed with a high precision in the order of microns, the array of piezoelectric elements can perform the function of a lens. Hence, the array emits ultrasonic beams which efficiently converge at a point in the ink surface.

Still another ink-jet recording device according to the invention has a piezoelectric element array. The array comprises discrete electrode, a piezoelectric layer and a common electrode. The array is formed in the following steps. First, plate-shaped conductors and plate-shaped insulators are alternately combined, forming a rectangular block. Then, a trough-like groove is made in the upper surface of the block. Next, the piezoelectric layer is mounted in the groove. Finally, the common electrode is placed on the piezoelectric layer. In this case, too, the discrete electrodes are curved and formed with a high precision in the order of microns, the array of piezoelectric elements can perform the function of a lens. The array therefore emits ultrasonic beams which efficiently converge at a point in the ink surface.

Another ink-jet recording device according to the invention has a piezoelectric element array. The array comprises discrete electrode, a piezoelectric layer and a common electrode and is characterized in that at least one piezoelectric element at either end is not driven at all to emit an ultrasonic beam. That is, the array has more piezoelectric elements than necessary to squirt ink droplets. Thus, the average capacitive load of the elements driven and the acoustic coupling between any two adjacent elements driven are less than otherwise. More precisely, the electric coupling and acoustic coupling between any two adjacent discrete electrodes are equal to those between any other two adjacent discrete electrodes. This minimizes the cross-talk noise between the beam generating elements.

Since all piezoelectric elements but those located at the ends of the array are driven, emitting ultrasonic beams. Since the elements driven are located relatively remote from the walls of the ink reservoir unlike the elements at the ends of the array, the ultrasonic beams they emit are not reflected by the walls of the reservoir. The convergence of the beams is not hindered at all.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the present invention and, together with the general description given above and the detailed description of the preferred embodiments given below, serve to explain the principles of the present invention in which:

FIGS. 31A and 31B are tables showing the grouping of ultrasonic generating elements used in Embodiment 3-1, and the 2-phase drive signals to be supplied to the groups of elements;

FIG. 60 is a sectional view showing the main components of the recording head section incorporated in Embodiment 7;

FIG. 61 is a diagram representing the waveform of the drive voltage used in Embodiment 7;

FIG. 62 is a sectional view showing the main components of a first modified recording head section for use in Embodiment 7;

FIG. 63 is a sectional view showing the main components of a second modified recording head section for use in Embodiment 7;

FIG. 64 is a sectional view showing the main components of a third modified recording head section for use in Embodiment 7;

FIGS. 75A to 75F are perspective views and sectional views, explaining another method of manufacturing the ink-jet head shown in FIGS. 73A and 73B;

DETAILED DESCRIPTION OF THE PREFERRED EMBODIMENTS

Hereinafter, referring to the accompanying drawings, embodiments of the present invention will be explained in detail.

Figure 1:
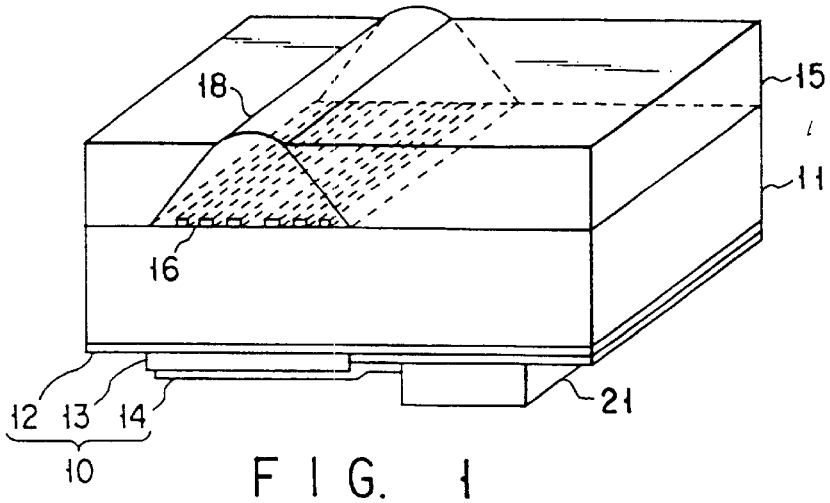
FIG. 1 is a perspective view of the recording head section incorporated in an ink-jet recording device according to Embodiment 1-1 of the present invention.

FIG. 1 is a pictorial view of part of a recording head section in an ink-jet recording device according to an Embodiment 1-1 of the present invention. In the Embodiment 1-1, piezoelectric elements are used as ultrasonic generating elements. The piezoelectric elements are arranged in a one-dimensional array.

The features of the Embodiment 1-1 is that a plurality of adjacent ultrasonic beams emitted from the piezoelectric element array are forced to interfere with each other within an ultrasonic interference layer formed of such material as glass, which is also used as an acoustic matching layer, and then are allowed to converge in the main-scanning direction, and that a one-dimensional Fresnel zone plate is used as means for forcing ultrasonic beams emitted from the piezoelectric element array to converge in the sub-scanning direction.

The recording head section comprises an ultrasonic interference layer 11, a common electrode 12, a piezoelectric layer 13, a discrete electrode 14, a nozzle substrate (hereinafter, sometimes referred to as an ink pod), a Fresnel zone plate 16, and a driving circuit 21.

The ultrasonic interference layer 11 also serves as an acoustic matching layer between the piezoelectric element support of the recording head section and piezoelectric element array 10 and ink 18, and is formed of, for example, glass. On the bottom surface of the ultrasonic interference layer 11, the piezoelectric layer 13 is formed via the common electrode 12 made up of a thin metal film.

The piezoelectric layer 13 is such that a layer of such a material as ZnO or PZT is formed all over (or in stripes on) the bottom surface of the ultrasonic interference layer 11 by a film forming method capable of controlling the film thickness arbitrarily, such as sputtering. On the top surface of the ultrasonic interference layer 11, a plurality of discrete electrodes 14 are formed with a pitch corresponding recording dots. The thickness of the piezoelectric layer 13 is determined by the wavelength of the ultrasonic wave used and designed so that the total of its thickness and the equivalent thickness of the metal common electrode 12 and the discrete electrode 14 sandwiching the piezoelectric layer 13 between them is half the wavelength of the ultrasonic wave.

The common electrode 12, piezoelectric layer 13, and discrete electrode 14 constitute the piezoelectric element array 10 or the ultrasonic generating element array. In FIG. 1, the piezoelectric element array 10 has only eight elements. In the case of an actual ink-jet head, for example, a line head as long as the length of the A4 size sheet with a resolution of 600 dpi, about 5,000 piezoelectric elements are arranged in a line. In this case, the individual piezoelectric elements in the piezoelectric element array 10 are arranged in a line at regular intervals determined by the required recording density. A magnetostrictive transducer array may be used instead of the piezoelectric element array 10. In that case, a magnetostrictive transducer is used as the piezoelectric layer 13 and a discrete exciting coil (magnetization coil) 14 is used as the discrete electrode 14. Such an arrangement will be explained in Embodiment 3-3 and Embodiment 3-4.

On the top surface of the ultrasonic interference layer 11, a nozzle substrate 15 in which a slit-like nozzle-cum-ink chamber with a trapezoidal cross section is formed is laminated so that the nozzle-cum-ink chamber may be positioned directly above the piezoelectric element array 10. The nozzle-cum-ink chamber is filled with liquid ink 18.

At the boundary of the piezoelectric element array 10 and the ink 18, the one-dimensional Fresnel zone plate 16 is formed. The Fresnel zone plate 16 is formed in such a manner that if the distance from the center of diffraction is x, first regions that pass ultrasonic waves with no phase shift are arranged at the positions of x=0 to 1K, $\sqrt{3}\times K$ to $\sqrt{5}\times K$, $\sqrt{7}\times K$ to $\sqrt{9}\times K$, $\sqrt{11}\times K$ to $\sqrt{13}\times K$, . . . and second regions that shift the phase of ultrasonic waves by a half-wave length are arranged at the positions of x=1 to $\sqrt{3}\times K$, $\sqrt{5}\times K$ to $\sqrt{7}\times K$, $\sqrt{9}\times K$ to $\sqrt{11}\times K$, $\sqrt{13}\times K$ . . . Here, P is the focal length or the thickness of the nozzle substrate 15, $\lambda$ is the wavelength of the ultrasonic wave used, and $K=(\lambda p/2)^{1/2}$. Since the first and second regions have only to differ relatively from each other by a half-wave length, only either the first or the second region is formed of a metal evaporation film by photolithography. Its thickness is determined to be about several $\mu$m to several tens $\mu$m that allow a half-wave length phase shift to take place due to the difference from a low sound speed in the ink.

The operation of Embodiment 1-1 will be explained with reference to FIGS. 2A and 2B.

One typical phased array scanning technique is to group a specific number of adjacent piezoelectric elements in the piezoelectric element array into one unit and drive these units shifting the phase suitably so that the ultrasonic beams emitted from them may interfere with each other, by shifting the piezoelectric element to be driven one by one. Here, a case where linear scanning is effected using four piezoelectric elements as one unit.

Figure 2A:
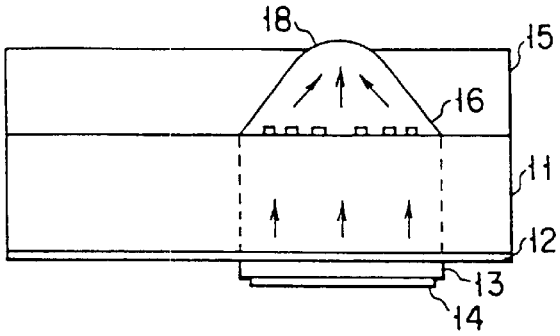
FIGS. 2A and 2B are diagrams explaining the operation of the recording head section of Embodiment 1-1.
Figure 2B:
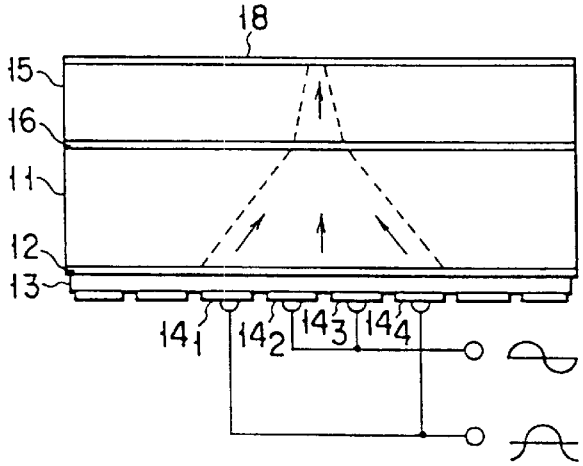

As shown in FIGS. 2A and 2B, a voltage of burst wave made up of an alternating current of a specific frequency and a pulse train is applied to the discrete electrodes $\mathbf{14}_1$ to $\mathbf{14}_4$ of four piezoelectric elements.

Under these conditions, when a voltage of burst wave of a specific phase is applied to the two inner ones $\mathbf{14}_2$, $\mathbf{14}_3$ of the four piezoelectric elements, and a voltage of burst wave leading the voltage of burst wave applied to the discrete electrodes $\mathbf{14}_2$, $\mathbf{14}_3$ of the two inner piezoelectric elements is applied to the discrete electrodes $\mathbf{14}_1$, $\mathbf{14}_4$ of the two outer piezoelectric elements, the ultrasonic beams emitted from the respective piezoelectric elements interfere with one another, producing a lens effect in the direction in which the piezoelectric elements are arranged in the piezoelectric element array 10 (hereinafter, referred to as the array direction), or in the main-scanning direction. In the ultrasonic interference layer 11, the beams never converge in the direction perpendicular to the piezoelectric element array 10 (in the sub-scanning direction).

The ultrasonic beams arriving at the boundary with the ink chamber experience a lens effect by means of the Fresnel zone plate 16 in such a manner that they converge centripetally in the direction perpendicular to the piezoelectric element array 10 (i.e., the sub-scanning direction). Specifically, the convergence of the ultrasonic beams in the main-scanning direction starts at the inside of the ultrasonic interference layer 11 also serving as an acoustic matching layer and extents to the ink 18 in the nozzle substrate 15, whereas the convergence in the sub-scanning direction takes place only within the ink 18 in the nozzle substrate 15. The ultrasonic beams are focused on the surface of the ink remaining still at the opening of the slit at the top surface of the nozzle substrate 15 in both of the main-scanning and sub-scanning directions.

In this way, the pressure of the converged ultrasonic beams forces an ink droplet to fly from the ink surface to record an image on a recording medium such as recording paper (not shown). With this recording method, when the ultrasonic beams are forced to converge on a dot using four piezoelectric elements as shown in FIGS. 3A to 3E, divisional driving is effected where one line is divided into four or more pieces, which are each driven with one fourth of the original timing. Namely, shifting in the main-scanning direction must be done by linear scanning using four piezoelectric elements as one unit.

The operation of FIGS. 3A to 3E will be explained briefly.

Figure 3A:
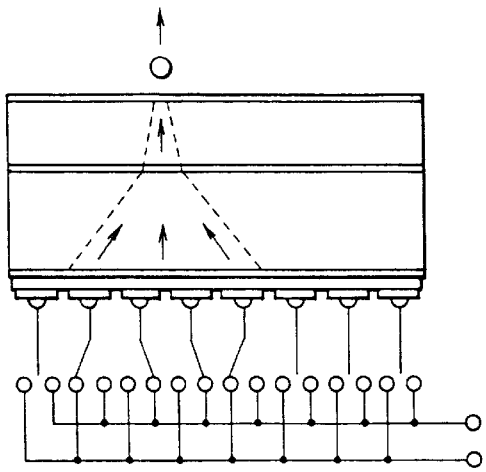
FIGS. 3A to 3E are diagrams explaining how the recording head section of Embodiment 1-1 performs phased array scanning.

FIG. 3A pictorially shows a case where a voltage of burst wave is applied to the two inner ones $\mathbf{14}_3$, $\mathbf{14}_4$ of the grouped discrete electrodes $\mathbf{14}_2$ to $\mathbf{14}_5$, and a voltage of burst wave leading the voltage of burst wave applied to the two inner discrete electrodes $\mathbf{14}_3$, $\mathbf{14}_4$ is applied to the two outer discrete electrodes $\mathbf{14}_2$, $\mathbf{14}_5$.

Figure 3D:
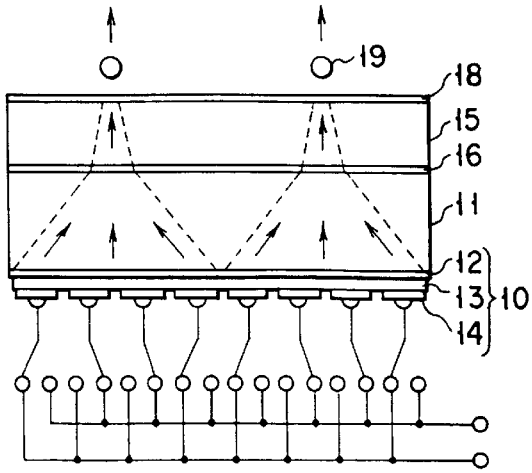
Figure 3B:
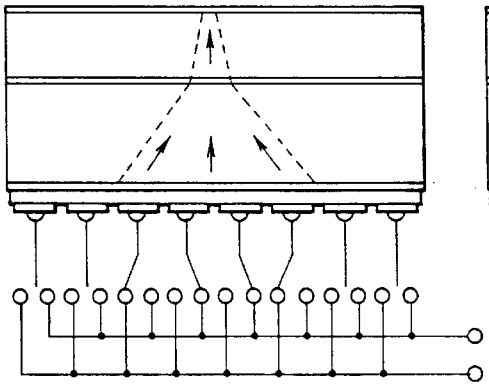

FIG. 3B pictorially shows a case where a voltage of burst wave is applied to the two inner ones $\mathbf{14}_4$, $\mathbf{14}_5$ of the next grouped discrete electrodes $\mathbf{14}_3$ to $\mathbf{14}_6$, and a voltage of burst wave leading the voltage of burst wave applied to the two inner discrete electrodes $\mathbf{14}_4$, $\mathbf{14}_5$ is applied to the two outer discrete electrodes $\mathbf{14}_3$, $\mathbf{14}_6$.

Figure 3E:
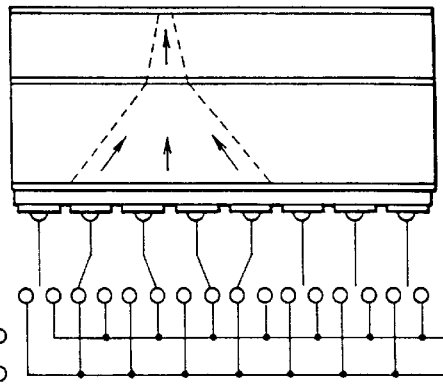
Figure 3C:
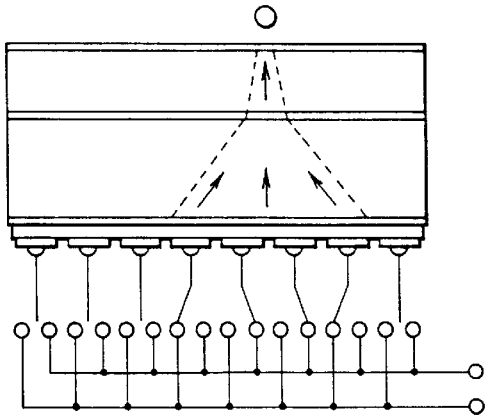

FIG. 3C pictorially shows a case where a voltage of burst wave is applied to the two inner ones $\mathbf{14}_5$, $\mathbf{14}_6$ of the grouped discrete electrodes $\mathbf{14}_4$ to $\mathbf{14}_7$, and a voltage of burst wave leading the voltage of burst wave applied to the two inner discrete electrodes $\mathbf{14}_5$, $\mathbf{14}_6$ is applied to the two outer discrete electrodes $\mathbf{14}_4$, $\mathbf{14}_7$.

FIG. 3D pictorially shows a case where the discrete electrodes $\mathbf{14}_1$ to $\mathbf{14}_8$ divided into a group of discrete electrodes $\mathbf{14}_1$ to $\mathbf{14}_4$ and a group of discrete electrodes $\mathbf{14}_5$ to $\mathbf{14}_8$, and the two groups are driven at the same time to squirt two droplets of ink with a specific pitch.

FIG. 3E shows the same state as in FIG. 3A.

Practically, it is desirable that the number of piezoelectric elements constituting one group is 20 or more.

As described above, by grouping the piezoelectric elements in the piezoelectric element array 10, rearranging the grouping sequentially, and changing and applying the voltage of burst wave according to the positions of the piezoelectric elements 13 in the grouping, an ink droplet of a constant size is always forced to fly straight in a constant direction, which eliminates a mechanism for controlling the flying direction of an ink droplet, contributing greatly to the simplification of the recording device.

Furthermore, by sequentially changing the grouping in the piezoelectric element array 10 and selectively applying a specific alternating-current voltage or a voltage of burst wave to the piezoelectric elements 13 according to the positions of the elements in the grouping, the energy density of ultrasonic beam can be improved, variations in the size of ink droplet be alleviated, and high-quality recording be effected.

In Embodiment 1-1, linear scanning in units of four piezoelectric elements has been explained. The number of elements for one unit to drive the piezoelectric element array in linear scanning, that is, the number of piezoelectric elements used to record one pixel, is not restricted to one unit of four piezoelectric elements. By using more piezoelectric elements, side lobe of the ultrasonic beams converging centripetally is reduced and the energy density is raised, thereby reducing variations in the ink droplet and lowering the driving voltage of the piezoelectric element array 10.

A feature of Embodiment 1-1 is that the one-dimensional Fresnel zone plate 16 is used as means for forcing the ultrasonic beams emitted from the piezoelectric element array 10 to converge in the sub-scanning direction. The effect of using the one-dimensional Fresnel zone plate 16 to force the ultrasonic beams to converge in the sub-scanning direction is as follows. An acoustic cylindrical lens using a bulk material that has the same cross section along the piezoelectric element array in the sub-scanning direction is used as ultrasonic beam converging means in the sub-scanning direction. Of the ultrasonic beams forced by phased array scanning to converge with a centripetal wave surface, however, those near the center strike the lens face or the lens surface at right angles, whereas those at both ends of the ultrasonic beams hit the lens surface obliquely. When F number (=focal length/lens aperture) is reduced to about 1 to increase the energy efficiency, the incidence angle to the vertical axis at both ends increases to about 30°. When the incidence angle becomes larger with respect to the vertical axis, the curvature of the lens surface in the incident beam advancing direction becomes greater, thus shortening the focal length of the ultrasonic beams incident on that portion. As a result, the ultrasonic beams cannot focus on a single point. This makes the efficiency very low. Because the size of ink droplet is irregular and unstable, the picture quality is low. Additionally, it is difficult for the ink-jet printer to operate properly.

In contrast, when the one-dimensional zone plate 16 is used to force ultrasonic beams to converge in the sub-scanning direction as in Embodiment 1-1, the focal length will not change even if the incidence angle of the ultrasonic beams changes with respect to the direction in which the beams extend in a belt. Therefore, the problem in using an acoustic cylindrical lens using a bulk material is solved.

Figure 4:
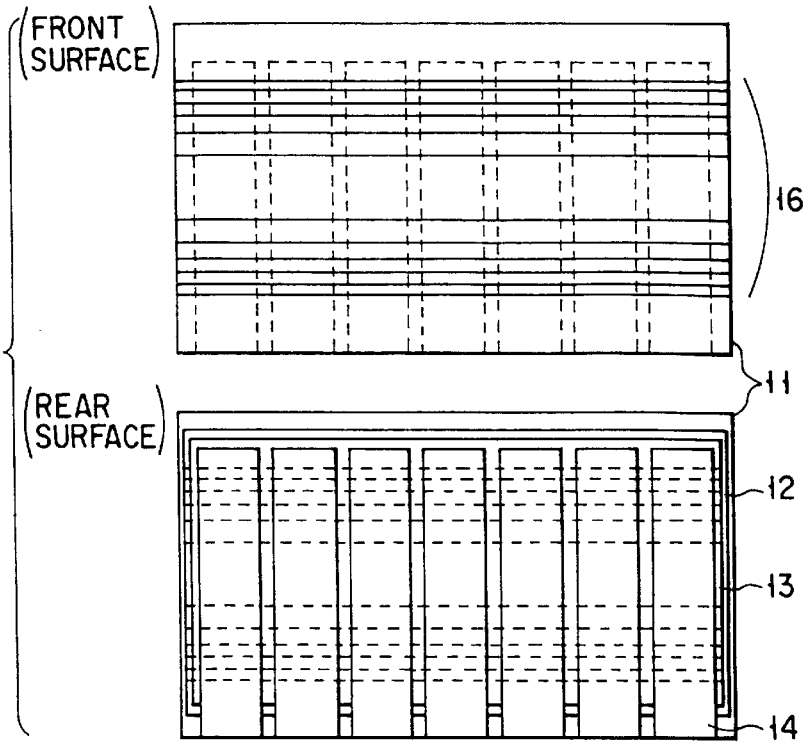
FIG. 4 is a diagram illustrating the positional relation which the Fresnel zone plate and the piezoelectric element array have in Embodiment 1-1.

Furthermore, the Fresnel zone plate 16 with such a straight pattern is helpful in the manufacturing process. Specifically, in Embodiment 1-1, as shown in FIG. 4, on the top surface of the glass substrate, the ultrasonic interference layer 11 also serving as an acoustic matching layer, the Fresnel zone plate 16 with a straight pattern extending in the main-scanning direction. On the bottom surface of the glass substrate, the discrete electrode 14 with a straight pattern extending in the sub-scanning direction is formed on a lamination of the common electrode 12 and the piezoelectric layer 13. Since each pattern is composed of straight lines without corners, they can be produced finely, precisely, and independently. The accuracy of positioning the top and bottom patterns of the glass substrate to combine them may be must less strict than the accuracy of forming each pattern. Therefore, a pattern suitable for high resolution can be produced using an easy-to-handle manufacturing process.

Furthermore, another advantage of using the one-dimensional Fresnel zone plate 16 is that unlike a cylindrical lens using a curved surface bulk material, the Fresnel zone plate prevents the focus from moving according to the incidence angle of the ultrasonic beam and the aberration from occurring.

Embodiment 1-2

Figure 5:
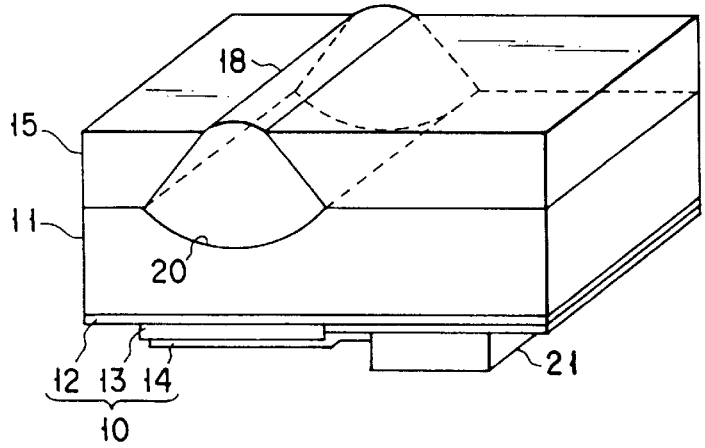
FIG. 5 is a perspective view showing the recording head section incorporated in an ink-jet recording device according to Embodiment 1-2 of the invention.

FIG. 5 shows the structure of a recording head according to an Embodiment 1-2 of the present invention. In the Embodiment 1-2, means for forcing ultrasonic beams to converge in the main-scanning direction uses phased array scanning as in Embodiment 1-1, whereas a cylindrical lens 20 using a curved surface bulk material is used as means for forcing ultrasonic beams to converge in the sub-scanning direction.

Figure 6:
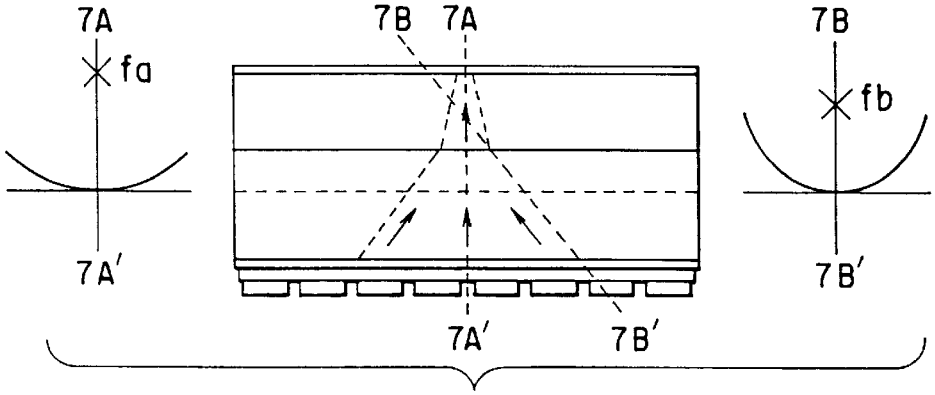
FIG. 6 is a diagram explaining how the focal point moves in Embodiment 1-2.

In this embodiment, as shown in FIG. 6, since the focal length (fa) of the beams in the central portion (7A–7A') striking the lens 20 at right angles differs from the focal length (fb) of the beams at the end portions (7B–7B') striking the lens 20 obliquely, the convergence characteristic is poorer than that in Embodiment 1-1. In addition, because the beams from both ends are diffracted in a complicated three-dimensional plane, an aberration takes place.

Therefore, the recording head of Embodiment 1-2 is inferior to that of Embodiment 1-1 in the energy efficiency in generating squirted ink droplets and the uniformity of ink droplets. Since the recessed side of the cylindrical lens 20 serves as an ink chamber as it is, the former has the advantage of providing an ink passage with a large cross section. Thus, in the case of high-speed recording, the recording head of embodiment of 1-2 has the advantages that it can supply a sufficient amount of ink to deal with the speed, the change of ink concentration due to the evaporation of the ink solvent at the nozzle is slow, and the clogging of the nozzle is less liable to occur.

Hereinafter, Embodiment 1-3 to Embodiment 1-8 featuring the structure of the piezoelectric element will be explained.

Embodiment 1-3

Figure 7:
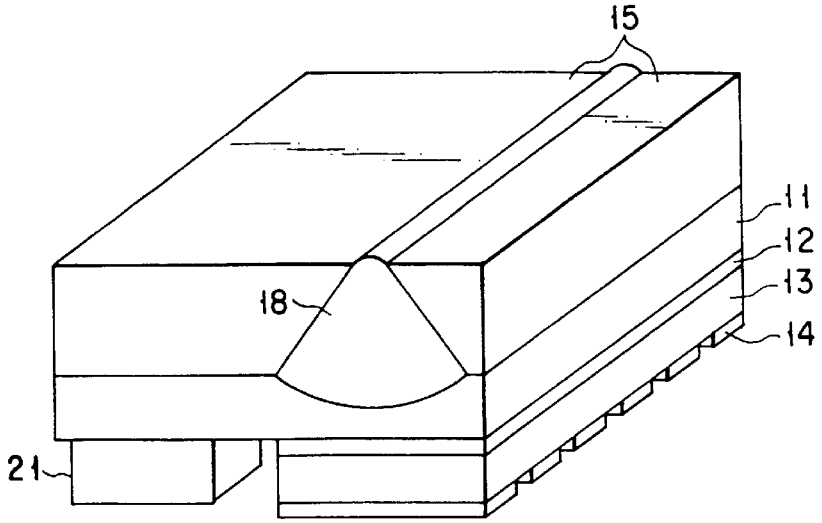
FIG. 7 is a perspective view showing the recording head section incorporated in an ink-jet recording device according to Embodiment 1-3 of this invention.

FIG. 7 is a perspective view of the recording head section in an ink-jet recording device according to an Embodiment 1-3 of the present invention.

Embodiment 1-3 is characterized in that a single piezoelectric element is provided with a plurality of discrete electrodes and a plurality of ultrasonic waves are generated from the single piezoelectric element.

In FIG. 7, a piezoelectric element array 10 is composed of a piezoelectric layer 13 of a long plate with a constant thickness, a common electrode 12 formed on one side of the layer and a plurality of discrete electrodes 14 formed on the other side of the layer. Namely, the piezoelectric layer 13, common electrode 12, and discrete electrodes 14 constitute a plurality of piezoelectric elements arranged one-dimensionally.

On the surface of the common electrode opposite to the piezoelectric layer 13, an acoustic lens 11 is formed. The acoustic lens 11 is formed of, for example, a glass plate, has a recessed surface on the opposite side to the piezoelectric element array 10, and functions as an acoustic concave lens. On the acoustic lens 11, an ink pod 15 is placed. In the ink pod 15, an ink chamber getting narrower gradually so as to wrap the passage of ultrasonic beams from the piezoelectric element array is formed on the recessed surface of the acoustic lens 11. The ink chamber is filled with liquid ink 18.

On the bottom surface of the glass plate, a component member of the acoustic lens 11, an integrated driving circuit (hereinafter, referred to as a driving IC) 21 is mounted. The driving IC 21 is connected to the common electrode 12 and discrete electrodes 14 via a wiring pattern on the glass plate.

Figure 8:
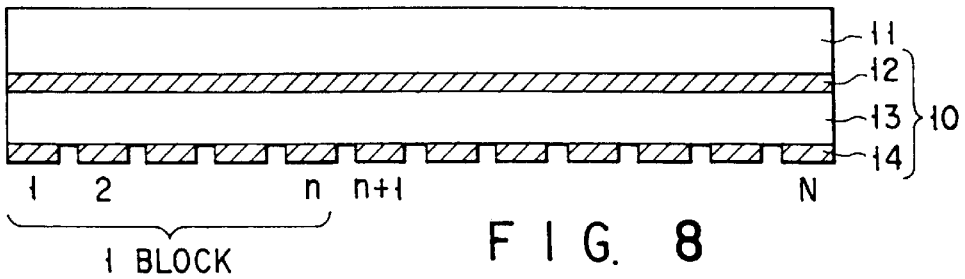
FIG. 8 is a sectional view taken along a line in which the piezoelectric elements are juxtaposed as shown in FIG. 7.
Figure 9:
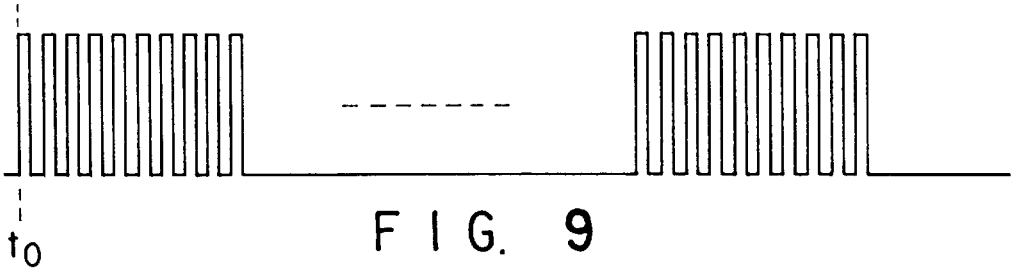
FIG. 9 is a diagram illustrating the voltage waveform of the drive signal used in Embodiment 1-3.

The driving IC 21 performs linear electronic scanning by driving the piezoelectric element array 10 according to the image data to be recorded in such a manner that blocks of n adjacent piezoelectric elements in the array direction (the arrangement direction of piezoelectric elements, the main-scanning direction) are driven one after another. Specifically, high-frequency driving signals with a specific phase difference are supplied to the n piezoelectric elements in the selected block and these piezoelectric elements are driven simultaneously, thereby causing the ultrasonic beams emitted from the piezoelectric element array 10 to converge in the main-scanning direction. More specifically, as shown in FIG. 8, if the total number of elements in the piezoelectric element array 10 is N and the number of piezoelectric elements driven at the same time is n, the first to n-th piezoelectric elements are driven simultaneously with a specific phase difference between them. Then, the second to (n+1)th piezoelectric elements are driven simultaneously with a specific phase difference between them. Similarly, the positions of piezoelectric elements simultaneously driven are shifted by one element each time the piezoelectric elements have been driven, thereby causing the direction of ultrasonic beams forced to converge to move linearly in the main-scanning direction. The waveform of the driving signal may be a rectangular burst as shown in FIG. 9 or a sinusoidal burst. Changing the phase difference for driving n piezoelectric elements means changing the timing that the driving signal of FIG. 9 starts to be applied.

The ultrasonic beam emitted from the piezoelectric element array 10 and forced to converge in the main-scanning direction is further forced by the acoustic lens 11 to converge in the direction (the sub-scanning direction) perpendicular to the main-scanning direction, and finally converges on the liquid surface of ink 18 in the form of a dot. The pressure (radiation pressure) generated by the ultrasonic beams converged at the ink liquid surface grows a conical ink meniscus at the ink liquid surface, and in a short time, a droplet of ink is squirted from the tip of the ink meniscus. The squirted ink droplet flies straight on a recording medium (not shown), adheres to it, and is dried and fixed, thereby effecting image recording.

Here, one of the parameters determining the size of a flying ink droplet is the frequency of an ultrasonic wave. Since the piezoelectric element array 10 radiates ultrasonic waves making use of the resonance along the thickness of the piezoelectric layer 13, the frequency is determined by the thickness of the piezoelectric layer 13. Since the thickness is in inverse proportion to the frequency, the thinner the piezoelectric layer, the higher the frequency. Therefore, a printer with a higher resolution needs ultrasonic waves of higher frequencies, and the type and formation of the piezoelectric layer 13 must be selected accordingly.

In addition to the thickness determined by the resolution, chief conditions for selecting the type of piezoelectric layer are an electromechanical coupling coefficient indicating the efficiency of converting an electric input into an ultrasonic output and a dielectric constant having an effect on the electrical matching with the driving IC. Ceramic such as zirconium titanate (PZT) and zinc oxide, macromolecular material such as a copolymer of vinylidene fluoride and ethylene trifluoride, a single crystal such as lithium niobate are used for the piezoelectric layer. Practically, PZT is suitable for a printer with a resolution of 600 dpi (dots per inch) or below and ZnO is suitable for a printer with a resolution (frequency) higher than 600 dpi in terms of the formation of the piezoelectric layer 13 and performance. When a bulk of PZT is ground for a piezoelectric layer, an adhesive layer intervenes between the common electrode 12 and the acoustic lens 11, which is not shown in FIG. 7.

The electrode 12 and electrodes 14 are formed by a thin filming technique such as evaporation of Ti, Ni, Al, Cu, or Au or sputtering, or by a baking technique based on printing using a screen of glass frits mixed with silver paste. Furthermore, the acoustic lens 11 is formed of glass or resin. When PZT is caused to adhere to the acoustic lens 11, the workability of lens material and the acoustic matching with the ink 18 in the piezoelectric layer 13 are taken into account. When ZnO is deposited by sputtering, however, the temperature at the time of sputtering and the ease of orientation of the piezoelectric layer are taken into consideration, in addition to the above factors.

Embodiment 1-4

Figure 10:
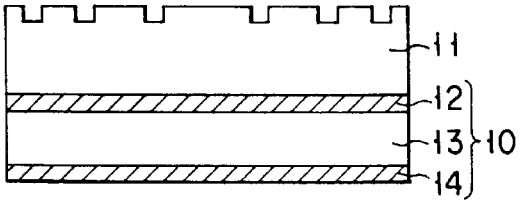
FIG. 10 is a sectional view of the recording head section used in an ink-jet recording device according to Embodiment 1-4 of the present invention.

FIG. 10 is a sectional view of a major portion of the recording head section in an ink-jet recording device according to an Embodiment 1-4 of the present invention. This is an example of using a Fresnel lens with straight slits in specific positions as the acoustic lens 11 in place of the concave lens of FIG. 7. The distance ri between slits and the depth d are expressed by the following equations:

$$ri = \left\{\left(\frac{(2i-1)\lambda w}{2}\right)\times\left(F+\frac{(2i-1)\lambda w}{8}\right)\right\}^{1/2}$$

($i$ = a natural number)

$$d = \frac{1}{2\times\left(\frac{1}{\lambda w}-\frac{1}{\lambda l}\right)}$$

where ri is the distance from the center of the aperture of the lens, λw is the wavelength of an ultrasonic wave in ink, and λl is the wavelength of an ultrasonic wave in lens.

Embodiment 1-5

Figure 11:
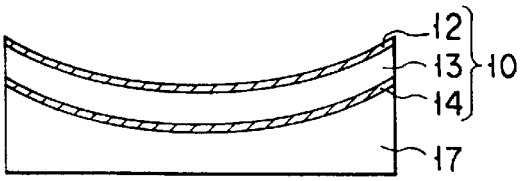
FIG. 11 is a sectional view of the recording head section used in an ink-jet recording device according to Embodiment 1-5 of the present invention.

FIG. 11 is a sectional view of a major portion of the recording head section in an ink-jet recording device according to an Embodiment 1-5 of the present invention. In this embodiment, by forming the piezoelectric element array 10 into a concave shape using part of a circular cylinder instead of using an acoustic lens, ultrasonic beams are forced to converge in the sub-scanning direction. In this case, the piezoelectric element array 10 is supported on the piezoelectric element support 17.

Embodiment 1-6

Figure 12:
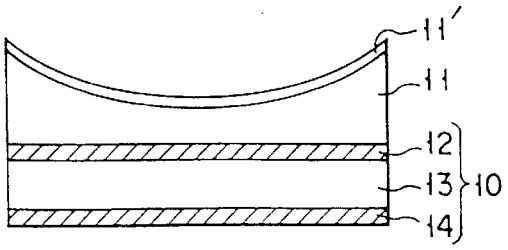
FIG. 12 is a sectional view showing the recording head section incorporated in an ink-jet recording device according to Embodiment 1-6 of the invention.

FIG. 12 is a sectional view of a major portion of the recording head section in an ink-jet recording device according to an Embodiment 1-6 of the present invention. In this embodiment, an acoustic matching layer 11' is formed on one side of the acoustic lens 11 opposite to the piezoelectric element array 10.

Embodiment 1-7

Figure 13:
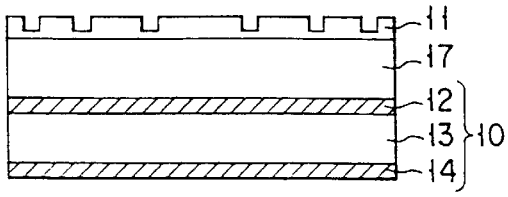
FIG. 13 is a sectional view showing the recording head section provided in an ink-jet recording device according to Embodiment 1-7 of this invention.

FIG. 13 is a sectional view of a major portion of the recording head section in an ink-jet recording device according to an Embodiment 1-7 of the present invention. While in Embodiment 1-4, the acoustic lens 11 of a Fresnel lens also serves as the support for the piezoelectric element array 10, in this embodiment, the piezoelectric element support 17 and the acoustic lens 11 are provided separately.

A more concrete embodiment associated with Embodiment 1-3 to Embodiment 1-7 will be explained taking the basic structure of FIG. 7 as an example. Five 4.5-cm-long PZT piezoelectric ceramic plates with a relative permittivity of 2000 were used as the piezoelectric layer 13, whose resonance frequency was determined to be 50 MHz (for a thickness of 40 m). At the time of mounting, these five ceramic plates were arranged on the acoustic lens, and a Ti/Ni/Au electrode was formed on both sides by sputtering to a thickness of 0.05 μm, 0.05 μm, and 0.2 μm in that order, followed by a polarizing process under an electric field of 2 kV/mm. Thereafter, by etching the electrode on one side of the piezoelectric layer 13, 3000 60-μm-wide discrete electrodes 14 were formed at intervals of 15 μm (a piezoelectric element arranging pitch of 75 μm). Then, the piezoelectric layer 13, the common electrode 12 on the other side, and these discrete electrodes 14 constituted a piezoelectric element array 10.

A 1-mm-thick pyrex was used as the acoustic lens 11 and worked into a concave so as to provide a lens curvature of 2.3 mm and an aperture of 1.5 mm. The acoustic lens 11 was bonded to the piezoelectric element array 10 with an epoxy resin adhesive so that the opening (concave) of the acoustic lens 11 may align with the position of the electrode of the piezoelectric element array 10. Then, an ink pod 15 was provided and a driving IC 21 was connected as shown in FIG. 7, in which way an ink-jet head was formed. The depth of ink 18 was determined to be 3 mm and the distance from the common electrode 12 to the ink liquid surface was determined to be 4 mm.

Next, as a comparison example, a piezoelectric element array was produced by cutting with a dicing saw according to the above-described specification. Specifically, electrodes were formed on both sides of a 40-μm-thick PZT piezoelectric layer in the same manner as the above embodiment, and the resulting layer was bonded to an acoustic lens material with an epoxy resin. Thereafter, by using a dicing saw with a 15-μm-thick blade, slits were made as far as part of the acoustic lens material so that the piezoelectric layer may be cut off completely.

By measuring the impedance characteristic using Embodiment 1-3 to 1-7 and the first comparison example, a check was made to see if there was any faulty channel. As a result, while in Embodiment 1-3 to Embodiment 1-7, none out of 3000 piezoelectric elements was faulty, in the first comparison example, 467 out of 3000 piezoelectric elements presented higher impedance. When the high-impedance places were seen through a microscope, cracks were found in the array direction of the piezoelectric layer. Thereafter, the ink-jet head of the first comparison example was immersed in an epoxy stripping agent to separate from the acoustic lens. Then, the piezoelectric layer was examined, and it found that the layer was damaged clearly.

As a second comparison example, an ink-jet head with a cutting-off pitch large enough to prevent damage to the piezoelectric layer was produced. The frequency was the same 50 Mhz and a 40-μm-thick PZT piezoelectric layer was used. On both sides of the piezoelectric layer, electrodes ware formed as in the first comparison example, and the resulting layer was bonded to an acoustic lens material with an epoxy resin. Thereafter, by using a dicing saw with a 15-μm-thick blade, slits were made as far as part of the acoustic lens material with a pitch of 150 μm. The number of piezoelectric elements was 15000. When the impedance characteristic of the ink-jet head was determined, no faulty channel was found.

Next, when a sound field in water was measured using the ink-jet heads of Embodiment 1-3 to Embodiment 1-7 and the second comparison example, and the beam widths and the grating grove levels of the ultrasonic beam were compared at the central axis of −10 dB, it was found that the beam width was 0.16 mm in the embodiments and 0.20 mm in the second comparison example, and the grating grove level was −17 dB and −6 dB in the second comparison example. Namely, the beam width at the central axis was narrower in the embodiments, enabling ultrasonic beams to converge better, but the difference was not distinctive. In contrast, the grating grove level in the embodiments was 11 dB lower. This means that while in the comparison examples, there is a possibility that ink will fly from irrelevant points, Embodiment 1-3 to Embodiment 1-7 are free from such a problem.

Next, an ink-droplet flying test was carried out actually. The driving signal voltage waveform applied to the piezoelectric element array was a 20-MHz rectangular burst, the number of waves was 500 (25 μs), and the voltage was 100 V. In Embodiment 1-3 to Embodiment 1-7, when the 2000 elements in the piezoelectric element array were grouped into blocks of 20 elements and one block was driven simultaneously, a droplet of ink was squirted only from the central axis. In contrast, in the second comparison example, in addition to those from the central axis, droplets of ink were squirted from the places near one end of 1500 elements where a grating grove has occurred. Examination of the phenomenon showed that the flying of ink droplets from the places other than the central axis took place due to a subtle inclination of the head. It is found that it was very difficult to adjust the head. Therefore, it is not practical that when not only discrete electrodes but also the piezoelectric layer are cut off, the cutting-off pitch is widened to prevent damage to them.

The above results apply not only to the case where the acoustic lens 11 is a concave lens, but also to the case where the acoustic lens is a Fresnel lens and the case where the piezoelectric element has a concave shape as shown in FIG. 11. In the case of a concave piezoelectric element, it is difficult to form a piezoelectric element into a concave and then to cut off the concave element into an array. Furthermore, when higher frequencies are used to make ink droplets smaller, the arranging pitch on piezoelectric element array must be made narrower to eliminate the effect of the grating grove. For this reason, dividing only discrete electrodes to form an array is much more effective in a piezoelectric element array as with the present invention.

As described above, with Embodiment 1-3 to Embodiment 1-7, by array-dividing only discrete electrodes without cutting off the piezoelectric layer, the arranging pitch on the piezoelectric element array can be made smaller without reducing the manufacturing yield than when the piezoelectric layer as well as discrete electrodes are array-divided. Furthermore, these embodiments are effective in making ultrasonic waves higher, so that high-resolution recording can be effected easily.

Embodiment 1-8

Figure 14:
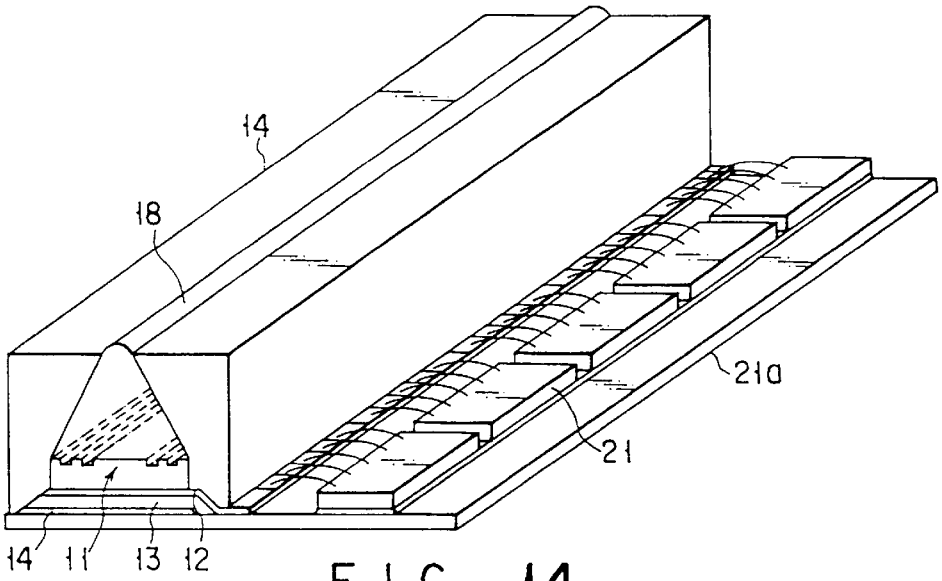
FIG. 14 is a perspective view of the recording head section used in an ink-jet recording device according to Embodiment 1-8 of the present invention.

FIG. 14 is a perspective view of the recording head section in an ink-jet recording device according to an Embodiment 1-8 of the present invention.

Embodiment 1-8 is characterized in that in a piezoelectric element array, gaps or slits are made in at least one portion of the longitudinal side of the piezoelectric layer.

In FIG. 14, a piezoelectric element array 10 is composed of a piezoelectric layer 13 of a long plate with a constant thickness, a common electrode 12 formed on one side of the layer and discrete electrodes 14 formed on the other side of the layer. Namely, the piezoelectric layer 13, common electrode 12, and discrete electrodes 14 constitute a plurality of piezoelectric elements arranged one-dimensionally.

The following materials are suitable for the piezoelectric layer 13. As one of typical piezoelectric layers with a large electromechanical coupling coefficient, PZT ($Pb(Zr, Ti)O_3$)

is given. Since its relative permittivity is as high as 500 to 2000, its impedance drops too much in high-frequency driving and therefore it cannot be used. It is suitable for low-frequency driving. ZnO among ceramic materials and PVD (Polyvinyl-Diphenylfluoride) among organic materials are desirable for a piezoelectric layer with a relative permittivity of only about 10 suitable for high-frequency driving.

On the surface of the common electrode 12 opposite to the piezoelectric layer 13, an acoustic lens 11 is formed. The acoustic lens 11 is a Fresnel lens with straight slits in specific positions in Embodiment 1-8 and may be a lens produced by forming a concave on the surface a glass plate. On the acoustic lens 11, an ink pod 15 is placed. In the ink pod 15, an ink chamber getting narrower gradually so as to wrap the passage of ultrasonic beams from the piezoelectric element array 10 is formed on the recessed surface of the acoustic lens 11. The ink chamber is filled with liquid ink 18.

The head portion thus constructed is mounted together with a driving IC 21 on a wiring substrate 21*a*. The driving IC 21 is connected to the common electrode 12 via a wiring pattern (not shown) on the wiring substrate 21*a* and further connected to the discrete electrodes 14 via bonding wires.

The basic image recording operation in this embodiment is the same as in Embodiment 1-3. Specifically, the driving IC 21 performs linear electronic scanning by driving the piezoelectric element array 10 according to the image data to be recorded in such a manner that blocks of n adjacent piezoelectric elements in the array direction (the main-scanning direction) are driven one after another. Specifically, high-frequency driving signals with a specific phase difference are supplied to the n piezoelectric elements in the selected block and these piezoelectric elements are driven simultaneously, thereby causing the ultrasonic beams emitted from the piezoelectric element array 10 to converge in the main-scanning direction. Similarly, the positions of piezoelectric elements simultaneously driven are shifted by one element each time the piezoelectric elements have been driven, thereby causing the direction of ultrasonic beams forced to converge to move linearly in the main-scanning direction.

The ultrasonic beam emitted from the piezoelectric element array 10 and forced to converge in the main-scanning direction is further forced by the acoustic lens 11 to converge in the direction (the sub-scanning direction) perpendicular to the main-scanning direction, and finally converges on the liquid surface of ink 18 in the form of a dot. The pressure (radiation pressure) generated by the ultrasonic beams converged at the ink liquid surface grows a conical ink meniscus at the ink liquid surface, and in a short time, a droplet of ink is squirted from the tip of the ink meniscus. The squirted ink droplet flies straight on a recording medium (not shown), adheres to it, and is dried and fixed, thereby effecting image recording.

Figure 15:
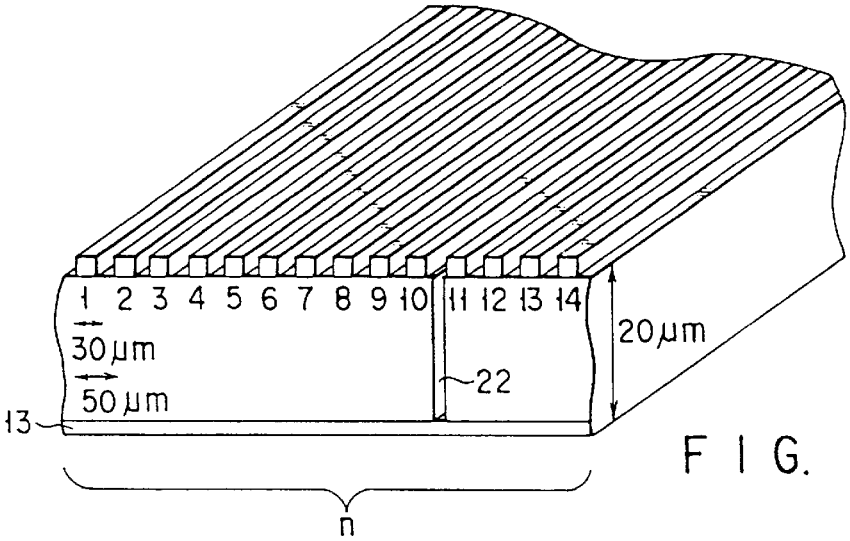
FIG. 15 is a perspective view of the recording head section of Embodiment 1-8, as looked at in the direction perpendicular to the row of piezoelectric elements are juxtaposed as shown in FIG. 14.

FIG. 15 is a perspective view of the piezoelectric element array 10 in the ink-jet head shown in FIG. 14, seen from the direction perpendicular to the array direction. As shown in the figure, a gap 22 is made in the piezoelectric layer 13 so as to go through at least a part of the longitudinal side (the array direction) of the layer across the thickness. It is desirable that the number K of gaps 22 made in the piezoelectric layer 13 should be in the range of N/2>=K>=N/n and they be provided at regular intervals, where N is the total number of piezoelectric elements constituting the piezoelectric element array 10 and n is the number of piezoelectric elements driven simultaneously.

When the piezoelectric layer 13 is divided into N pieces according to N piezoelectric elements constituting the piezoelectric element array 10, crosstalk noise is the smallest. Dividing the piezoelectric layer 13 into individual elements leads to a significant drop in the mass productivity. If the number of gaps is set at N/2>=K, the distance between gaps 22 will be 100 $\mu$m or more. Thus, by cutting deep into the piezoelectric layer with a dicer, gaps 22 can be made easily. If the number of gaps is in the range of K>=N/n at minimum, the effect of reducing crosstalk will never fail to appear in driving to squirt individual droplets. Since the width of the gap 22 may be very small, if piezoelectric layers of the size corresponding to n signal lines or as large as an integral multiple of that size, the effect will not change. Such gaps as made in part of the thickness or width of the piezoelectric layer produce a similar effect.

A more concrete embodiment will be described. Using a piezoelectric layer that has a gap for every n piezoelectric elements (n=14 in FIG. 15) for K>=N/n, the minimum number of gaps, as shown in FIG. 15, generated crosstalk was measured. The piezoelectric layer was produced by making slits in a 1.05-mm-wide ZnO sintered material with a dicer with ten blades arranged so as to move parallel to the material and carrying out an automatic cutting operation in which the dicer is moved in parallel.

Figure 16:
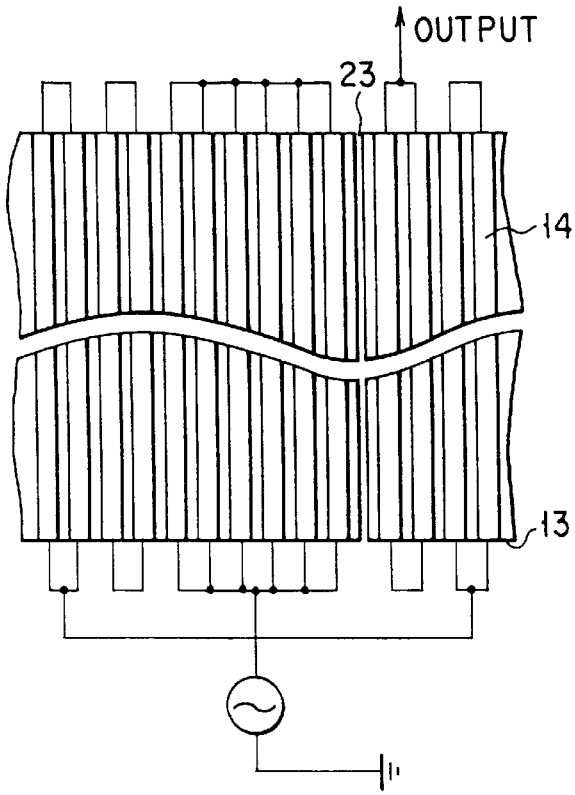
FIG. 16 is a diagram explaining how signals are input to the array of piezoelectric elements in order to confirm reduction in cross talk in Embodiment 1-8.
Figure 17:
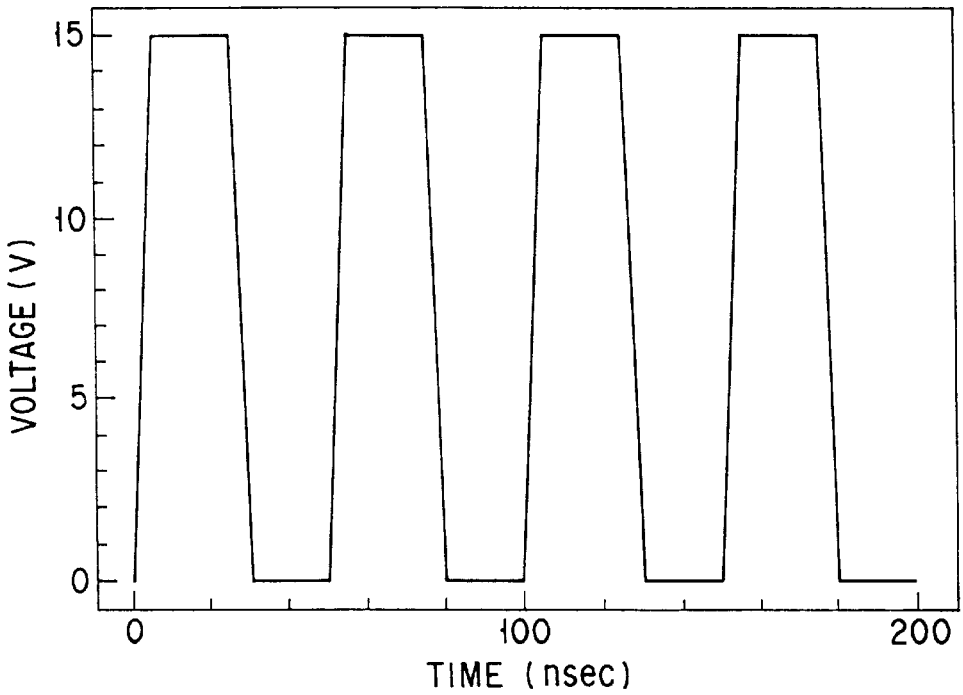
FIG. 17 is a diagram illustrating the waveform of the drive signal used to measure the reduction in cross talk in Embodiment 1-8.
Figure 18:
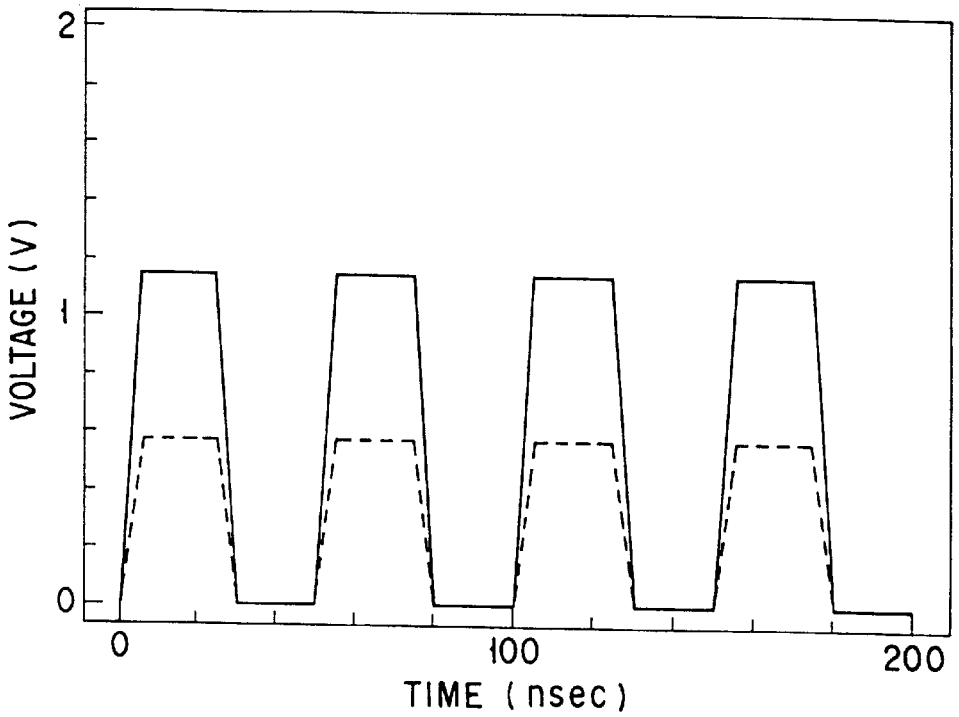
FIG. 18 is a diagram showing the voltage waveform of noise generated in a line to which no signals are input.

FIG. 16 diagrammatically shows the piezoelectric element 10, piezoelectric layer 13, and discrete electrodes 14 to explain how a signal is applied to the array to examine the effect of reducing crosstalk. While a driving signal voltage of a 100-MHz burst waveform shown in FIG. 17 was being applied to only the central portion and both end portions of the (n) piezoelectric elements in one block that squirts a single droplet of ink, noise generated on the lines near the gap 22 applied with no driving signal voltage, or crosstalk was measured. Although no output waveform should be found on the lines, noise was measured in the form of the output waveform shown by broken lines in FIG. 18. Its amplitude is 4% or less (FIG. 18 has an enlarged ordinate of FIG. 17) and there was no phase shift. Using the piezoelectric layer 13 with such gaps, an ink-jet head as shown in FIG. 14 was constructed. Then, when the ink-jet head was operated on a printer, a A4-size monochromatic print with a high resolution of 600 dpi could be obtained in 30 seconds.

Figure 19:
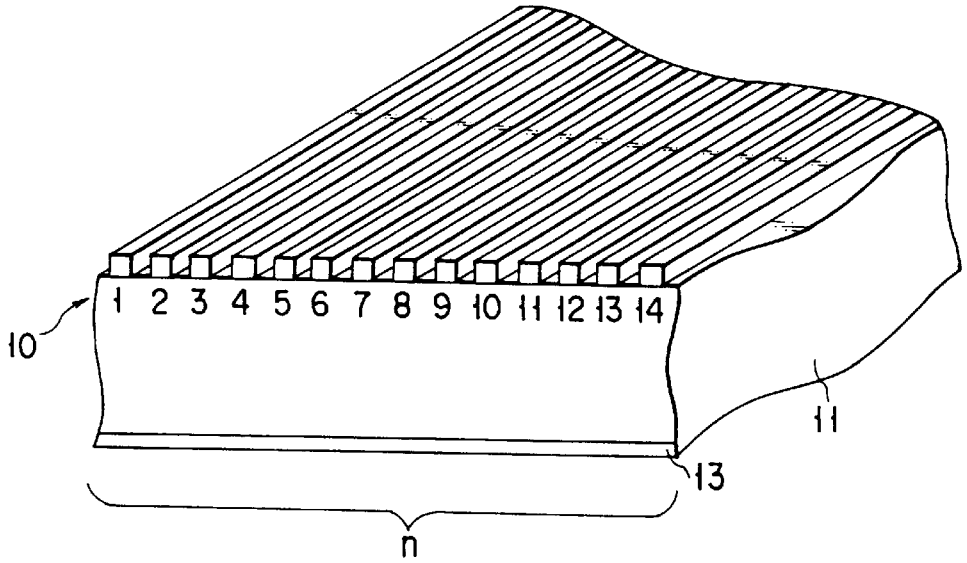
FIG. 19 is a perspective view of a conventional ink-jet head, for comparison with the recording head section of Embodiment 1-8.
Figure 20:
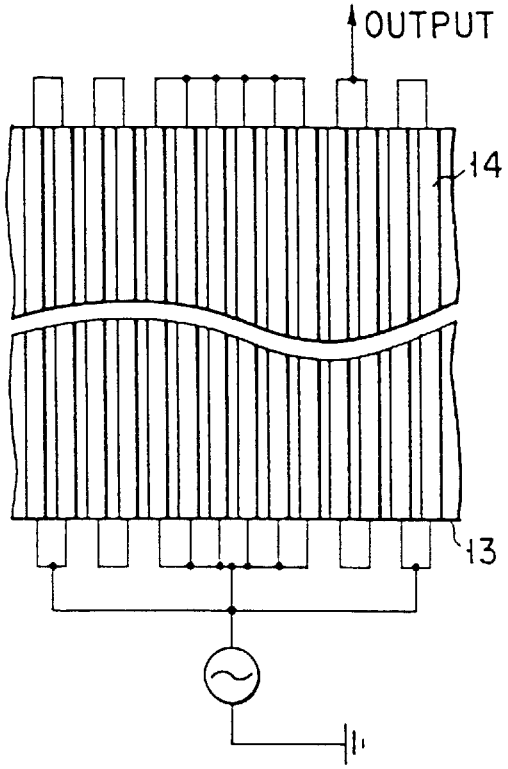
FIG. 20 is a diagram explaining how signals are input to the array of piezoelectric elements in order to confirm reduction in cross talk in the conventional ink-jet head.

As a comparison example, an ink-jet head was constructed using the piezoelectric layer 13 shown in FIG. 19. The piezoelectric layer 13 in FIG. 19 is the same as that in the embodiment except that no gap is made. Like FIG. 16, FIG. 20 diagrammatically shows the piezoelectric element 10, piezoelectric layer 13, and discrete electrodes 14 to explain how a signal is applied to the array. As in the embodiment, while a driving signal voltage of a 100-MHz burst waveform shown in FIG. 17 was being applied to only the central portion and both end portions, crosstalk noise generated on the lines near the gap applied with no driving signal voltage, was measured. Crosstalk noise was measured in the form of the output waveform shown by solid lines in FIG. 18. The amplitude of the crosstalk noise was 8% or less, more than twice the amplitude measured in the embodiment.

As described above, with Embodiment 1-8, crosstalk can be suppressed to a low level, so that it is possible to realize high-resolution ink-jet recording needing high-frequency driving. A relatively small number of caps have only to be formed on the piezoelectric layer to form an ink-jet head, maintaining the mass productivity.

Embodiment 1-9

Figure 21:
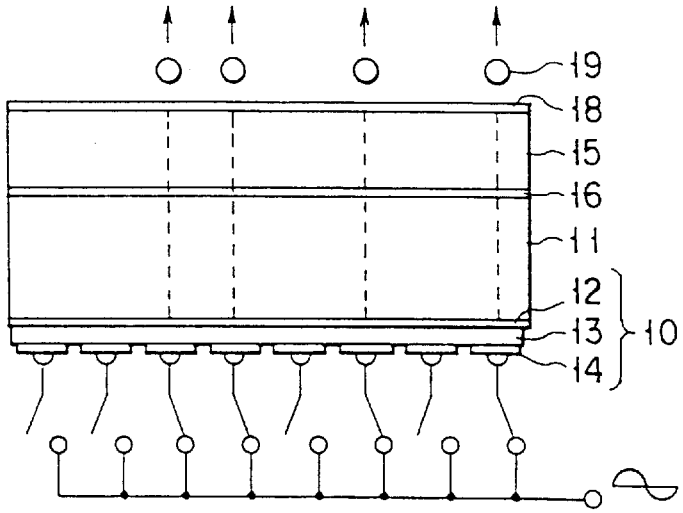
FIG. 21 is a diagram showing the recording head section of an ink-jet recording device according to Embodiment 1-9.

FIG. 21 shows the structure of a recording head section according to an Embodiment 1-9 of the present invention. Embodiment 1-9 differs from Embodiment 1-1 in that ultrasonic beans are forced to converge without effecting phased array scanning by using only a one-dimensional Fresnel zone plate 16.

In Embodiment 1-9, the wavelength of the ultrasonic beam emitted from the piezoelectric element array 10 is set at a sufficiently small value as compared with the pitch on the piezoelectric element array 10. The ultrasonic beams of such a short wavelength advance straight without diverging in the direction perpendicular to the surface of the piezoelectric layer 13, passes through the ink chamber, and strikes the surface of ink 18, thereby squirting an ink droplet 19 with a size close to the wavelength in the ink 18, that is, with a sufficiently small (or too a small) droplet size with respect to the necessary resolution.

According to the experiment conducted by the inventors, even when the surface of ink 18 is hit by ultrasonic beams of a relatively long wavelength as compared with a flying ink droplet 19 corresponding to the wavelength of the ultrasonic beams as in Embodiment 1-9, the ink droplet 19 flies from the central portion of the ultrasonic beams accurately and stably because the ultrasonic beams have an intensity distribution where the intensity attenuates radially outward.

The problem that the flying ink droplet 19 is too small as compared with the resolution can be solved by performing multiple recording (or overwriting) where ink droplets are forced to fly straight on the same pixel consecutively, to make the dot thicker. The operation of making a pixel thicker by overwriting can be put to practical use only by a method of generating ink droplets at a high-speed repeating period that enables dots to merge one another in ink droplets by forcing a subsequent flying ink droplet to arrive before the preceding flying ink droplet has been absorbed by the recording sheet. Therefore, this is an effect unique to an ink-jet recording device featuring high-speed recording.

Furthermore, with Embodiment 1-9, since grouping in a main-scanning direction is not necessary, many ink droplets can be squirted in a single operation and recording time can be reduced.

Embodiment 1-10

With an ink-jet recording device of the present invention, an alternating-current voltage of a constant frequency or a pulse voltage is applied in a burst to the piezoelectric element array 10, which then generates ultrasonic beams synchronized with the frequency. In this case, to effect phased array scanning in Embodiment 1-1 and Embodiment 1-3, the phase of the ultrasonic beams generated from adjacent piezoelectric elements must be set so that they may each focus on specific positions.

In Embodiment 1-10, a configuration of the driving circuit for the recording head used in the ink-jet recording devices in Embodiment 1-1 and Embodiment 1-2 will be explained.

A configuration where a driving circuit for phased array scanning is mounted integrally on a head substrate on which a piezoelectric element array generating ultrasonic beams is new and produce a unique effect.

It is well known that in an ink-jet recording device using ultrasonic beams, flying ink droplets depend greatly on the frequency of ultrasonic waves. To obtain the necessary resolution for a printer, the frequency of driving voltage ranging from several tens MHz to several hundreds MHz is needed. To apply a voltage of such high frequencies to each piezoelectric element to drive the piezoelectric element array and control the driving phase at an accuracy necessary for phased array scanning, the magnitude of delay due to long wiring distances and variations in the delay in the scanning circuit must be taken into consideration on the order of nanoseconds ($10^{-9}$ sec). On this subject, the inventors actually made the following circuit and conducted an experiment to compare the performance. Specifically, the following three types of oscillators to produce a using frequency are compared with each other in terms of performance:

(A1) A CR oscillator composed of a delay circuit made up of a capacitor and a resistor in each IC chip and a buffer circuit.

(A2) A ring oscillator composed of a plurality of buffer circuits connected in series (A3) A configuration where a signal from an external quartz-crystal oscillator is directed into an IC via printed wires on the head substrate.

The following three types of delay circuits for delay control to provide a phase difference in driving each piezoelectric element necessary for phased array scanning are compared with each other in terms of performance:

(B1) A delay circuit composed of a capacitor and a resistor in each IC chip.

(B2) A delay circuit composed of a plurality of buffer circuits connected in series.

(B3) A configuration where a plurality of signals delayed outside the circuit are directed into the IC via a plurality of printed wires on the head substrate.

The comparison results showed that methods by which errors in each circuit and errors between adjacent circuits can be minimized and the necessary accuracy can be obtained are (A3) and (B3)

The above results suggest that a circuit for driving separate piezoelectric elements needs a data selector circuit. Because the driving circuits arranged on the head substrate are required by the printed wires provided close to and in parallel with these circuits and each supplying pulse trains of different phases to select the pulse of the necessary phase according to the respective timing, they need a data selector circuit. With the present invention, by providing the data selector circuit, it is possible to realize a compact, simple driving circuit having the function of applying to the piezoelectric element array a burst pulse voltage with an accurate specific phase difference necessary for phased array scanning.

Figure 22:
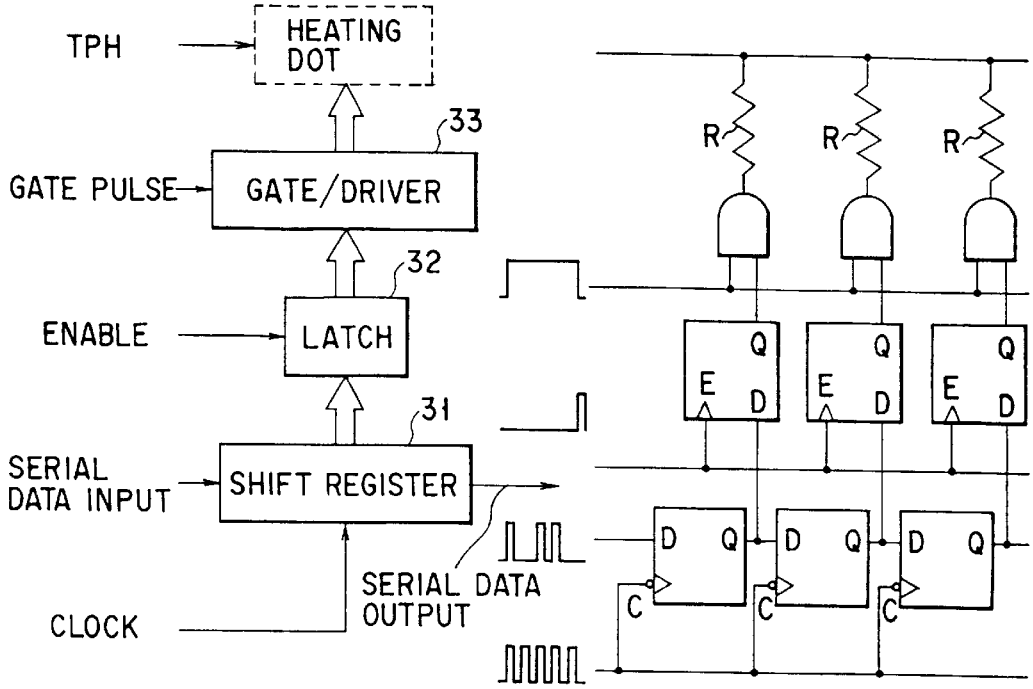
F I G. 22 (PRIOR ART)
FIG. 22 is a diagram of a thermal head drive circuit to be mounted on a conventional head substrate.

One of the most typical examples of a compact driving circuit IC mounted on the head substrate is a thermal head driving IC. As shown in FIG. 22, the thermal head driving IC generally comprises an image data transfer shift register 31 also capable of input and output to another chip, a latch 32 that takes in the image data transmitted via the shift register 31 in parallel, and a gate/driver 33 that controls the passing of a common pulse determining the timing and width according to the image data held in the latch 32. The heading dots (heating resistive elements) in the thermal head TPH are driven by the output pulse voltage from the gate/driver 33.

To drive the piezoelectric element array in an ink-jet recording device using ultrasonic beams to effect phased array scanning, the gate/driver 33 of FIG. 22 must be replaced with another circuit. As described above, to realize phased array scanning, it is desirable that the necessary pulse train should be selected from several consecutive pulse trains with different phases. Therefore, the final stage must be a data selector instead of a gate. Thus, the recording head driving IC in the ink-jet recording device using ultrasonic beams is composed of the shift register 31, latch 32, and data selector/driver 34 as shown in FIG. 23.

Figure 23:
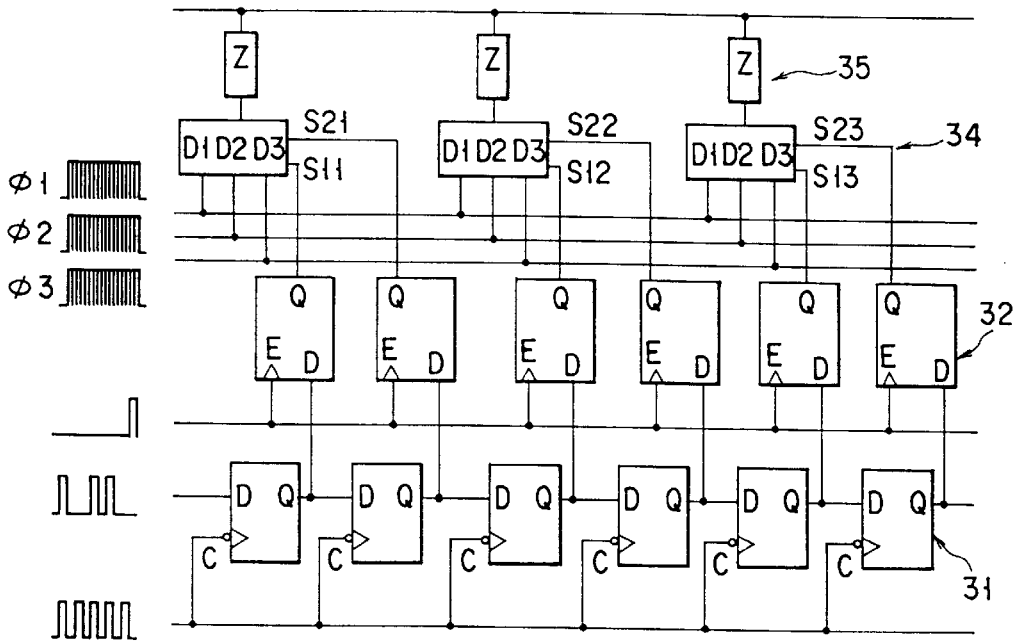
FIG. 23 is a diagram showing the circuit for driving the recording head section incorporated in an ink-jet recording device according to Embodiment 1-10 of the present invention.

In FIG. 23, the shift register 31 transfers the serially inputted image data according to the clock pulse. The image data taken in the shift register 31 is transferred in parallel to the latch 32, which stores it temporarily. Data items corresponding to two adjacent piezoelectric elements in the image data temporarily stored in the latch 32 are supplied to the data selector/driver 34 as control codes S11, S21, S12, S22, S13, S23, S14, S24, . . . (where S14, S24 are not shown). A plurality of pulse trains 1, 2, 3, with different phases are inputted to the data selector/driver 34, which selects any one of the pulse trains 1, 2, 3, . . . according to the control signal code supplied from the latch 32. The pulse train is amplified to a suitable voltage level and applied to the discrete electrode of the corresponding piezoelectric element, thereby driving the piezoelectric element. By such an operation, phased array scanning can be effected.

The operation of the recording head driving circuit will be explained concretely, taking an example of effecting linear scanning by using four adjacent piezoelectric elements as a unit as shown in FIGS. 2A to 3E in Embodiment 1-1 and driving them while shifting the phase. Explanation will be given as to a case where the control signal codes supplied from the latch 32 to the data selector/driver 34 are set at S11=0, S12=1, S21=1, S22=0, S13=1, S23=0, S14=0, and S24=1.

For example, a voltage of burst wave with phase 1 leading 2 is applied to two outer ones of the four piezoelectric elements, and a voltage of burst wave with phase *2 is applied to the two inner piezoelectric elements, which forces the ultrasonic beams to converge in the main-scanning direction and strike the ink as shown in FIG. 2B. The data obtained by converting the original image data at an image data processing circuit (not shown) is inputted to the shift register 31 so that control codes S11, S21, S12, S22, S13, S23, S14, S24, . . . may take the above values in forming the recording pixels. When the original image data is 0, or when it is the data not forming a recording pixel, the image data inputted to the shift register 31 undergoes conversion at the image data processing circuit so that all of S11, S21, S12, S22, S13, S23, S14, S24, . . . may be 0.

The driving circuit in Embodiment 1-10 is new in the following points:

(1) The final stage is not a single gate, but a data selector (data selector/driver 34).

(2) A plurality of signal wires for supplying pulse trains selected at the data selector/driver 34 are provided as common lines for the individual piezoelectric elements on the head substrate.

(3) A multi-bit signal for controlling the data selector/driver 34 is inputted to the serial input line for inputting the image data to the shift register 31.

As for the third feature, a parallel input may be used instead of the serial input of FIG. 23. The former has the advantage that the number of input/-output terminals on a driving IC is small, and the latter has the advantage that the transfer speed need not be reduced.

With the recording head driving circuit, when the size of flying ink droplets must be controlled, use of a configuration of selecting the necessary pulse from consecutive pulse trains of different frequencies makes it easy to realize the control.

The basic configuration of the present invention has been described. In embodiment 301 to Embodiment 3-3, the grouping of piezoelectric elements (vibrators) will be explained.

Embodiment 2-1

Figure 24:
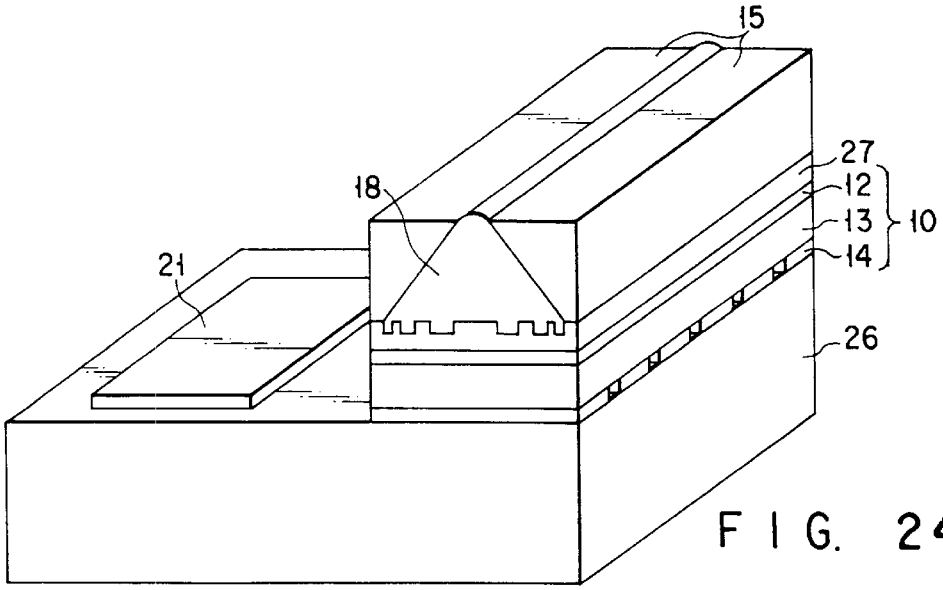
FIG. 24 is a perspective view illustrating the recording head section incorporated in an ink-jet recording device according to Embodiment 2-1 of the present invention.
Figure 25A:
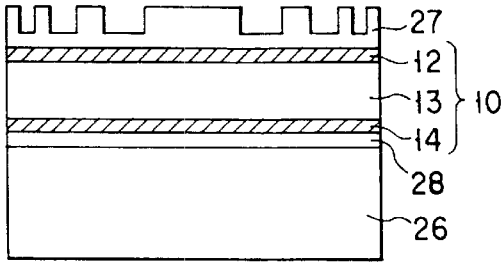
FIGS. 25A and 25B are sectional views of a recording head section designed for use in Embodiment 2-1.
Figure 25B:
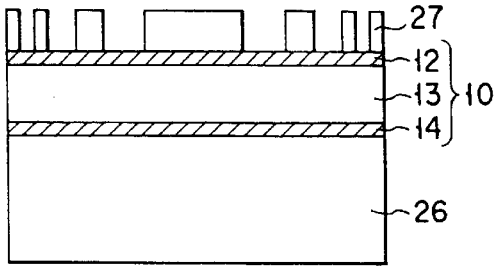

FIG. 24 is a perspective view of the recording head section in an ink-jet recording device according to an Embodiment 2-1 of the present invention. FIGS. 25A and 25B show the recording head of another ink-jet recording device in Embodiment 2-1.

Embodiment 1-3 is characterized by an acoustic matching layer.

In FIG. 24, a piezoelectric element array 10 is composed of a piezoelectric layer 13 of a long plate with a constant thickness, a common electrode 12 formed on one side of the layer and a plurality of discrete electrodes 14 formed on the other side of the layer. Namely, the piezoelectric layer 13, common electrode 12, and discrete electrodes 14 constitute a plurality of piezoelectric elements arranged one-dimensionally. One of ceramic such as zirconium titanate (PZT), macromolecular material such as a copolymer of vinylidene fluoride and ethylene trifluoride, a single crystal such as lithium niobate, and a piezoelectric semiconductor such as zinc oxide is selected and used for the piezoelectric layer 13 according to the frequency of ultrasonic beam and the size of element. The electrode 12 and electrodes 14 are formed on the piezoelectric layer by a thin filming technique such as evaporation of Ti, Ni, Al, Cu, or Au or sputtering, or by a baking technique based on printing using a screen of glass frits mixed with silver paste.

The piezoelectric element array 10 is formed on a backing material 26. The piezoelectric element array 10 may be formed directly on the backing material by sputtering or CVD techniques and also may be formed via an adhesive layer 28 as shown in FIG. 25A.

On the surface of the common electrode 12 opposite to the piezoelectric layer 13, an acoustic matching layer 27 is formed. The acoustic matching layer 27 matches the piezoelectric element array 10 with ink acoustically. The acoustic impedance of the matching layer is set at a value near the square root of the product of the acoustic impedance of the piezoelectric layer 13 and that of ink. Practically, epoxy resin, a mixture of epoxy resin and fiber, or a mixture of epoxy resin and aluminum or tungsten powder is used.

Materials for an acoustic matching layer-cum-acoustic lens 11" include, in addition to epoxy resin, resin material such as ethylene resin, propylene resin, styrene resin, methyl methacrylate resin, polyvinyl chloride, polyvinylidene chloride, polyvinyl acetate, styrol resin, cellulosic resin, imide resin, amide resin, fluoride plastic, silicon resin, polyester, polycarbonate, polybutadiene-type resin, nylon, polyacetal, urethane resin, phenol resin, melamine resin, or urea resin, and their copolymer resin. They also include rubber material such as polybutadiene rubber, natural rubber, or olefin rubber, and an inorganic compound such as various types of glass material, silicon, or its compound. They further include metal material such as aluminum, tin, lead, titanium, zinc, brass, or zirconium.

On the basis of the Fresnel zone theory, grooves are further made in the acoustic matching layer 27, which then also serves as an acoustic lens, means for forcing the ultrasonic beans from the piezoelectric element array 10 to converge in the direction (the sub-scanning direction) perpendicular to the array direction (the main-scanning direction) of the piezoelectric element array 10. The thickness t of the acoustic matching layer-cum-acoustic lens 11" is expressed as $t=\lambda m\times(2n+1)/4$ as shown in equation (1), where n is an integer and Am is the wavelength of ultrasonic wave in the acoustic matching material.

In the case of a Fresnel lens, the thickness t of the acoustic matching layer-cum-acoustic lens 11"0 of FIG. 24 has two types: the thickness t1 of a portion without slits and the thickness t2 of a portion with slits. As shown in equation (3), the depth d of the slits in the Fresnel lens is expressed as $d=1/\{2(1/\lambda i-1/\lambda m)\}$. Therefore, it is preferable that each of the thickness t1 of a portion without slits and the thickness t2 (t2=t1−d) of a portion with slits should meet equation (1), or not meet equation (2). From equation (2) and equation (3), the ratio of the wavelength λm in the acoustic matching material to the wavelength λi of ultrasonic wave in ink, or the ratio Vm/Vi of the sound speed Vm in the acoustic matching material to the sound speed Vi in ink is in the range given by the following expression:

$$\{(2n+3)/(2n+1)\}<(Vn/Vi)<\{(2n+1)/(2n-1)\} \quad (4)$$

Under this condition, a Fresnel lens is realized which provides acoustic matching, prevents the total reflection of ultrasonic waves at the lens interface, and has a high transmission efficiency of ultrasonic waves.

Furthermore, when the material for the acoustic matching layer-cum-acoustic lens where the sound speed Vm in the range given by equation (4) is nonresistant to the solvent contained in the ink, a protective film may be formed on the lens surface using a material resistant to the solvent. It is desirable that the protective film should have such a thickness as does not prevent ultrasonic waves from traveling and converging in ink and maintain the surface state that prevents air bubbles contained in ink from adhering to the surface. For example, material such as polyimide may be used for the protective film.

In the ink pod 15, an ink chamber getting narrower gradually so as to wrap the passage of ultrasonic beams from the piezoelectric element array 10 is formed on the acoustic matching-cum-acoustic lens 11". The ink chamber is filled with liquid ink 18. The driving IC 21 is formed on the backing material 26 and connected to the common electrode 12 and discrete electrodes 14 via a wiring pattern (not shown).

In the present embodiment, the piezoelectric element array 10 is driven by the driving IC 21 in such a manner that if the total number of piezoelectric elements constituting the piezoelectric element array 10 is N and the number of piezoelectric elements simultaneously driven is n, the first to n-th piezoelectric elements will be grouped with a specific phase difference or on the basis of the Fresnel diffraction theory so that the ultrasonic beams may focus on the liquid surface of the ink, and one end is shifted by a half-wave length and driven. Then, the positions of the piezoelectric elements simultaneously driven are moved by one element and the second to (n+1)th piezoelectric elements are driven. A similar operation is repeated until the (N−n+1)th to N-th piezoelectric elements are driven. In scanning, a shift of more than one element may be used in place of a shift of a single piezoelectric element. Furthermore, the piezoelectric elements simultaneously driven are not restricted to one group in the total elements and may belong to two or more groups.

A more concrete example according to an Embodiment 2-1 of the present invention will be explained.

A PZT piezoelectric ceramic plate with a relative permittivity of 2000 was used as the piezoelectric layer 13, whose resonance frequency was determined to be 20 MHz (for a thickness of 100 μm). A Ti/Ni/Au electrode was formed on both sides of the piezoelectric ceramic plate by sputtering to a thickness of 0.05 μm, 0.05 μm, and 0.2 μm in that order, followed by a polarizing process under an electric field of 2 kV/mm. Thereafter, by etching the electrode on one side of the piezoelectric layer 13, discrete electrodes 14 were formed so that the width of a piezoelectric element might be 120 μm and the distance between electrodes be 30 μm (the arrangement pitch of discrete elements be 150 μm). The length of the electrode in the sub-scanning direction was 5 mm.

Then, The acoustic matching layer-cum-acoustic lens 11" was produced using a material whose acoustic impedance was $6\times10^6$ Kg/m$^2$s by mixing epoxy resin with aluminum powder for acoustic matching material. The sound speed in the acoustic matching material is 3100 m/s, about twice the sound speed in ink. After the lens had been bonded to the resinous backing material 26 with epoxy resin, the ink pod 15 was positioned as shown in FIG. 24. Then, the driving IC 21 was connected, which completed an ink-jet head.

As a comparison example, by working glass into a concave, an ink-jet head that forces ultrasonic beams to converge in the sub-scanning direction was produced without using an acoustic matching layer-cum-acoustic lens.

With Embodiment 2-1, a resolution of about 200 dpi was achieved and ink was able to fly efficiently. With the comparison example, however, the resolution was about 150 dpi at most and an ink droplet sometimes did not fly even if a 1.5-fold driving signal voltage was applied.

While in Embodiment 2-1, the acoustic matching layer-cum-acoustic lens 11" has a single layer, it may have more layers.

As described above, with Embodiment 2-1, by forming an acoustic matching layer-cum-acoustic lens formed of the same material on the piezoelectric element array, the ultrasonic beams can be radiated without being reflected in the ink. Therefore, it is possible to force the ultrasonic beams to converge effectively on the liquid surface of the ink, thereby squirting an ink droplet efficiently. Furthermore, by the electronic focusing technique or a driving technique based on Fresnel-type grouping, an ink droplet can be forced to fly vertically, enabling high-resolution recording.

Embodiment 2-2

A method of manufacturing the acoustic matching layer-cum-acoustic lens 11" used in Embodiment 2-1 will be explained.

The Fresnel lens provided on the piezoelectric element array has an irregular cross section. If the wavelength of ultrasonic wave is λ, ultrasonic beans can converge provided that, for example, the difference in height between the projected portion and the recessed portion is λ/2, the height of the projected portion is 5λ/4, and the height of the recessed portion is 3λ/4. For example, when PZT with a relative permittivity of 2000 is used for the piezoelectric layer and the ultrasonic wave frequency is determined to be 7.5 MHz and the height of the projected portion of the Fresnel lens is determined to be 3λ/4 in a low driving frequency region, the height of the projected portion will be 300 μm and the height of the recessed portion will be 100 μm. In this case, the accuracy of the height of the projected portion and that of the recessed portion required for the ultrasonic beams to converge sufficiently is within ±10%.

The projected portion needs a work accuracy of ±30 μm and the recessed portion requires a work accuracy of ±10 μm. In this range, the necessary work accuracy can be achieved easily by, for example, cutting a molded piece of epoxy resin into a Fresnel lens and laminated the lens above the piezoelectric element array via an adhesive layer.

At a higher driving frequency, for example, at an ultrasonic wave frequency of 200 MHz, when λ is λ=16 μm and the height of the projected portion is 5λ/4, the height of the projected portion will be 20 μm, the height of the recessed portion will be 12 μm, the work accuracy required at the projected portion will be ±2 μm and the work accuracy required at the recessed portion will be ±1 μm. Therefore, the cutting work of a molded piece cannot provide a sufficient accuracy. Furthermore, one of means for manufacturing resinous molded pieces with a work accuracy of a thickness difference of 1 μm at the irregular portion is a method of molding thermoplastic resin using a nickel electroforming stamper used for compact discs as a mold. Although compact discs require a high accuracy for the difference between the projected and recessed portions, they need a thickness of 1 mm 10% at best. In constant, the Fresnel lens requires a high accuracy for the height of the irregular portion and sometimes has a 300-mm-long shape extending lengthwise. With a molding method used for compact discs, it is difficult to control the height of the irregular portion and molding cannot be effected at a high accuracy for the lengthwise thickness difference.

With the present embodiment, in a method of manufacturing resinous molded pieces to which a pattern is transferred using a metal mold on whose inner mold an reversed-lens-shaped stamper having a transfer pattern with a plurality of projecting parallel tracks is mounted, by forming resin relief grooves parallel to the projecting tracks and causing resin to flow in the direction perpendicular to the projecting tracks to transfer a pattern, it is possible to provide a method of manufacturing a transfer resin sheet whose irregular thickness and lengthwise thickness area controlled at a high accuracy. Furthermore, this method provides a resin sheet having a highly accurate lens pattern. Additionally, by providing a piezoelectric element array on the outer mold of the metal mold, an acoustic matching layer-cum-acoustic lens is formed of resin integrally on the piezoelectric element array.

Figure 26A:
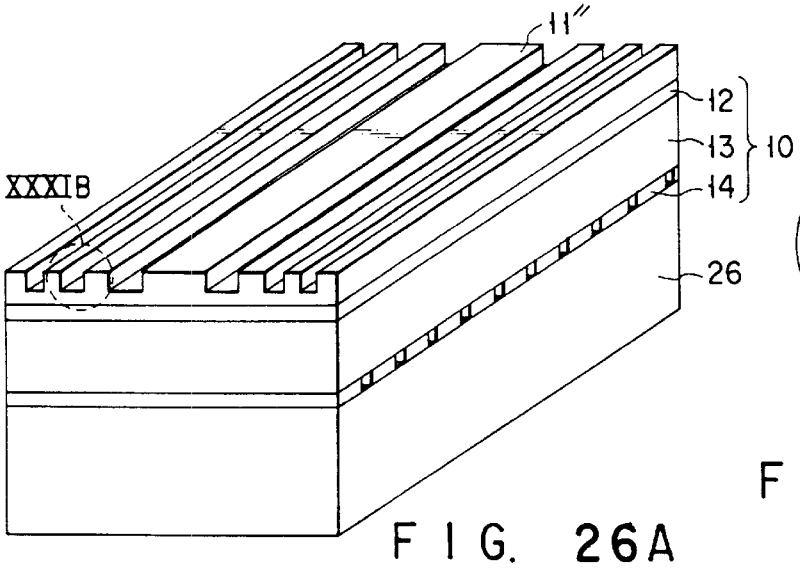
FIGS. 26A and 26B are perspective views of an ink-jet head comprising a piezoelectric element array having an acoustic matching/lens layer.
Figure 26B:
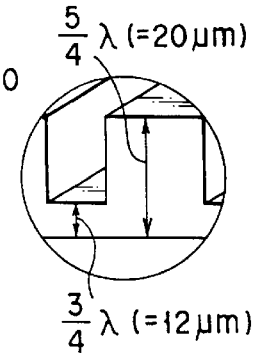

FIGS. 26A and 26B are perspective views of the recording head section where an acoustic matching layer-cum-acoustic lens 11" associated with Embodiment 2-2 are formed of resin integrally on the piezoelectric element array 10. An enlarged view of the irregularity of the lens 11" is also shown in the figure.

The ink-jet head comprises: a piezoelectric element array 10 where a common electrode 12 of a 1-μm-thick tungsten film is formed on one side of a piezoelectric element layer 13 of a 30-μm-thick sintered PZT for λ=16 μm and discrete electrodes 14 of a 1-μm-thick aluminum film with a pattern of a width of 40 μm and a spacing of 20 μm is formed on the other side of the layer; an acoustic matching layer-cum-acoustic lens 11" of epoxy resin with a height of 20 μm ±1 μm at the projected portion, a height of12 μm*1 μm at the recessed portion, a length of 300 mm±10 μm across the longitudinal side, and a 10-mm-thick rubber backing material 26.

Figure 27:
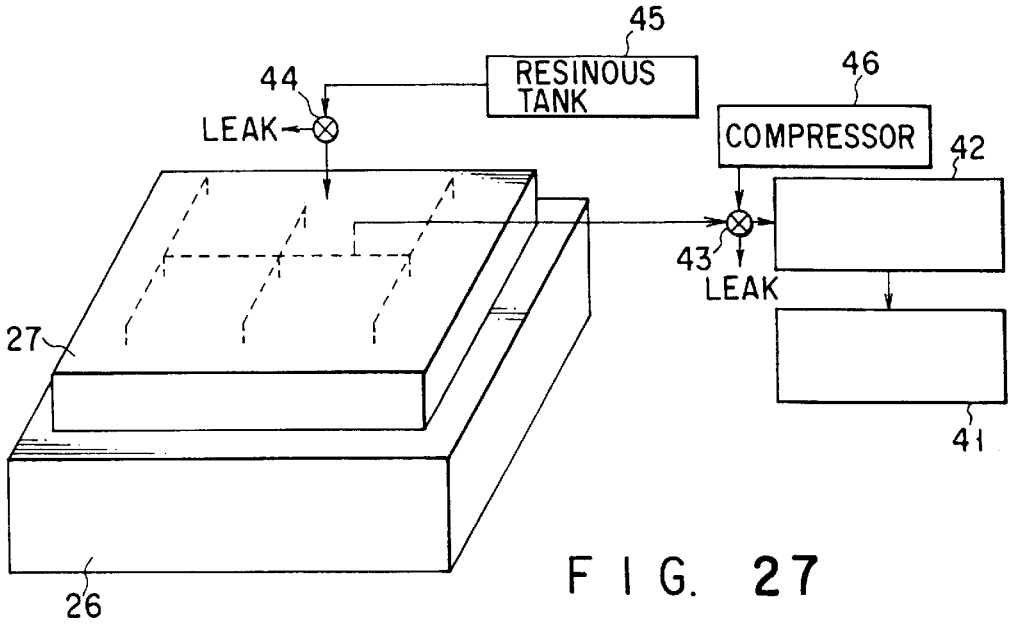
FIG. 27 is a diagram showing an apparatus for manufacturing the piezoelectric element array shown in FIG. 26.
Figure 28:
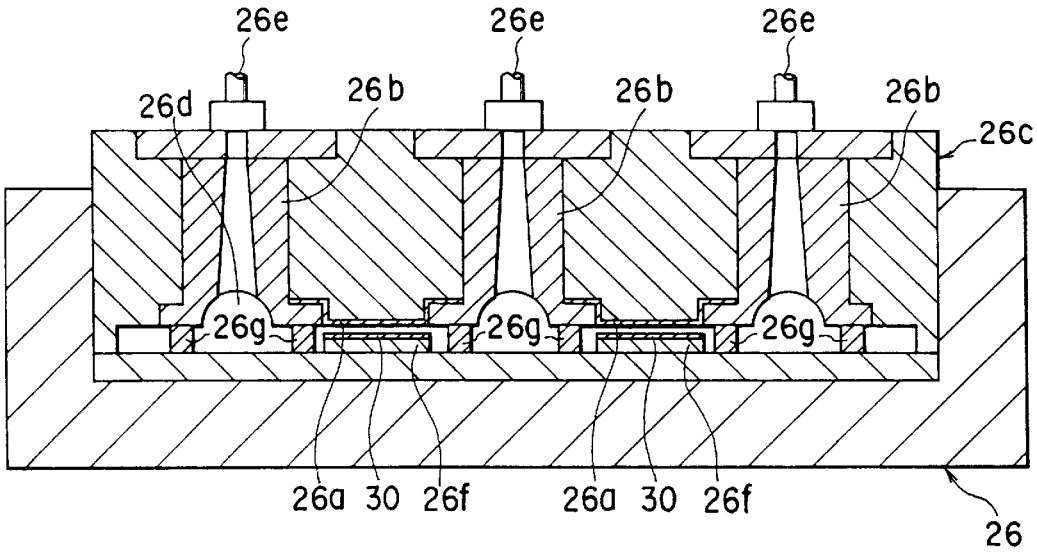
FIG. 28 is a sectional view of the mold used in the apparatus shown in FIG. 27.

Explained next will be a method of integrally forming the piezoelectric element array 10 and the acoustic matching layer-cum-acoustic lens 11" in the ink-jet head. FIG. 27 diagrammatically shows a manufacturing apparatus for injecting resin at a reduced pressure into a mold for forming a resinous sheet serving as an acoustic matching layer-cum-acoustic lens 11" having a highly accurate transfer pattern (irregular pattern) on the piezoelectric element array 10 through injection of uncured epoxy resin. FIG. 28 is a sectional view of the metal mold.

The mode of FIG. 28 will be explained. A nickel electroforming stamper 26*a* (not shown in detail) on whose surface a plurality of 8-μm-high, 350-mm-long projecting tracks are formed is installed on a movable support 26*c*, the inner mold of the metal mold, by a stamper clamp. In the movable support 26*c*, a relief groove 26*d* is made along the longitudinal side of the projecting track. Pressure reducing and increasing holes 26*e* and resin injecting inlets (not shown) are made in several places in the relief groove 26*d*. On the fixed support 26, the outer mold of the metal mold, the piezoelectric element array 10 is secured to a projecting pedestal 26*f* and a stopper 26*g* is formed.

After the movable support 26*c* is moved until it hits the stopper 26*g* and the inside of the mold is reduced in pressure by a pressure-reducing pump 41 via a pressure-reducing tank 42, a pressure reducing/increasing valve is closed to a medium level, a resin valve 44 is opened, and then a constant amount of resin is poured from a resin tank 45. At this time, since resin flows in the direction perpendicular to the projecting pattern toward the relief groove 26*d* in FIG. 27, resin can be poured uniformly into the inside of the fine recessed pattern without variations in the thickness along the longitudinal side.

Then, the resin valve 44 is closed and the resin valve 44 and pressure reducing/increasing valve 43 are leaked. In this state, after the epoxy resin is cured by raising the temperature of the mold to 250° C., the pressure reducing/increasing valve 43 is switched and the pressure is raised to about 2 to 10 kg/cm$^2$ by a compressor 46. Then, the mold is opened while the resin is being stripped from the movable support 26*c*, the inner mold. Then, the piezoelectric element array 10 and the resinous sheet formed on the array are taken out and cut off into a desired shape, thereby producing a piezoelectric element array with an acoustic matching layer-cum-acoustic lens shown in FIGS. 26A and 26B.

Embodiment 2-3

Figure 29A:
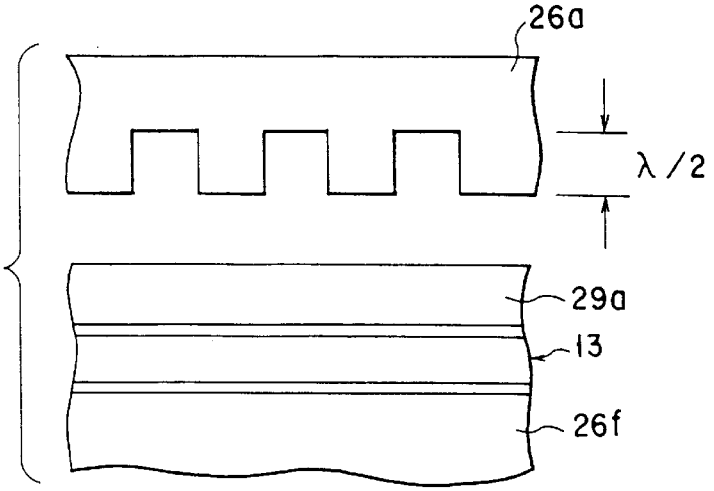
FIGS. 29A and 29B are sectional views explaining a method of manufacturing the piezoelectric element array shown in FIG. 26.
Figure 29B:
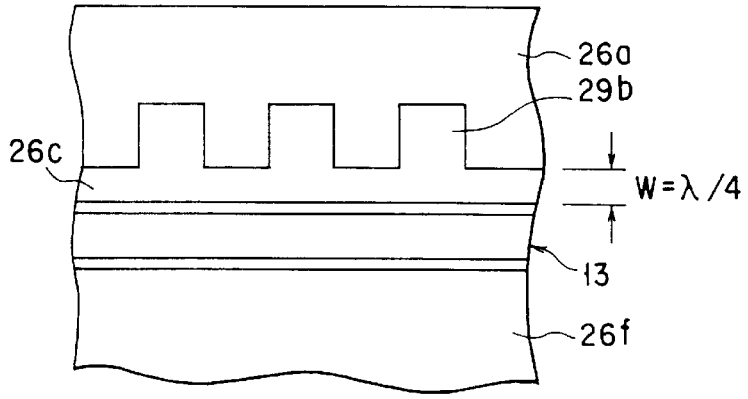

FIGS. 29A and 29B show another embodiment in which a piezoelectric element array with an acoustic matching-cum-acoustic lens is formed using a resin film for λ=16 μm. FIG. 29A is an enlarged view of the electroforming stamper 26*a* of FIG. 28 and part of the piezoelectric element array 10 coated with a resin film 29*a*. FIG. 29B is an enlarged view of an area where a resinous sheet 29*b* is formed by moving the movable support 26*c* of FIG. 28 and transferring the pattern of the electroforming stamper 26*a* to the resin film 29*a*.

For the electroforming stamper 26*a*, a transfer pattern is prepared on whose surface a plurality of projecting parallel tracks that have a rectangular cross section and have a height in rectangle of λ/2=8 μm from the main plane, are formed. The stamper is mounted on the movable support 26*c*. To the projecting pedestal 26*f* of the fixed support 26, the piezoelectric element array 10 has been secured temporarily. On the array, a polycarbonate resin film 29*a* with a thickness of about 20 μm is coated.

Then, at the same time that the movable support 26*c* is moved to the position of the stopper 26*g* mounted on the fixed support 26 and adjusted so that the distance of w=3λ/4 between the projecting portion of the projecting stamper 26*a* and the piezoelectric element array 10 may be 12 μm, the temperature of the mold is raised to 180° C. while the pressure in the mold is being decreased by the pressure reducing pump 41, thereby melting the resin film 29*a*. Because the melted resin flows in the direction perpendicular to the projecting pattern toward the relief groove 26*d*, the resin can be poured thoroughly into the inside of the fine recessed pattern without variations in the thickness along the longitudinal side. The surplus resin is forced to flow in the direction perpendicular to the projecting pattern, thereby thoroughly filling the resin in the inside of the fine recessed pattern without variations in the thickness along the longitudinal side. In this state, the temperature of the mold is cooled down below the heat distortion temperature to cure the resin, thereby forming a resin sheet 29*b*. Thereafter, the pressure is applied from the compressor 46. While the resin sheet 29*b* is being stripped from the inner mold, the metal mold is opened and a piezoelectric element array with an acoustic matching layer-cum-acoustic lens is taken out. By cutting the array into a desired shape, a piezoelectric element array with an acoustic matching layer-cum-acoustic lens shown in FIGS. 26A and 26B are produced.

Embodiment 2-4

An embodiment where a piezoelectric element array with an acoustic matching layer-cum-acoustic lens is formed using application of resin, will be explained.

An electroforming stamper 26*a* is prepared which has a transfer pattern on whose surface a plurality of projecting parallel tracks that have a rectangular cross section and have a height in rectangle of λ/2 8 μm from the main plane, are formed. The stamper is mounted on the movable support 26*c*. To the projecting pedestal 26*f* of the fixed support 26, the piezoelectric element array 10 has been secured temporarily. On the array, an uncured polycarbonate resin film with a thickness of about 10 μm is applied to form a resin coating layer.

Then, at the same time that the movable support 26*c* is moved to the position of the stopper 26*g* mounted on the fixed support 26 and adjusted so that the distance of w=λ/4 between the projecting portion of the projecting stamper 26*a* and the piezoelectric element array 10 may be 4 μm, the pressure in the mold is decreased by the pressure reducing pump 41. This allows the melted resin to flow in the direction perpendicular to the projecting pattern toward the relief groove 26*d*, so that the resin is poured thoroughly into the inside of the fine recessed pattern without variations in the thickness along the longitudinal side. The surplus resin is forced to flow in the direction perpendicular to the projecting pattern, thereby thoroughly filling the resin in the inside of the fine recessed pattern without variations in the thickness along the longitudinal side. In this state, the temperature of the mold is raised to 250° C. to cure the epoxy resin. Thereafter, the pressure is applied from the compressor 46. While the resin sheet is being stripped from the inner mold, the metal mold is opened and a piezoelectric element array with an acoustic matching layer-cum-acoustic lens is taken out. By cutting the array into a desired shape, a piezoelectric element array with an acoustic matching layer-cum-acoustic lens shown in FIGS. 26A and 26B are produced.

While in Embodiment 2-2 to Embodiment 2-4, the projecting pedestal 26*f* is provided on the fixed support 26, to which the piezoelectric element array 10 is secured temporarily, the piezoelectric element array may be temporarily secured directly on the fixed support 26 without the projecting pedestal 26*f*, according to the dimensions and shape of the resin sheet. In these embodiments, the resin is mixed with filler such as metallic oxide or metallic nitride so that the thermal expansion coefficient of the resin may be closer to that of the mold. Taking into account the difference in thermal expansion coefficient between the resin and the mold according to the inclusion rate of filler, the recessed portion of the electroforming stamper 26*a* may be made a little larger so that the volume of uncured or melted resin poured in the recessed portion of the electroforming stamper 26*a* may be 101% to 106% of that of the size after shaping.

The methods explained in Embodiment 2-2 to Embodiment 2-4 may be applied not only to the manufacture of piezoelectric element arrays with an acoustic matching layer-cum-acoustic lens, but also to a case where an acoustic lens composed of a Fresnel lens is provided separately from an acoustic matching layer.

As described above, with Embodiment 2-2 to Embodiment 2-4, when a resinous molded piece on which a pattern is transferred is produced using a metal mold on whose inner mold a stamper having a transfer pattern on which a plurality of projecting parallel tracks reverse to the irregularity of the Fresnel lens acting as an acoustic lens are formed, is mounted, a transfer resin sheet whose irregularity thickness and the thickness along the lengthwise side are controlled at high accuracy can be obtained easily by forming resin relief grooves parallel to the projecting tracks and allowing the resin to flow in the direction perpendicular to the projecting tracks to transfer the pattern. Therefore, even when the shape and size of the acoustic lens get finer and strict size accuracy is required, the requirements can be met. In addition, the method may be applied to a case where the piezoelectric element array is driven at high frequencies.

Furthermore, by providing an piezoelectric element array on the outer mold of the metal mold, it is easy to produce a piezoelectric element array with an acoustic lens where the acoustic lens composed of a Fresnel lens is formed of resin integrally on the piezoelectric element array, or a piezoelectric element array with an acoustic matching layer-cum-acoustic lens. In this case, since an adhesive layer between the piezoelectric element array and the acoustic lens is not necessary, it is possible to produce the size and shape of the resin region laminated on the piezoelectric element array at higher accuracy.

Embodiment 3-1

Figure 30A:
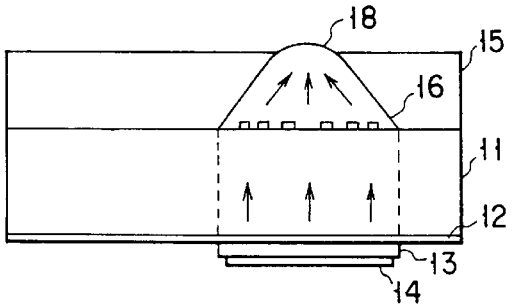
FIGS. 30A and 30B are diagrams explaining the operation of the recording head section provided in an ink-jet recording device according to Embodiment 3-1.
Figure 30B:
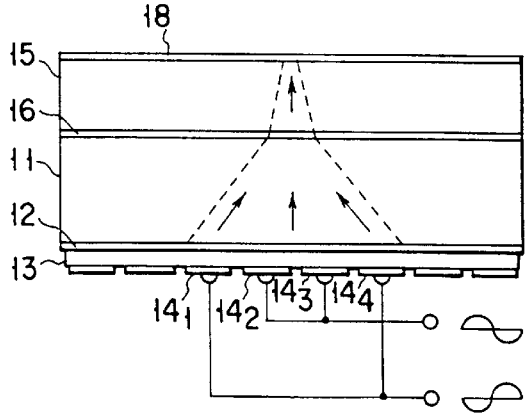

Since the primary configuration of Embodiment 3-1 is the same as that of Embodiment 1-1, the drawing and explanation of it will not be given. Using FIGS. 30A and 30B, the operation of Embodiment 3-1 will be described. Embodiment 3-1is characterized in that piezoelectric elements are divided into a first group and a second group and driving signals of opposite phases (e.g., 0 phase and π phase) are applied to the first group and the second group.

The operation of performing linear scanning in the main-scanning direction, the direction in which the piezoelectric elements are arranged in the piezoelectric element array 10, by phased array scanning. As in Embodiment 1-1, for simplicity, it is assumed that four piezoelectric elements forms one group (a piezoelectric element group), which is driven simultaneously. The operation of effecting linear scanning by shifting the positions of the piezoelectric element groups one by one will be explained.

A voltage of burst wave composed of an alternating-current voltage of specific frequency or a pulse train is applied to the discrete electrodes $\mathbf{14}_1$ to $\mathbf{14}_4$ of the four piezoelectric elements as a driving signal. As in Embodiment 1-1, the frequency of the driving signal must be set so that at least the wavelength of ultrasonic wave in the ultrasonic interference layer 11 (also used as an acoustic matching layer) may be larger than the pitch on the piezoelectric element array. Furthermore, the thickness of the ultrasonic interference layer 11 must be less than a specified value. To obtain the necessary resolution for a printer, the frequency of driving signal must be in the range of several tens MHz to several hundreds MHz.

Under such conditions, two inner ones of the four piezoelectric elements are determined to be a first group, and the two outer ones are determined to be a second group. Then, a 2-phase driving signal of opposite phases, 0 phase and π phase, (a voltage of burst wave composed of an alternating-current voltage of specific frequency or a pulse train) is applied to the piezoelectric elements of the first and second groups.

The number of piezoelectric elements simultaneously driven (referred to as the number of elements simultaneously driven) required for ink to be forced to fly in the form of a droplet is practically 10 to 100. These piezoelectric element groups are grouped so as to correspond to the 2-phase driving signal of 0 phase and π phase. The grouping is determined by the width and pitch determined from the focal length and wavelength on the basis of the concept of the Fresnel zone plate. Then, the piezoelectric elements arranged at regular intervals are grouped according to the determined width and pitch. For example, when the piezoelectric elements 13 (or discrete electrodes 14) are arranged with a pitch of 50 μm, grouping is effected at the maximum error of 25 μm. The details of the grouping will be explained later.

One know method is to arrange piezoelectric elements according to the width and pitch of piezoelectric elements. When piezoelectric element arrays are arranged at regular intervals, one know method is to closely set the driving delay time difference given to the piezoelectric element groups simultaneously driven, as in phased array scanning in an ultrasonic diagnostic apparatus. With the present invention, however, since whether an ink droplet is squirted or not has only to be determined, even if the piezoelectric elements arranged at regular intervals are divided into two groups and driven by a 2-phase driving signal of 0 phase and π phase, the ultrasonic beams can be forced to converge on a single point to control the flying of an ink droplet. This has been confirmed as a result of the experiments conducted by the inventors. It goes without saying that the smaller the pitch of piezoelectric elements, the fewer errors and the higher the convergence efficiency. This enables the piezoelectric element array 10 arranged at regular intervals to produce a lens effect in the arranging direction (the main-scanning direction). Furthermore, electronic scanning of ultrasonic beams can be realized easily by changing grouping sequentially. In the ultrasonic interference layer 11, however, the ultrasonic beams do not converge in the direction (or the sub-scanning direction) perpendicular to the array direction.

In this embodiment, the Fresnel zone plate 16 is provided and the ultrasonic beams arrived at the interface with the ink chamber undergo a lens effect that forces the beams to converge centripetally in the direction (or the sub-scanning direction) perpendicular to the array direction, by means of the Fresnel zone plate 16. Therefore, the convergence in the main-scanning direction starts from inside the ultrasonic interference layer 11 and the convergence in the sub-scanning direction takes place only in the ink 18 in the nozzle substrate 15.

The ultrasonic beams are forced to focus on the surface of ink remaining still due to surface tension at the slit opening in the top surface of the nozzle substrate 15 in the main-scanning direction and the sub-scanning direction. The pressure of the ultrasonic beams thus converged causes an ink droplet 19 to fly from the liquid surface of the ink 18 as shown in FIGS. 3A to 3E, thereby recording an image on a recording medium such as recording paper (not shown).

By dividing and driving the piezoelectric element array 10 as described above, the following problem can be solved.

The phased array method is characterized in that the convergence position of ultrasonic beam on the liquid surface can be controlled arbitrarily by controlling the phases of a plurality of beams and a plurality of ultrasonic wave sources need not be changed with respect to the convergence position of ultrasonic beam. In an ink-droplet generating mechanism that forces ultrasonic beams to converge to generate an ink droplet, however, it is found that an ink droplet flies in the direction in which ultrasonic beams converge. For example, experiments showed that when an ultrasonic beam at an angle of several degrees to the direction perpendicular to the ink liquid surface was forced to converge on the liquid surface of ink, the droplet flied in the direction of the angle.

Specifically, when the phased array method is used, the flying angle of an ink droplet changes depending on the position on which the ultrasonic beam is forced to converge, with the result that the flying direction of the ink droplet from the liquid surface is at a specific angle to the vertical direction. This means that pixels with a different pitch are formed on recording paper. Therefore, to maintain the pitch of pixels on recording paper, it is necessary to predict the angle at which an ink droplet flies and perform phase control of the ultrasonic generating elements. The control is required to control the phase continuously at high accuracy. Such a circuit has the disadvantages of being very complex in configuration and needing a very large memory capacity to store a large volume of data for correction.

In Embodiment 3-1, however, since the size of ink droplet is always kept constant as described above and complex processes including control of the flying direction of ink droplet are not needed, the device can be realized using a simpler configuration.

Now, grouping at the time of driving the piezoelectric element array 10 will be explained in detail.

As well known in the field of optics, the Fresnel zone plate is such that in the case of a two-dimensional example, rings consisting of concentric circles whose radius Rm is proportional to the square root of integer m are arrange in such a manner that first rings that allow light to pass through without a phase shift are alternated with second rings that shift the phase of light by a half-wave length, thereby causing the light from each ring to converge at a point with the same phase. The principle of the Fresnel zone plate can be applied to ultrasonic waves that present wave motion like light. Actually, the aforementioned Fresnel zone plate 16 is constructed as a one-dimensional Fresnel zone plate, making use of the principle. In this case, a first region that allows ultrasonic waves to pass through with no phase shift corresponds to the first ring and a second region that shifts the phase of ultrasonic wave by a half-wave length corresponds to the second ring.

With the present invention, by determining a method of driving the piezoelectric element array 10 where elements are one-dimensionally arranged at regular intervals, the piezoelectric element array 10 is forced to function equivalently as one-dimensional Fresnel zone plate.

FIGS. 31A and 31B show an example of rounding off the distance Rm from the center of the Fresnel zone plate with respect to the arranging pitch (50 μm) on the piezoelectric element array 10 (FIG. 36A) and determining the phase of a driving signal supplied to each element in the piezoelectric element array 10 on the basis of the rounded-off value Rr (FIG. 36B) in a case where the sound speed in ink (the same as the sound speed in water) is 1500 m/s, the frequency of driving signal is 100 MHz, the wavelength of ultrasonic wave in ink is 15 μm, the focal length f of ultrasonic beam is 5 mm, the number N of elements simultaneously driven in the piezoelectric element array 10 is 32, and the arranging pitch P on the piezoelectric element array 10 is 50 μm.

When of 32 consecutive piezoelectric elements to be simultaneously driven, those in the central portion of the arrangement (in this example, ten elements marked with element numbers 12 to 21) are determined to be a first group, and those located on both sides of the first group (in this example, three elements marked with element numbers 9 to 11 and another three elements marked with element numbers 22 to 24) are determined to be a second group. A 0-phase driving signal is supplied to the first group of piezoelectric elements and a π-phase driving signal is supplied to the second group.

Figure 32:
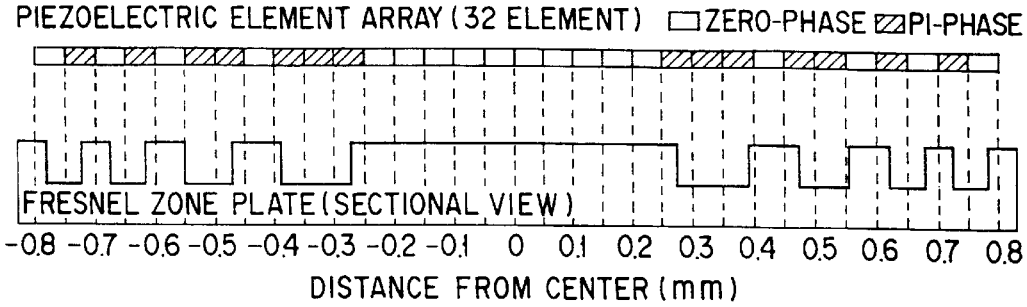
FIG. 32 is a diagram illustrating the grouping of ultrasonic generating elements, and an ideal cross section for the Fresnel zone plate incorporated in Embodiment 3-1.
Figure 33:
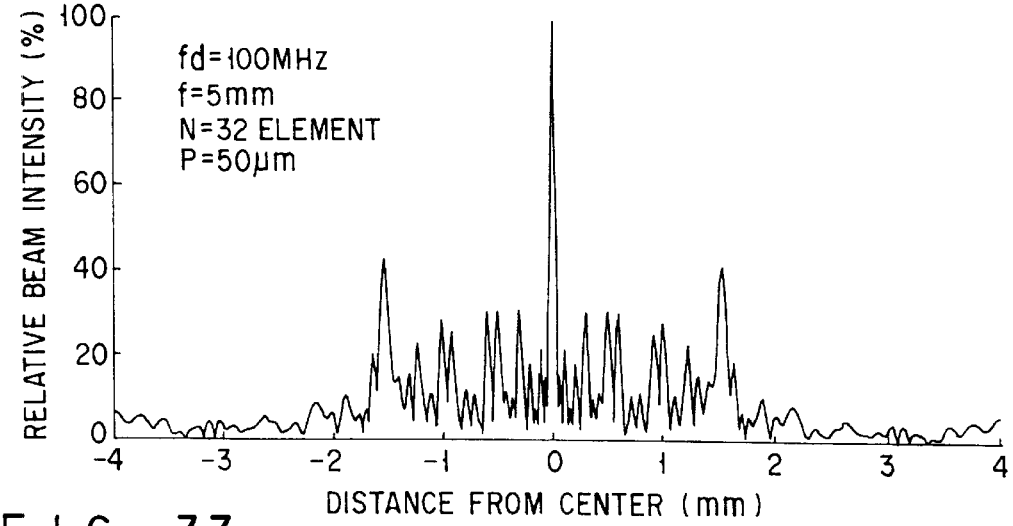
FIG. 33 is a graph representing the intensities an ultrasonic beam has at various distances from the center of ultrasonic generating elements when the ultrasonic generating elements are grouped as shown in FIG. 32.

FIG. 32 shows how grouping is effected in FIGS. 31A and 31B and a cross section of an ideal Fresnel zone plate. From FIG. 32, it can be seen that by grouping the piezoelectric element array, application of a 0-phase and π-phase driving signals produces almost the same effect as the Fresnel zone plate. FIG. 33 shows the relative beam intensity at the depth of the focus (the liquid surface of ink) at each distance from the center when grouping is effected as shown in FIG. 32. From FIG. 33, it is obvious that the relative beam intensity is by far the highest in the central portion of the piezoelectric element array. Therefore, by grouping the piezoelectric elements in Embodiment 3-1, ultrasonic waves can be forced to converge effectively.

To effect phased array scanning, such grouping is a necessary and minimum condition. In Embodiment 3-1, grouping is effected in such a manner that of the piezoelectric elements outside the second group, those marked with element numbers 8 and 25 are determined to be a first group, those marked with element numbers 6 and 7 and element numbers 26 and 27 outside this first group are determined to be a second group, those marked with element numbers 5 and 28 outside this second group are determined to be the first group, those marked with element numbers 4 and 29 outside this first group are determined be the second group, . . . A 0-phase driving signal is applied to the piezoelectric elements of the first group and a π-phase driving signal is applied to the piezoelectric elements of the second group. By doing this, the convergence efficiency of ultrasonic beam can be improved.

By effecting grouping in a group of piezoelectric elements simultaneously driven in the piezoelectric element array 10, applying a 0-phase and π-phase driving signals to the individual piezoelectric elements in the first and second groups, shifting the position of the group of piezoelectric elements simultaneously driven by, for example, one element at a time in the arranging direction of the piezoelectric element array 10, and repeating the same driving operation, the ultrasonic beams can be forced to converge on the liquid surface of ink 18 and the converging point can be moved linearly in the arranging direction of the piezoelectric element array 10 (in the main-scanning direction).

By doing as described above, the present invention only requires a 2-phase driving signal, which can be generated using an inversion amplifier, whereas conventional phased array scanning requires a driving signal having a phase difference phase-controlled accurately.

Embodiment 3-2

The configuration of the recording head section and the principle of squirting ink in Embodiment 3-2 are the same as those in FIG. 5 and FIG. 6 in Embodiment 1-2, so that the drawing and explanation of them will not be given and what is the difference between Embodiment 1-2 and the present embodiment will be explained.

As in Embodiment 1-2, in Embodiment 3-2, it is found that the energy efficiency for squirting an ink droplet is decreased and the uniformity of ink droplet is degraded. Embodiment 3-1 is characterized by improving these factors.

Like Embodiment 1-2, Embodiment 3-2, however, has the advantage of forming an ink passage with a large cross section, because the concave lens surface becomes an ink chamber as it is. Therefore, only when high-speed recording is required, Embodiment 3-2 produces the effect of supplying a sufficient amount of ink to deal with the speed, slowing the change of ink density due to evaporation of ink solvent, and making the nozzle less liable to clog up.

Embodiment 3-3

A piezoelectric element does not need as the ultrasonic generating elements of the present invention. Such embodiments are shown in Embodiment 3-4 and Embodiment 3-5.

In Embodiment 3-3, the major configuration of the recording head section is the same as that of FIG. 1, the drawing and explanation of it will not be given. Embodiment 3-1 differs from Embodiment 1-2 in that magnetostrictive transducers separated by electrodes are used as ultrasonic generating elements and the transducers are arranged one-dimensionally to form an array. As in Embodiment 3-1, in Embodiment 3-3, grouping is effected, producing the same effect as the Fresnel zone plate.

The magnetostrictive transducers 13 are such that they are formed of material such as $Te_{0.3}D_{0.7}Fe_2$ or $Te_{0.3}D_{0.7}(Fe_{0.9}Mn_{0.1})_2$ on the entire bottom surface or into belts by a film forming method capable of controlling the film thickness such as sputtering. On both ends of the magnetostrictive transducer 13, magnetic field applying elements (not shown) are provided. A permanent magnet, free from a power consumption problem and a heating problem, is suitable for the magnetic field applying elements. On the surface of the magnetostrictive transducer 13, discrete exciting coils 14 pairing with common electrodes 12 are formed with a pitch corresponding to the recording dots. The magnetostrictive transducer array may be such that island-shaped magnetostrictive transducers are formed with a pitch corresponding to the recording bits. The thickness of the magnetostrictive transducer 13 is designed to match with the wavelength of an ultrasonic wave used.

The common electrode 12, magnetostrictive transducers 13, magnetic field applying element and exciting coil 14 constitute a magnetostrictive transducer array 10 serving as an ultrasonic generating element array. In the case of an actual ink-jet head, for example, a line head as long as the length of the A4 size sheet with a resolution of 600 dpi, about 5000 magnetostrictive transducers are arranged in a line. In this case, the individual magnetostrictive transducers in the magnetostrictive transducer array 10 are arranged in a line at regular intervals determined by the required recording density. The remaining configuration is the same as that of Embodiment 1-1, so that the explanation of it will not be given.

Figure 34A:
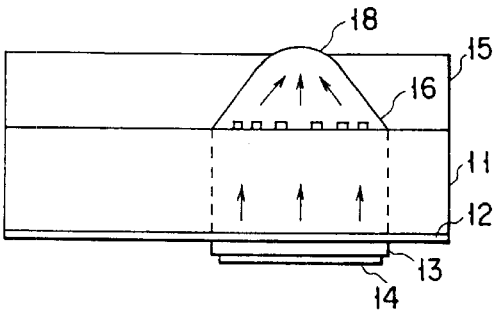
FIGS. 34A and 34B are diagrams explaining the operation of the recording head section provided in an ink-jet recording device according to Embodiment 3-3.
Figure 34B:
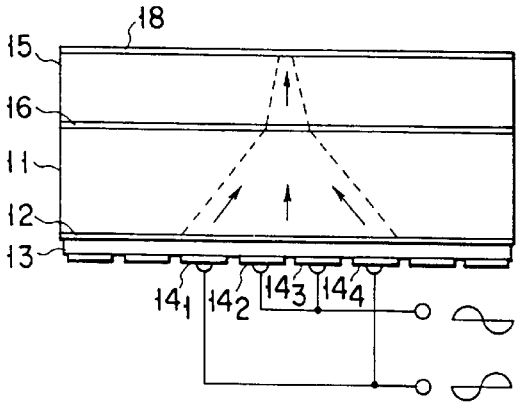
Figure 35A:
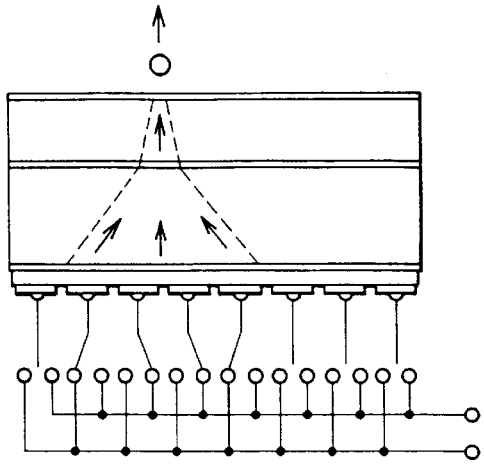
FIGS. 35A to 35E are diagrams explaining how the recording head section of Embodiment 3-3 performs phased array scanning.
Figure 35D:
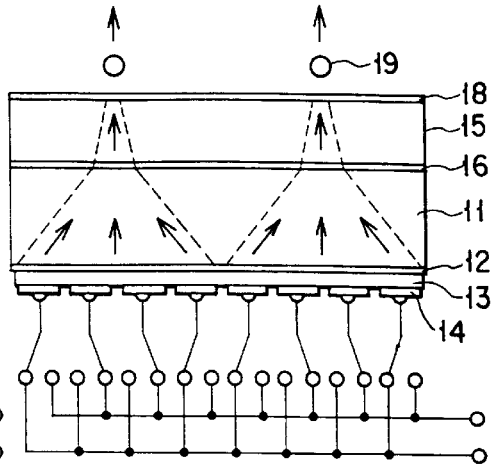
Figure 35B:
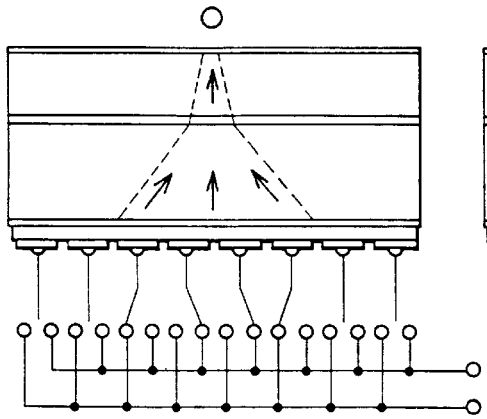
Figure 35E:
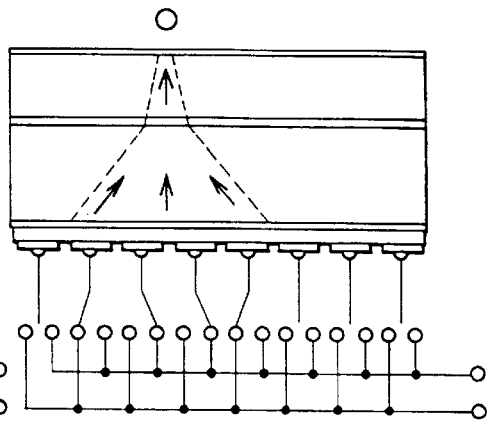
Figure 35C:
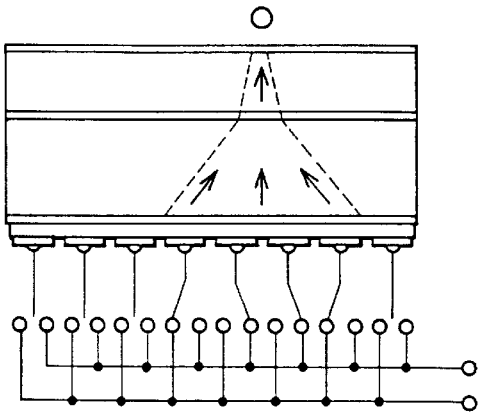

Using FIGS. 34A and 34B, the operation of Embodiment 3-3 will be explained, although part of the explanation will overlap with that of Embodiment 1-1. The operation of performing linear scanning in the main-scanning direction, the direction in which the magnetostrictive transducers are arranged in the magnetostrictive transducer array 10, by phased array scanning. As in Embodiment 1-1, for simplicity, it is assumed that four magnetostrictive transducers forms one group (a magnetostrictive transducer group), which is driven simultaneously. The operation of effecting linear scanning by shifting the positions of the magnetostrictive transducer groups one by one will be explained.

A burst current composed of an alternating current of specific frequency or a pulse train is applied to the discrete exciting coils $14_1$ to $14_4$ connected to four magnetostrictive transducers 14 as a driving signal. The frequency of the driving signal must be set so that at least the wavelength of ultrasonic wave in the ultrasonic interference layer 11 (also used as an acoustic matching layer) may be larger than the pitch on the piezoelectric element array. Furthermore, the thickness of the ultrasonic interference layer 11 must be less than a specified value. To obtain the necessary resolution for a printer, the frequency of driving signal must be in the range of several tens MHz to several hundreds MHz. Under such conditions, two inner ones of the four magnetostrictive transducers are determined to be a first group, and the two outer ones are determined to be a second group. Then, a 2-phase driving signal of opposite phases, 0 phase and π phase, (a burst current composed of an alternating current of specific frequency or a pulse train) is applied to the magnetostrictive transducers of the first and second groups.

The number of magnetostrictive transducers simultaneously driven (referred to as the number of elements simultaneously driven) required for ink to be forced to fly in the form of a droplet is practically 10 to 100. These magnetostrictive transducer groups are grouped so as to correspond to the 2-phase driving signal of 0 phase and π phase. The grouping is determined by the width and pitch determined from the focal length and wavelength on the basis of the concept of the Fresnel zone plate. Then, the magnetostrictive transducers arranged at regular intervals are grouped according to the determined width and pitch. For example, when the magnetostrictive transducers in the magnetostrictive transducer array 10 are arranged with a pitch of 50 μm, grouping is effected at the maximum error of 25 μm. The grouping is the same as that of the piezoelectric element array 10 in Embodiment 3-1, so that its explanation will not be given.

By grouping the magnetostrictive transducer array 10 as described above and driving them with a 2-phase driving signal, the piezoelectric element array 10 arranged at regular intervals can produce a lens effect in the arranging direction (the main-scanning direction). Furthermore, electronic scanning of ultrasonic beams can be realized easily by changing grouping sequentially. In the ultrasonic interference layer 11, however, the ultrasonic beams do not converge in the direction (or the sub-scanning direction) perpendicular to the array direction.

The ultrasonic beams arrived at the interface with the ink chamber undergo a lens effect that forces the beams to converge centripetally in the direction (or the sub-scanning direction) perpendicular to the array direction, by means of the Fresnel zone plate 16. Namely, the convergence in the main-scanning direction starts from inside the ultrasonic interference layer 11 (also used as an acoustic matching layer) and the convergence in the sub-scanning direction takes place only in the ink 18 in the nozzle substrate 15.

The ultrasonic beams are forced to focus on the surface of ink remaining still due to surface tension at the slit opening in the top surface of the nozzle substrate 15 in the main-scanning direction and the sub-scanning direction. The pressure of the ultrasonic beams thus converged causes an ink droplet 19 to fly from the liquid surface of the ink 18, thereby recording an image on a recording medium such as recording paper (not shown).

As for a recording method, when ultrasonic beams are forced to converge on a dot using four magnetostrictive transducers as shown in FIGS. 35A to 35E, division driving is effected in such a manner that one line is divided into four or more pieces and each piece is driven with a ¼ or less timing. Since the concrete operation has been described in FIGS. 3A to 3E in Embodiment 1-1, a detailed explanation will be omitted. For the sake of explanation, the cooperating operation of four elements has been explained, there is no need of limiting the number of elements. Use of more elements to record one pixel makes smoother the wave surface of the ultrasonic beams converging centripetally and raises the energy density of the ultrasonic beams at the liquid surface of ink 18, thereby reducing variations in the ink droplet and reducing the driving current supplied to the magnetostrictive transducer array 10.

Embodiment 3-4

Since the configuration of the recording head section in Embodiment 3-4 is the same as that of Embodiment 3-3, the drawing and explanation of it will not be given.

Figure 36A:
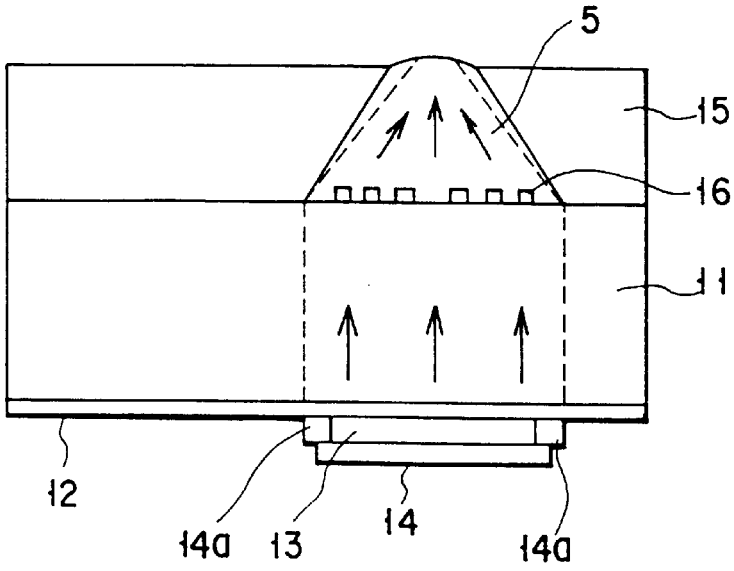
FIGS. 36A and 36B are diagram explaining the operation of an ink-jet recording device according to Embodiment 3-4 of the present invention.
Figure 36B:
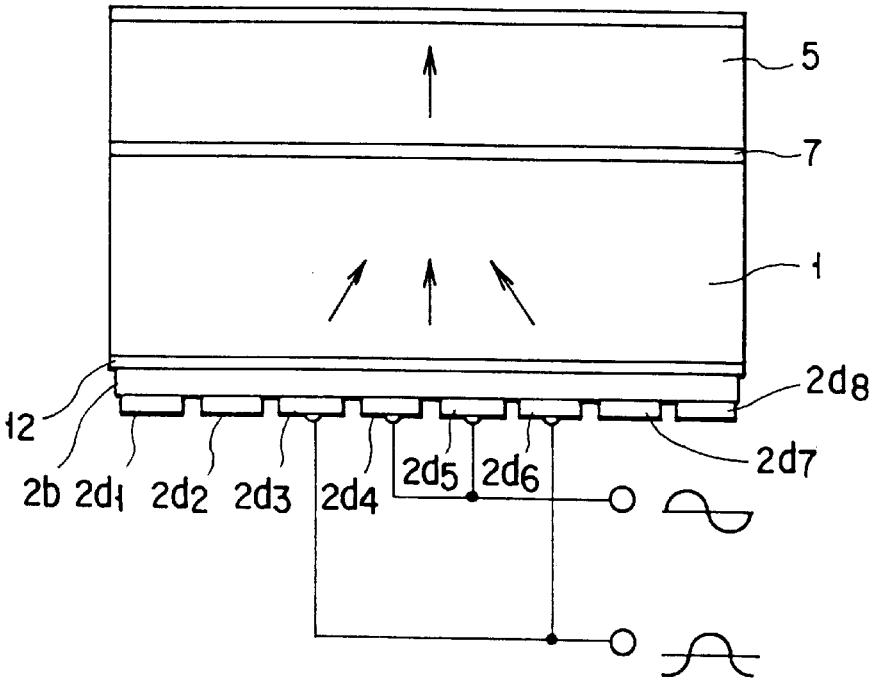

Referring to FIGS. 36A and 36B, the operation of an ink-jet head associated with Embodiment 3-4 will be explained. FIG. 36A is a sectional view taken along in the direction perpendicular to a magnetostrictive transducer array. FIG. 36B is a sectional view taken along in the direction along the magnetostrictive transducer array. FIG. 36A shows magnetic field applying means 14*a* that are provided on both sides of the magnetostrictive transducer 13 and applies a bias magnetic field to the magnetostrictive transducer 13.

A voltage of burst wave composed of an alternating current of specific frequency (or a pulse train) is applied to part of the magnetostrictive transducer array 10, for example, to the discrete exciting coils $\mathbf{14}_1$ to $\mathbf{14}_4$. The frequency of the applied alternating current is such that at least the wavelength of ultrasonic wave in the ultrasonic interference layer (an acoustic matching layer) is larger than the pitch of the sound wave sources (magnetostrictive transducers 13) in the array. When of the discrete exciting coils $\mathbf{14}_1$ to $\mathbf{14}_4$, the two inner ones $\mathbf{14}_2$, $\mathbf{14}_3$ are applied with an alternating-current voltage, and the two outer ones are applied with a voltage of burst wave leading the inner two discrete exciting coils $\mathbf{14}_2$, $\mathbf{14}_3$ in phase (by a ¼ phase in this embodiment), the ultrasonic beams interfere with each other as in Embodiment 3-3, thus producing a lens effect in the array direction (the main-scanning direction) in which the elements in the piezoelectric element array 10 are arranged. In the glass plate 1, however, the ultrasonic beams do not converge in the direction (or the sub-scanning direction) perpendicular to the array direction of the piezoelectric element array 10.

The ultrasonic beams arrived at the interface with the ink 18 undergo a lens effect that forces the beams to converge centripetally in the direction (or the sub-scanning direction) perpendicular to the array direction of the piezoelectric element array 10, by means of the Fresnel zone plate 7. Namely, the convergence in the main-scanning direction starts from inside the glass plate 1 functioning as an acoustic matching layer (a sound interference layer) and the convergence in the sub-scanning direction takes place only in the ink 18. At this time, since the nozzle substrate 15 has been selected and set so that its thickness may agree with the focus, the ultrasonic beams are forced to focus on the surface of ink remaining still due to surface tension at the slit opening forming a nozzle. The pressure of the ultrasonic beams thus converged in the main-scanning and sub-scanning directions causes an ink droplet to fly easily from the liquid surface of ink, thereby recording a clear image on a recording medium without variations in the density.

As described above, like Embodiment 3-3, the gist of Embodiment 3-4 is that four ultrasonic generating elements (magnetostrictive transducers) form one group, one line is division-driven with a ¼ timing at a time, and the discrete exciting coils 14 are shifted in the main-scanning direction by linear scanning.

While in Embodiment 3-4, one group consists of four magnetostrictive transducers to record one pixel, one group may consist of more magnetostrictive transducers, which prevents side lobe of the ultrasonic beams converging centripetally and raises the energy density, thereby reducing variations in the ink droplet and reducing the driving current supplied to the magnetostrictive transducer array.

Furthermore, while in Embodiment 3-3 and Embodiment 3-4, the convergence position of the ultrasonic beams is set at the liquid surface facing the center of the set of ultrasonic generating elements grouped and a droplet is forced to fly straight in the direction perpendicular to the sound wave generating element group, the squirting position may be shifted by changing the timing for applying a voltage of burst wave, as described later.

Embodiment 4

The recording head section explained in Embodiment 3-1 to Embodiment 3-4 is constructed as a line scanning recording head that records one line at a time. The configuration of a scanning control section that controls the line scanning recording head to record an image will be explained using FIG. 37.

Figure 37:
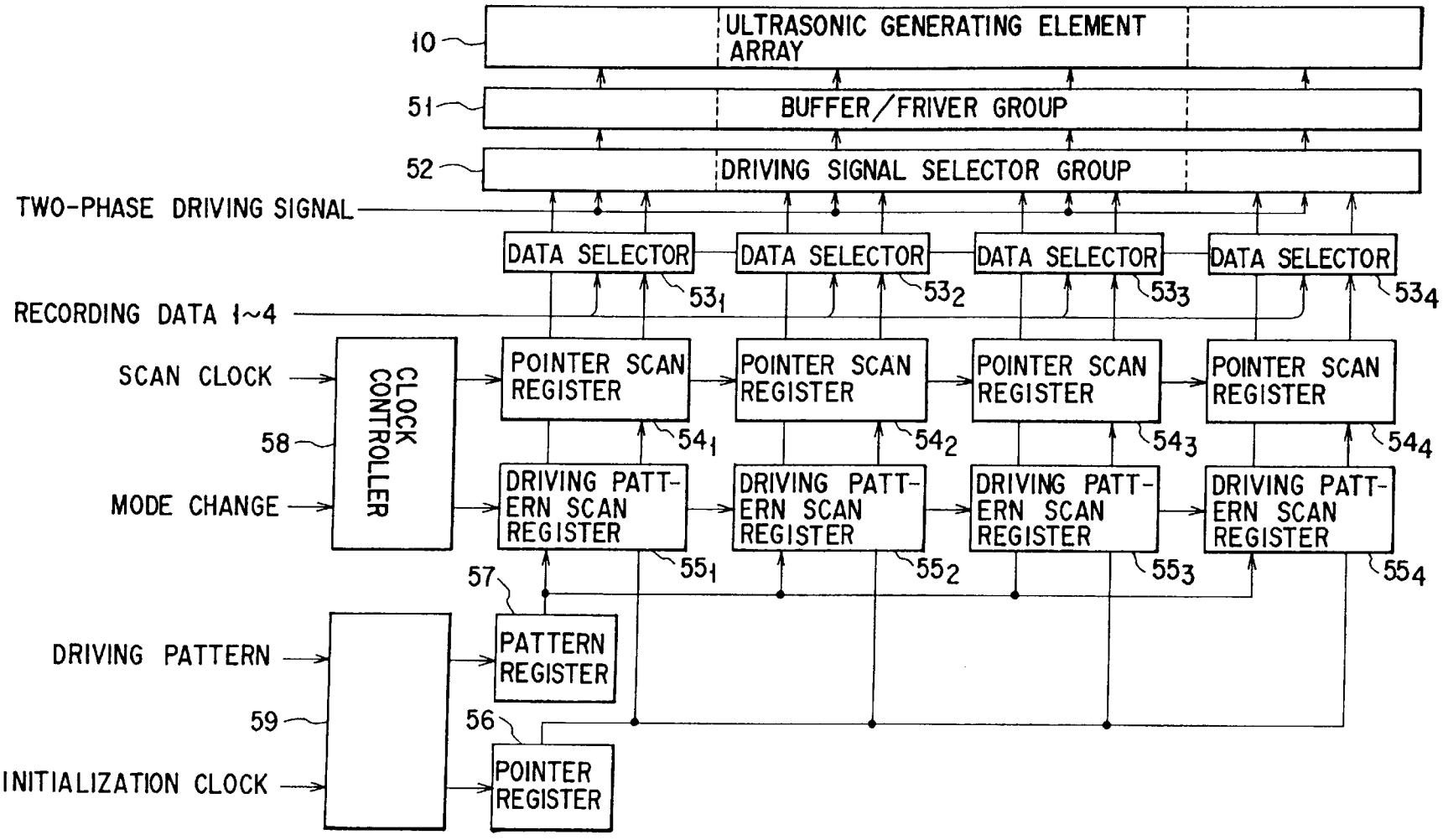
FIG. 37 is a block diagram of the scanning control section incorporated in an ink-jet recording device according to Embodiment 4 of the invention.

Embodiment 4 employs a division driving method where one main scanning line is divided into a plurality of groups and scanning recording is effected to realize higher recording speeds. In the division driving method, an ultrasonic generating element array is divided into a plurality of (N) groups, and these individual groups are driven simultaneously to record N pixels at a time. Its recording speed is N times as fast as the case where no division driving is effected. FIG. 37 shows a case where the number N of divisions is 4.

The scanning control section comprises an ultrasonic generating element array 10 (a piezoelectric element array 10 explained in Embodiment 3-1 and Embodiment 3-2 or a magnetostrictive transducer array 10 explained in Embodiment 3-3), a buffer driver group 51, a driving signal selector group 52, data selectors $\mathbf{53}_1$ to $\mathbf{53}_4$, pointer scanning registers $\mathbf{54}_1$ to $\mathbf{54}_4$, driving pattern scanning registers $\mathbf{55}_1$ to $\mathbf{55}_4$, a pointer register 56, a pattern register 57, a clock control section 58, and an initial setting section 59.

The number of elements in the ultrasonic generating element array 10 will be explained.

When a thermal head used in an ordinary thermal recording method is used as a line scanning recording head, the number of pixels obtained in one line is the same as the number of heating elements in the head. With the present invention, however, linear scanning is effected by phased array scanning that repeats the operation of selecting a specific number of ultrasonic generating element groups in the ultrasonic element array 10 where elements are arranged in lines and driving them simultaneously, while shifting the ultrasonic generating groups one by one in the arranging direction. Therefore, the total number of ultrasonic generating elements must be at least the number of elements equal to the sum of the number of elements for the recording width and the number of elements simultaneously driven needed for phased array scanning (the number of ultrasonic generating elements in one ultrasonic generating element group).

The reason for this is that in phased array scanning, since the converging point of the ultrasonic beans is located on a line perpendicular to the element in the center of the side along which elements are arranged in the group of ultrasonic generating elements driven simultaneously, to force an ink droplet to fly as far as the positions corresponding to the right and left ends of the recording width of the recording sheet, as many ultrasonic generating elements as half the number of ultrasonic generating elements simultaneously driven in the group must be provided outside both of the right and left ends. The number of ultrasonic wave elements may, of course, be greater. Concretely, in the present embodiment, the number of elements in the ultrasonic generating element array 10 is set at 4992, the sum of the number of recording pixels in one line of A4 size with 600 dpi, 4960, and the number of elements simultaneously driven, 32.

A 2-phase driving signal is applied from the buffer driver group 51 between the common electrodes facing the discrete electrodes (or the discrete exciting coils) corresponding to the 4992 ultrasonic generating elements in the ultrasonic generating element array 10. The buffer driver group 51 is composed of 4992 buffer drivers one-to-one corresponding to the individual elements in the ultrasonic generating element array 10. In a case where the ultrasonic generating elements are piezoelectric elements, a voltage of several tens V and a frequency of several hundreds MHz provide a sufficient capability for driving the ultrasonic generating elements. The buffer driver group 51 is supplied with a driving signal selected from three types of signal at the driving signal selector group 52.

Figure 38:
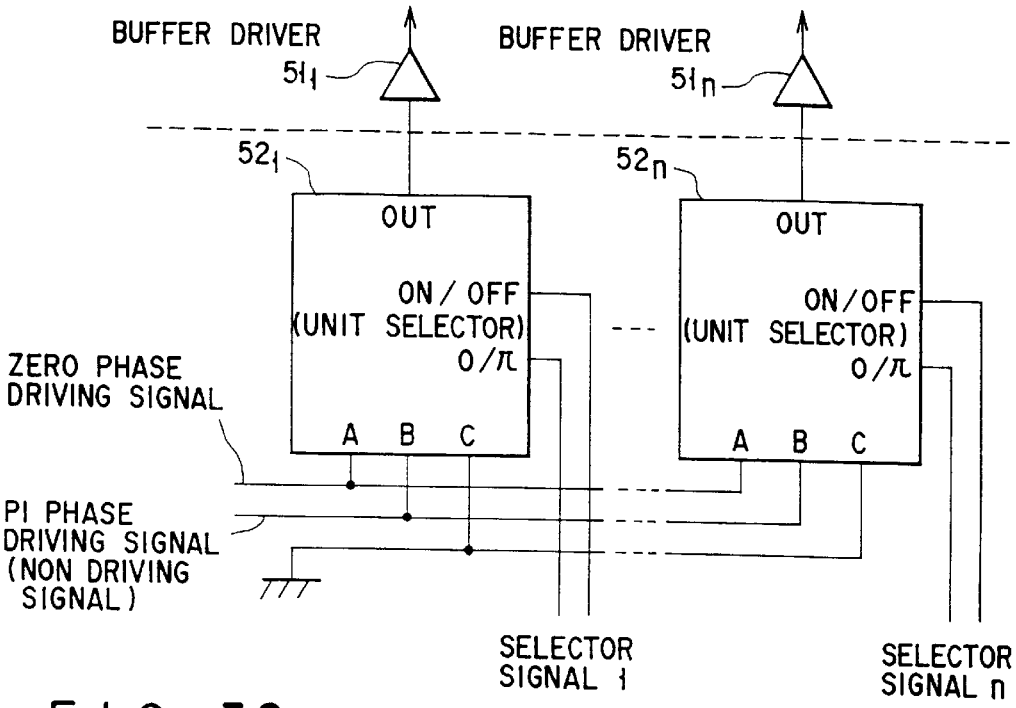
FIG. 38 is a block diagram showing the drive-signal selectors of the scanning control section shown in FIG. 37.

FIG. 38 shows the structure of the driving signal selector group 52 in FIG. 37. The driving signal selector group 52 is composed of n unit selectors $\mathbf{42}_1$ to $\mathbf{42}_n$ (n is the number of ultrasonic generating elements in the ultrasonic generating element array 10). These unit selector are connected to the respective buffer drivers in the buffer driver group 51 on a one-to-one basis. The individual unit selectors $\mathbf{42}_1$ to $\mathbf{42}_n$ receive three types of input signals, a 0-phase driving signal, a π-phase driving signal, and a non-driving signal (a reference potential in the figure) as inputs A, B, and C, and select one of these three input signals according to two types of select signals, a 0-phase π-phase select signal and a driving on/off select signal. The driving on/off select signal is generated from a recording signal and a pointer signal indicating an object of phased array at the data selectors $\mathbf{53}_1$ to $\mathbf{53}_4$.

The ultrasonic generating element array 10, buffer driver group 51, and driving signal selector group 52 basically include no structure for division-driving the ultrasonic generating element array 10. They are only for electronic linear scanning based on phased array scanning. Division driving is effected during scanning control.

Figure 39:
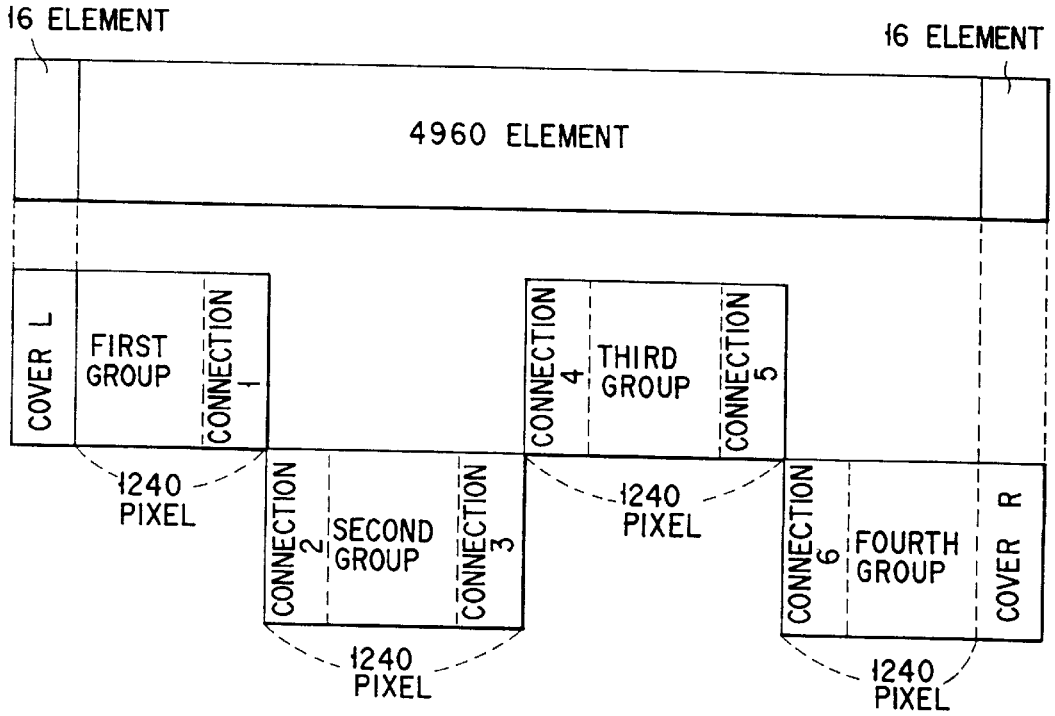
FIG. 39 is a diagram explaining how groups of ultrasonic generating elements are connected to one another in the scanning control section shown in FIG. 37.

Using FIG. 39, a method of dividing the ultrasonic generating element array 10 will be described. As shown in FIG. 39, in the ultrasonic generating element array 10, to cover 16 pixels at the right and left ends of the recording width corresponding to 4960 pixels, that is, the first to 16th pixels and the 4944th to 4960th pixels, as many elements as the number of elements simultaneously driven in phased array scanning, or 32 elements are allocated to both sides and sets of 16 elements are provided as cover blocks.

Then, the ultrasonic generating element array 10 is divided into a first to 44th groups. In the division, 4960 elements corresponding to the recording width are quadrisected and 1240 elements are determined to be the basic number of elements forming one group. The first and fourth groups on both sides are made of 1256 elements, the sum of the basic number of elements and the number of elements, 16, in the respective cover blocks L and R. By doing this, the connection between groups can be made reliably. The basic operation in the connection process will be explained with reference to the division arrangement of FIG. 39.

In FIG. 39, the connection process is carried out at portions of the individual connection blocks as follows: at connection 1 at the right end of a first group, at connection 2 and connection 3 at both ends of a second group, at connection 4 and connection 5 at both ends of a third group, and at connection 6 at the left end of a fourth group. The number of elements in each connection block is 16, the same as that in cover blocks L and R. A recording operation by phased array scanning starts at the first pixel in the individual groups into which one line of recording pixels=4960 pixels is quadrisected, that is, the first pixel, the 1241st pixel, the 2481st pixel, and the 3721st pixel. In line with this, the first driven ultrasonic generating element group in each quadrisected group in the ultrasonic generating element array 10 is determined.

Specifically, the first one of the recording pixels in one line is recorded by the 16 elements in cover block L of the first group and the 16 adjacent elements, a total of 32 elements; the 1241st pixel is recorded by the 16 elements in connection 1 of the first group and the 16 adjacent elements in connection 2 of the second group, a total of 32 elements; the 2481st pixel is recorded by the 16 elements in connection 3 of the second group and the 16 adjacent elements in connection 4 of the third group, a total of 32 elements; and the 3721st pixel is recorded by the 16 elements in connection 5 of the third group and the 16 adjacent elements in connection 6 of the fourth group, a total of 32 elements. Then, the 32 elements simultaneously driven in the ultrasonic generating element array 30 are shifted one by one and driven, which shifts the pixel to be recorded by a pixel at a time, effecting recording by phased array scanning. Finally, each group of one fourth of one line of recording pixels is shifted by 1240 pixels, which completes recording one line.

At the final stage of recording one line, the last pixel in each group of one fourth of one line of recording pixels is recorded as follows: the 1240th pixel is recorded by the 16 elements in an element of the first group and connection 1, and the 15 elements in a element of the second group and connection 2, a total of 31 elements; the 2480th pixel is recorded by the 16 elements in an element of the second group and connection 3, and the 15 elements in an element of the third group and connection 4, a total of 31 elements; the 3720th pixel is recorded by the 16 elements in an element of the third group and connection 5, and the 15 elements in an element of the fourth group and connection 6, a total of 31 elements; and the 4960th pixel is recorded by the 17 elements of the fourth group and 15 elements in cover block R adjacent thereto, a total of 32 elements.

The ultrasonic generating elements in the connection block set in each group in the ultrasonic generating element array cooperate with the ultrasonic generating elements in the block set in the adjacent group to record a pixel covered by the present group. Therefore, the connection block is controlled by the control blocks corresponding to two groups during the record scanning of one line. This is the basic connection process. The connection process is carried out by the data selector 43, pointer scanning register 54, and driving pattern scanning register 45 shown in FIG. 37.

Figure 40:
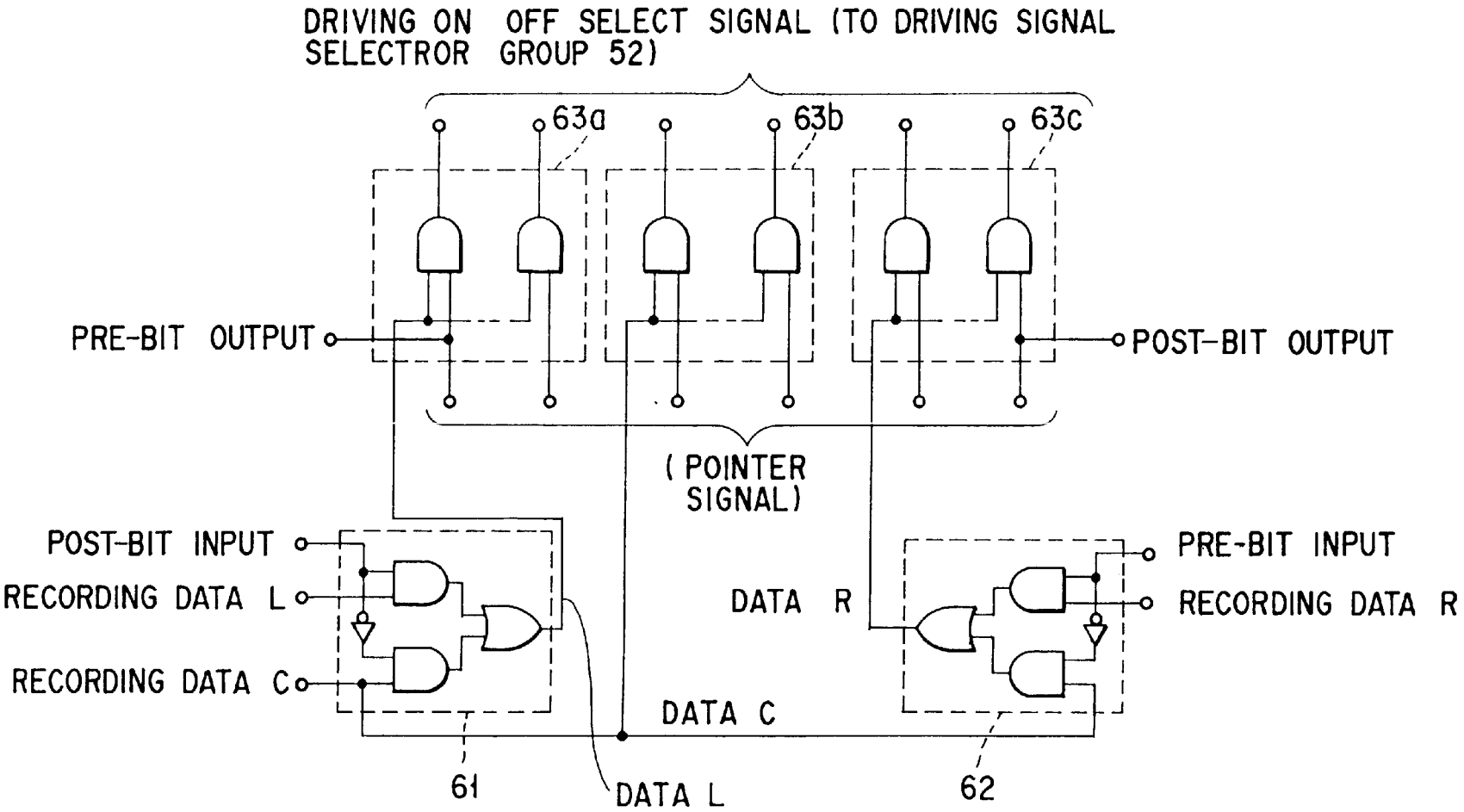
FIG. 40 is a block diagram of the data selector provided in the scanning control section shown in FIG. 37.

FIG. 40 shows the structure of one of the data selectors $\mathbf{53}_1$ to $\mathbf{53}_4$. The data selectors $\mathbf{53}_1$ to $\mathbf{53}_4$ perform data control including the process of connecting recording data (the image signals to be recorded). They receive six kinds of input signals: a pointer signal indicating the ultrasonic generating element group to be simultaneously driven in the ultrasonic generating element array, recording data C as the image signal to be recorded in the present group, recording data L and R as the image signals to be recorded in the groups on both sides, and a prebit input and a postbit input for activating the recording data in the groups on both sides. They output a driving on/off select signal to the driving signal selector group 52. The output section of each of the data selectors $\mathbf{53}_1$ to $\mathbf{53}_4$ is divided into three selector circuits 63*a*, 63*b*, 63*c* according to the recording data to be dealt with. The selector circuits 63*a*, 63*b*, 63*c* carry out the following operation.

The selector circuit 63*b* corresponds to the ultrasonic generating elements other than those in the connection block in the present group, and deals with only recording data C.

The selector circuit 63*a* deals with either recording data L corresponding to the ultrasonic generating elements in the group scanning the pixel area previous to the pixel area covered by the present group from the input selector circuit 61, in a line of pixels, or recording data C corresponding to the ultrasonic generating elements in the present group. Recording data L is selected only when the pointer signal indicating the bottom-end ultrasonic generating element in the group scanning the previous pixel area is active.

The selector circuit 63*c* deals with either recording data R corresponding to the group scanning the pixel area after the pixel area covered by the present group from the input selector circuit 62, in a line of pixels, or recording data C corresponding to the ultrasonic generating elements in the present group. Recording data R is selected only when the pointer signal indicating the top-end ultrasonic generating element in the group scanning the following pixel area is active. The pointer signal indicating the bottom-end ultrasonic generating element in the group scanning the previous pixel area is outputted as a prebit output signal and the pointer signal indicating the top-end ultrasonic generating element in the group scanning the following pixel area is outputted as a postbit output signal.

Figure 41:
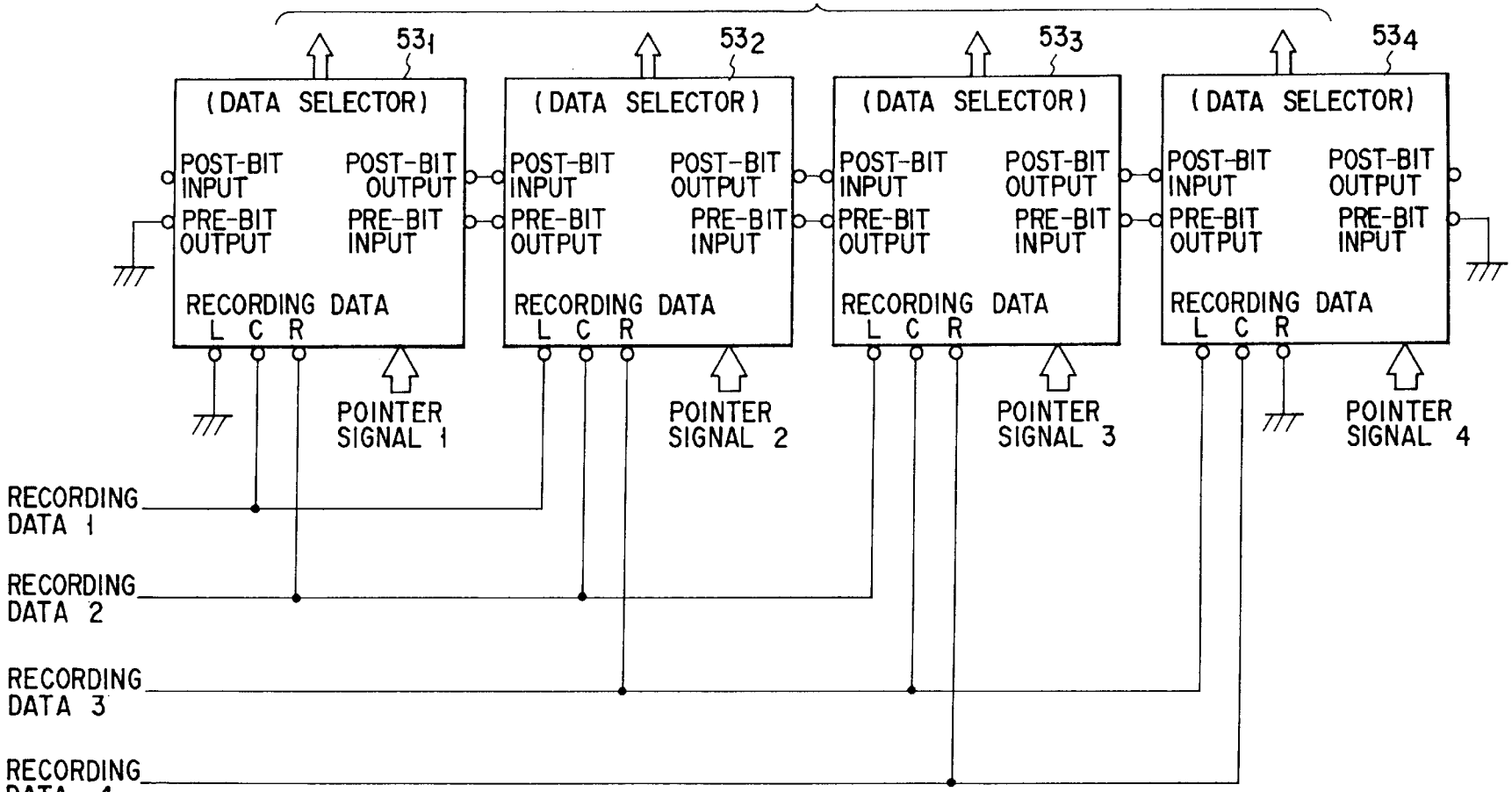
FIG. 41 is a block diagram illustrating the connection of the data selectors provided in the scanning control section shown in FIG. 37.

FIG. 41 shows how the data selectors $\mathbf{53}_1$ to $\mathbf{53}_4$ are connected to each other.

To each of the data selectors $\mathbf{53}_1$ to $\mathbf{53}_4$, a prebit output and a prebit input are connected and further a postbit output and a postbit input are connected. As for recording data items L, C, R inputted to the data selectors $\mathbf{53}_1$ to $\mathbf{53}_4$, the corresponding three or two data items of the four recording data item 1 to 4 transferred in parallel for each group are inputted. As seen from FIG. 41, the data selectors $\mathbf{53}_1$ to $\mathbf{53}_4$ have the structure base on the operation of the data selectors $\mathbf{53}_2$ to $\mathbf{53}_3$ for the second and third groups in the ultrasonic generating element array 10. Even for the data selectors $\mathbf{53}_1$ to $\mathbf{53}_4$ for the first and fourth groups having cover blocks L, R at both sides in the ultrasonic generating element array 10, the same structure as that of the data selectors $\mathbf{53}_2$ to $\mathbf{53}_4$ can be used by inactivating the postbit input and prebit input (e.g., by placing them at a reference potential).

The pointer scanning registers $\mathbf{54}_1$ to $\mathbf{54}_4$ of FIG. 37 will be explained. The pointer scanning registers $\mathbf{54}_1$ to $\mathbf{54}_4$ may be composed of serial-in, parallel-out shift registers, parallel-in, parallel-out shift registers, or parallel-serial-in, parallel-out shift registers. The number of stages of shift registers is determined to agree with the number of elements in each group in the ultrasonic generating element array 10. The parallel outputs of the pointer scanning registers $\mathbf{54}_1$ to $\mathbf{54}_4$ pass through the data selectors $\mathbf{53}_1$ to $\mathbf{53}_4$ and become select signals to the driving signal selector group 52.

The operation of a parallel-in, parallel-out shift register will be explained. The pointer scanning registers $\mathbf{54}_1$ to $\mathbf{54}_4$ are the registers that scan the pointers indicating the ultrasonic generating elements to be active in phased array scanning. With the first timing in a recording operation of one line, the driving start pattern for each group in the ultrasonic generating element array 10 stored in the pointer register 56 in FIG. 37 is set initially at the initial setting section 59, and thereafter shift scanning is effected according to the scanning clock supplied via the clock control section 58. The initially set pattern in the pointer register 56 is determined by the driving start element set in each group in the ultrasonic generating element array corresponding to the beginning recording pixels, the first pixel, the 1241st pixel, the 2481st pixel, and the 3721st pixel.

Specifically, the pattern is such that for the first pixel, the 16 elements in the cover block L of the first group and the 16 adjacent elements, a total of 32 elements, are active; for the 1241st pixel, the 16 elements in connection 1 of the first group and the 16 elements in connection 2 of the second group, a total of 32 elements are active; for the 2481st pixel, the 16 elements in connection 3 of the second group and the 16 elements in connection 4 of the third group, a total of 32 elements are active; and for the 3721st pixel, the 16 elements in connection 5 of the third group and the 16 elements in connection 6 of the fourth group, a total of 32 elements are active.

The driving pattern scanning registers $\mathbf{55}_1$ to $\mathbf{55}_4$ are the registers indicating a 0-phase and π-phase driving patterns for driving the active ultrasonic generating elements by a 0-phase and π-phase driving signals. Like the pointer scanning registers $\mathbf{54}_1$ to $\mathbf{54}_4$, the driving pattern scanning registers may be composed of serial-in, parallel-out shift registers, parallel-in, parallel-out shift registers, or parallel-serial-in, parallel-out shift registers.

The driving pattern is such that with the first timing in a recording operation of one line, the driving start 0/π phase select pattern for each group in the ultrasonic generating element array 10 stored in the pattern register 56 is set initially at the initial setting section 59, and thereafter shift scanning is effected according to the scanning clock supplied via the clock control section 58. The initially set pattern in the pattern register 57 is determined by the driving start element set in each group in the ultrasonic generating element array 10 corresponding to the beginning recording pixels for a line of pixels, the first pixel, the 1241st pixel, the 2481st pixel, and the 3721st pixel.

Specifically, the pattern is formed by grouping the pixels using the width and pitch rounded off on the basis of the concept of the Fresnel zone plate in such a manner that for the first pixel, the 16 elements in the cover block of the first group and the 16 adjacent elements, a total of 32 elements, are grouped; for the 1241st pixel, the 16 elements in connection 1 of the first group and the 16 elements in connection 2 of the second group, a total of 32 elements are grouped; for the 2481st pixel, the 16 elements in connection 3 of the second group and the 16 elements in connection 4 of the third group, a total of 32 elements are grouped; and for the 3721st pixel, the 16 elements in connection 5 of the third group and the 16 elements in connection 6 of the fourth group, a total of 32 elements are grouped. Here, the recording data supplied to four groups in units of 32 elements has only to be always determined. Thereafter, they are masked by the pointer signal from the pointer register 56. The pattern data for the whole single line is not needed.

Such a series of operations are controlled by the clock control section 58 and the initial setting section 59, which provide a recording operation of one line. The pointer register 56 and pattern register 47 may be either a ROM in which fixed data is written or a RAM or a shift register in which data can be written externally.

As described above, in embodiment 4, because the ultrasonic generating element array 10 is divided into a plurality of groups (four groups in the example shown) and it is controlled on the basis of the recording data whether or not the driving signal selector group 52 supplies a driving signal to the corresponding ultrasonic generating element group via the buffer driver group 51, four control means composed of the data selectors $\mathbf{53}_1$ to $\mathbf{53}_4$, pointer scanning registers $\mathbf{54}_1$ to $\mathbf{54}_4$, and driving pattern scanning registers $\mathbf{55}_1$ to $\mathbf{54}_4$ are provided for the respective groups in the ultrasonic generating element array 10. When an ultrasonic generating element group of 32 elements to be simultaneously driven in the ultrasonic generating element array 10 extends over two groups, the connection process is carried out by inputting an image signal for the pixels corresponding to the ultrasonic generating elements in connection 1 to connection 4 extending over the two groups, to the two control means corresponding to the two groups.

By effecting the connection process, scanning recording can be effected with a continuity at the boundary between groups, even if the ultrasonic generating element array 10 is divided into a plurality of groups for a division driving method.

A modification of embodiment 4 associated with a method of driving the ultrasonic generating element array 10 will be explained.

(1) While in embodiment 4, the number of elements simultaneously driven in the ultrasonic generating element array 10, or the number of ultrasonic generating elements simultaneously driven in each group is constant (32), the number may be odd and even alternately the arranging direction. By doing this way, a double recording density can be achieved using the same ultrasonic generating element array. Specifically, when the number of elements simultaneously driven is even, a pixel is recorded at a position opposite to center of two ultrasonic generating elements. When the number of elements simultaneously driven is odd, a pixel is recorded at a position opposite to an ultrasonic generating element itself. Therefore, by alternating an odd number of elements simultaneously driven with an even number of elements simultaneously driven, the recording density is twice as high as that achieved in scanning with a fixed odd or even number of elements simultaneously driven.

To achieve this, the pointer scanning registers $\mathbf{54}_1$ to $\mathbf{544}_4$, driving pattern scanning registers $\mathbf{45}_1$ to $\mathbf{45}_4$, point register 46, and pattern register 57 in FIG. 37 are made of a two-layer structure, and the number of elements simultaneously driven is switched between an odd and even numbers alternately, thereby producing a select signal to the data selectors $\mathbf{53}_1$ to $\mathbf{53}_4$. In this case, as shown in FIG. 37, a mode change signal for switching between the normal mode and the high-definition mode is externally supplied to the clock control section 58. In the normal mode, a scanning clock is supplied only to the first layers of the pointer scanning registers $\mathbf{54}_1$ to $\mathbf{54}_4$, driving pattern scanning registers $\mathbf{45}_1$ to $\mathbf{45}_4$, point register 46, and pattern register 57, and the number of elements simultaneously driven is odd or even only. In the high-definition mode, a scanning clock is supplied to both of the first layer and the second layer, and the number of elements simultaneously driven is switched between odd and even alternately.

(2) A control method of correcting the shortcoming of the ink-droplet squirting mechanism to improve the recording speed will be explained. With an ink-jet recording device of the present invention, an ink droplet flies from a free flat surface filled with ink liquid. As a result, when an ink droplet flies, ripples appear on the ink surface and it takes a certain time for the ripples to disappear each time an ink droplet flies. If an ink droplet is forced to fly at the position corresponding to the pixel immediately next to the pixel just recorded by the previous ink droplet, that is, if an attempt is made to record the adjacent pixel continuously in time, the focus of the ink droplet will not be determined and an unstable flying of ink droplet will result.

In the above embodiments, scanning control where after the ripples on the ink surface have disappeared to some extent, the immediately adjacent pixel is recorded consecutively, has been explained. To achieve higher-speed recording, an ink droplet is forced to fly to a pixel sufficiently away from the just recorded pixel, not to the immediately adjacent pixel. That is, by recording a pixel through skip scanning, the recording speed can be improved.

The basic operation of the control realized on the configuration of FIG. 37 will be explained. The ultrasonic generating element array 10 is divided into four groups, which are separated into odd-numbered groups and even-numbered groups. The odd-numbered groups and even-numbered groups effect recording alternately. In this case, recording is effected in such a manner that pixels in the odd-numbered groups (the first group and the third group), for example, the first pixel and the 2481st pixel, are recorded first; then, pixels in the even-numbered groups (the second group and the fourth group) away from the previous groups, for example, the 1241st pixel and the 3721st pixel, are recorded; thereafter, the operation returns to the odd-numbered groups and the adjacent pixels, or the second pixel and the 2482nd pixel are recorded; then the operation goes to the even-numbered groups and the 1242nd pixel and the 3722nd pixel are recorded. This doubles the interval time in recording two adjacent pixels, enabling effective use of the time required for ripples to disappear.

While in the previous explanation, the four groups in the ultrasonic generating element array 10 record four pixels simultaneously, the above technique enables two groups to record two pixel at a time, reducing the recording speed to half. To obtain the same effect without sacrificing the recording speed, the ultrasonic generating element array is divided into eight or more groups, and a division driving method is performed where four or more groups are used to record four or more pixels.

(3) To record a two-dimensional image with an ink-jet recording device of the present invention, the device is combined with a sub-scanning mechanism that feeds recording paper in the main-scanning direction of the line scanning recording head and in the direction perpendicular to the main-scanning direction, as with conventional image recording devices. Generally, the sub-scanning paper feed mechanism has two types: one type of paper feed mechanism feeds recording paper intermittently in synchronization with the recording speed of one line on the line scanning recording head, and the other type of feed mechanism feeds recording paper continuously. When the division driving method explained in the above embodiments, or a method of dividing the ultrasonic generating element array 10 into, for example, four groups and driving them, is used, a provision for transferring recording data to the control circuit in the line scanning recording head is needed.

Figure 42:
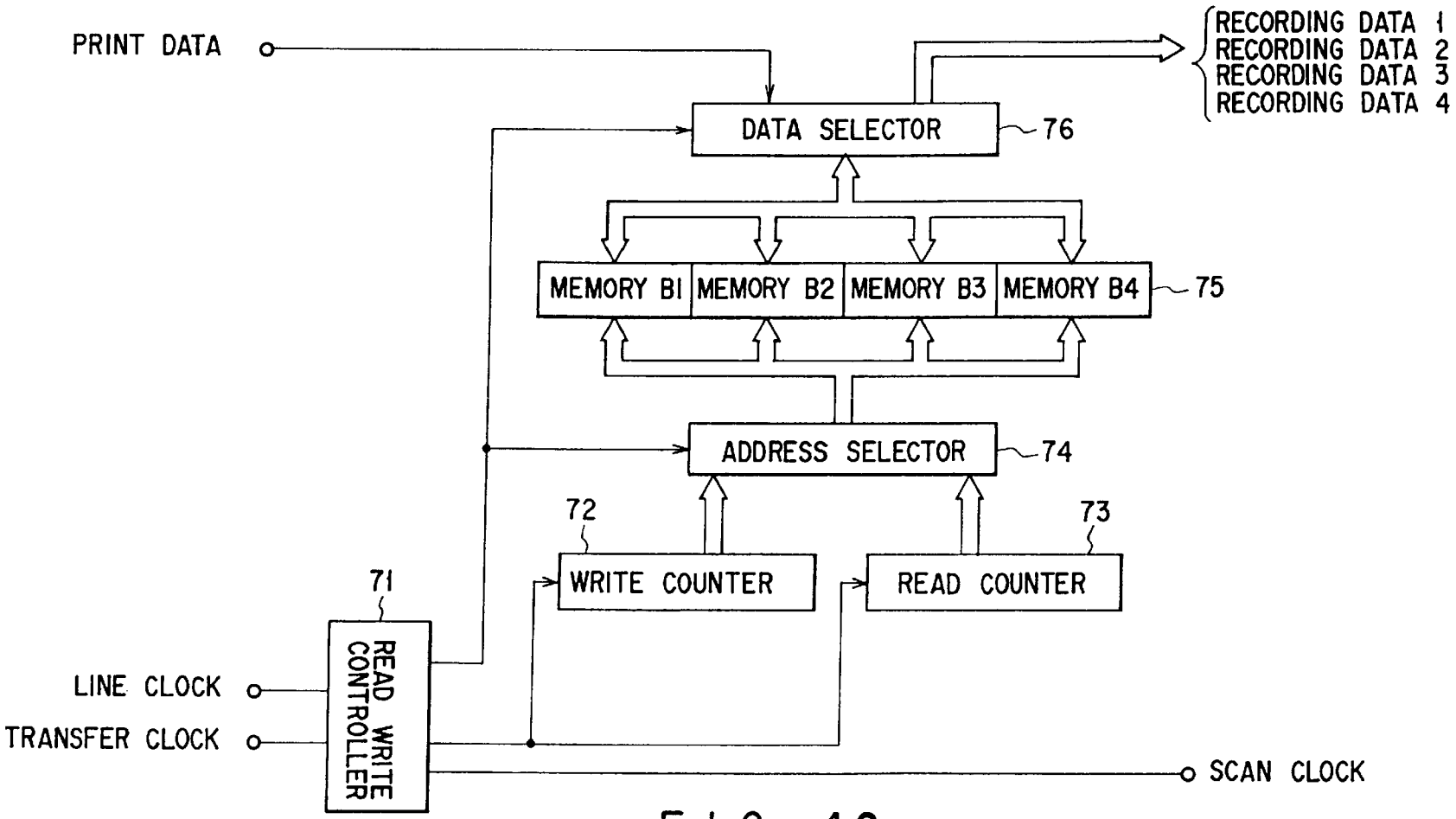
FIG. 42 is a block diagram of the record data buffer incorporated in Embodiment 4, for effecting intermittent sub-scanning in Embodiment 4.

(3-1) FIG. 42 shows the structure of the recording data buffer in the basic quadrisection driving with intermittent sub-scanning. The recording data buffer buffers the recording data to be supplied to the data selector $\mathbf{53}_1$ to $\mathbf{53}_4$ shown in FIG. 37 and FIG. 41, and is composed of a read/write control section 71, a write counter 72, a read counter 73, an address selector 74, a buffer memory 75, and a data selector 76.

Since in intermittent sub-scanning, recording paper remains still until the line scanning recording head has finished recording one line, the buffer memory 75 has a memory capacity for one line and stores one line of print data serially inputted at its end via the data selector 76. This is done in the write mode. Under the control of the read/write control section 71, the data selector 76 transfers the print data to the buffer memory 75. The address selector 74 is controlled by the output from the write counter 72 and transfers the write address to the buffer memory 75. By controlling the addresses in groups divided corresponding to the number of pixels (1240 pixels) into which the number of effective recording pixels (4960 pixels in the previous example) in the line scanning recording head of the invention is quadrisected, the print data stored in the buffer memory 75 is read out as recording data 1 to 4. This is done in the read mode. Under the control of the read/write control section 71, the data selector 76 transfers the data read from the buffer memory 75 to the data registers $\mathbf{43}_1$ to $\mathbf{43}_4$ of FIG. 37. The address selector 74 is controlled by the output of the read counter 73 and transfers the read address to the buffer memory 75. The recording data 1 to 4 are read sequentially, starting at that corresponding to the head of each divided group.

When one line of recording has been completed in this way, the recording sheet is advanced by one scanning line in the sub-scanning direction. In the meantime, the next one line of print data is transferred to the buffer memory 75, and the recording of the next line starts. The buffer memory 75 may be of a double buffer structure. With this structure, by switching each buffer memory alternately between the read mode and the write mode, the waiting time for print data transfer can be made shorter.

Figures 43, 44A, 44B:
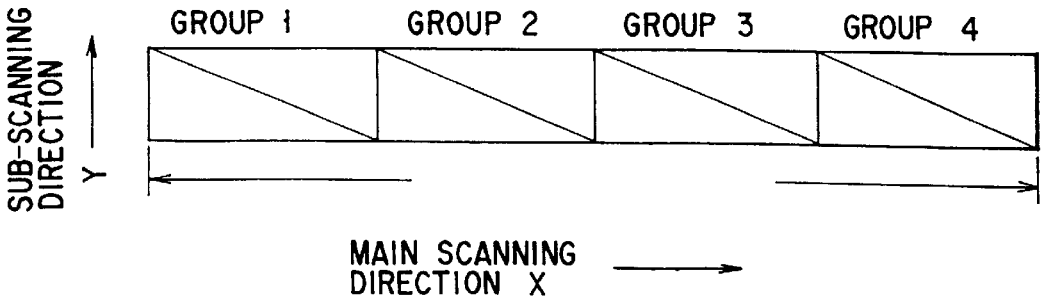
FIG. 43 is a diagram showing the condition of main scanning lines, for explaining the problem which arises when intermittent sub-scanning is carried out in Embodiment 4.
FIGS. 44A and 44B are diagrams explaining how to straighten the main scanning lines when intermittent sub-scanning is carried out in Embodiment 4.

(3-2) Recording data transfer in quadrisection driving with continuous feed sub-scanning will be described. A problem with a simple combination of division driving and continuous sub-scanning is that the main-scanning line is not straight. Specifically, as shown in FIG. 43, when the main-scanning width W is divided into four groups and tun individual groups undergo record scanning simultaneously, starting from the left end, the scanning lines 1 to 4 corresponding the respective groups of the main-scanning line each have a slope, with the result that the entire main-scanning line does not make a straight line. The reason for this is that the recording sheet is advanced even during the main scanning.

In this modification, a buffer memory with as many lines as the number of divided groups in the ultrasonic generating element array is provided, for example, when the ultrasonic generating element array is divided into four groups, a buffer memory with four lines is provided. By controlling the buffer memory, the main-scanning line is made straight.

FIGS. 44A and 44B illustrate the concept.

FIG. 44A shows how the print data from which the recording data is made is stored in a four line buffer memory. In FIG. 44A, A1, A2, A3, A4 indicate the print data for the first line, second line, third line, and fourth line, respectively. Each of them is divided into four elements in the main-scanning direction and controlled in the form of A1-1 to A1-4, A2-1 to A2-4, A3-1 to A3-4, and A4-1 to A4-4.

FIG. 44B diagrammatically shows the recording signals actually recorded. B1, B2, B3, B4, B5, B6 indicate the number of main-scanning lines on the line scanning recording head. As shown in FIG. 43, each main-scanning line is not straight. To overcome this problem, four main-scanning lines are treated as one set, and the print data items corresponding to the set are combined so as to obtain a single straight line. Concretely, quadrisected elements A1-1, A1-2, A1-3, A1-4 in print data Al for the first line of FIG. 44A are allocated to elements B1-1, B2-2, B3-3, B4-4 shifted sequentially in the main-scanning direction in the main-scanning direction of the first to fourth lines of FIG. 44B.

By doing this, the main-scanning line tilts a little toward the direction perpendicular to the sub-scanning direction, as a whole, but a straight main-scanning line can be achieved. If the main-scanning width W is 210 mm, the inclination of the main-scanning line will be converted into a distance of about 170 μm between one end and the other end of the main-scanning width W in the sub-scanning direction, so that it is so small that it can be neglected practically.

To make the main-scanning line straight by the above technique, print data transfer control is carried out as follows. A four-line buffer memory 70 that can store the image signals (print data) for four lines, the same number as the number of divided groups in the ultrasonic generating element array 10 is provided. The print data, the image signal, is stored in the four-line buffer memory as shown in FIG. 44A. The four-line buffer memory 70 shifts the print data corresponding to each group in the same line by one line one after another, and transfers it to control means corresponding to each group, that is, the data selectors $\mathbf{53}_1$ to $\mathbf{53}_4$ of FIG. 37 as recording data 1 to 4.

Specifically, for B1 recording lines, only data on A1-1 is transferred to the first group B1-1; for B2 recording lines, data on A2-1 is transferred to the first group B2-1 and data on A1-2 is transferred to the second group B2-2; for B3 recording lines, data on A3-1 is transferred to the first group B3-1, data on A2-2 is transferred to the second group B3-2, and data on A1-3 is transferred to the third group B3-3; for B4 recording lines, data on A4-1 is transferred to the first group B4-1, data on A3-2 is transferred to the second group B4-2, data on A2-3 is transferred to the third group B4-3, and data on A1-4 is transferred to the fourth group B4-4; for B5 recording lines, data on A5-1 is transferred to the first group B5-1, data on A4-2 is transferred to the second group B5-2, data on A3-3 is transferred to the third group B5-3, and data on A2-4 is transferred to the fourth group B5-4.

As described above, the four-line buffer memory 70 shifts the print data corresponding to each of the four groups in the same line by one line in time one after another and repeatedly transfers it as recording data 1 to 4 to the data selector $\mathbf{53}_1$ to $\mathbf{53}_4$, with the result that a straight main-scanning line can be obtained in continuous feed sub-scanning. To effect continuous feed sub-scanning smoothly, it is desirable that in the case of quadrisection driving, a line buffer memory for one line should be added to the four-line buffer memory to form a five-line buffer memory. The additional line buffer memory is needed for a subsequent one line.

(4) Gradation recording will be explained. Gradation recording on an ink-jet recording device of the present invention can be realized by changing the driving time of the ultrasonic generating elements according to the gradation image signal. Concretely, gradation recording can be achieved by changing the on time duration of the driving on/off select signal supplied to the driving signal selector group 52 in FIG. 37. The recording data signals from the data selectors $\mathbf{53}_1$ to $\mathbf{53}_4$ are used as it is as the driving on/off select signal, so that the pulse width of each pixel for the recording data has only to be modulated according to the multi-level recording data, the gradation image signal.

Figure 45:
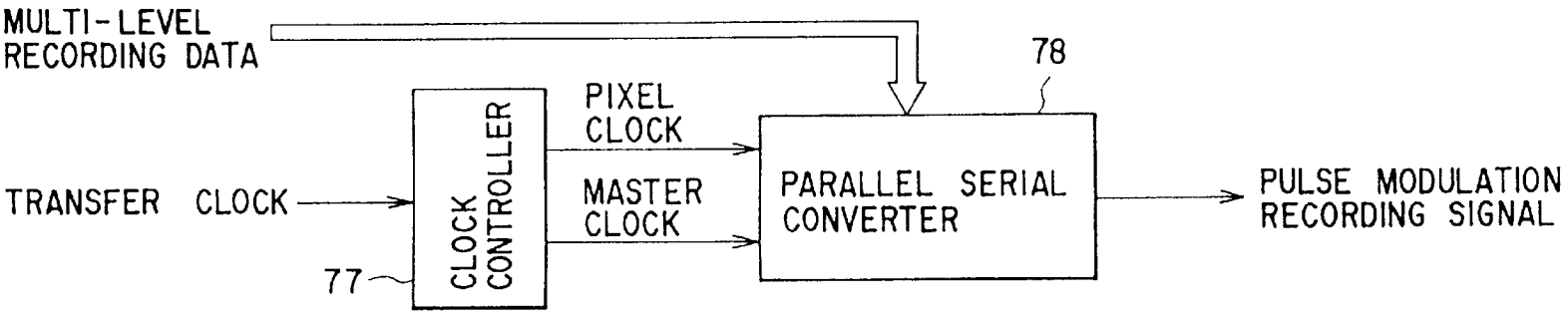
FIG. 45 is a block diagram of a system for use in the present invention, to record multi-gray level images.

FIG. 45 shows a circuit for gradation recording. In the circuit, a parallel-serial conversion circuit 78, which operates using the pixel clock and master clock generated at a clock control section 77 in synchronization with a transfer clock, converts multi-level recording data into a pulse-width modulation signal.

Embodiment 5-1

Figure 46:
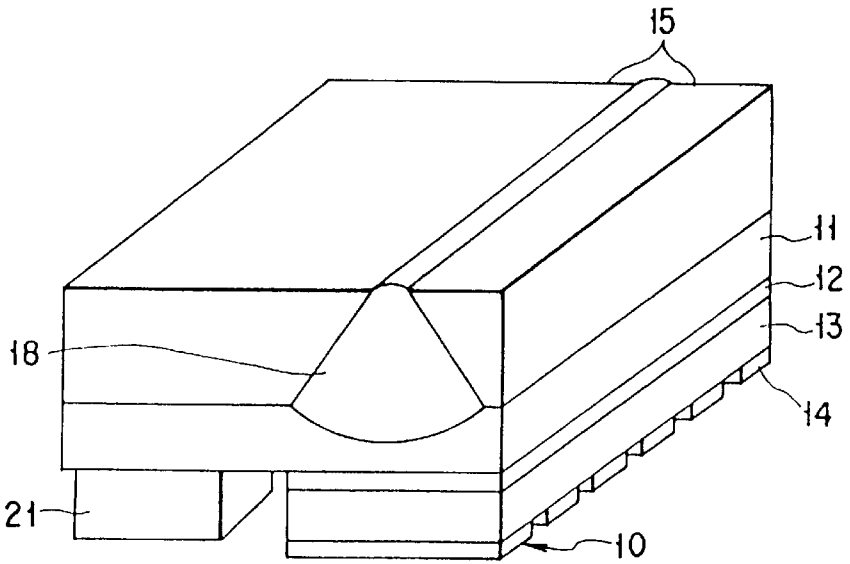
FIG. 46 is a perspective view of the recording head section used in an ink-jet recording device according to Embodiment 5-1 of the invention.

FIG. 46 is a perspective view of the recording head section used in an ink-jet recording device according to Embodiment 5-1 of the invention. As shown in FIG. 46, the recording head section comprises a piezoelectric element array 10, an acoustic lens 11, an ink reservoir 15, and a drive circuit 21.

The piezoelectric element array 10 is formed of a piezoelectric layer 13, a common electrode 12, and a plurality of discrete electrodes 14. The piezoelectric layer 13 is an elongated plate having a uniform thickness. The common electrode 12 is mounted on the upper surface of the layer 13. The discrete electrodes 14 are mounted on the lower surface of the layer 13, spaced apart one from another. The common electrode 13, the piezoelectric layer 13, and the discrete electrodes 14 constitute a plurality of piezoelectric elements. The piezoelectric elements are juxtaposed in a straight line which extends in the main-scanning direction.

The acoustic lens 11 is provided on the upper surface of the common electrode 12. The lens 11 is, for example, a glass plate. It has a concave in the surface which faces away from the piezoelectric element array 10 and functions as an acoustic concave lens. The ink reservoir 15 is placed on the acoustic lens 11. The reservoir 15 has an ink chamber. The ink chamber has a sector-shaped cross section, gradually narrowing away from the acoustic lens 11 for guiding ultrasonic beams from the piezoelectric elements. The ink chamber is filled with liquid ink 18.

The drive circuit 21 is mounted on the lower surface of the glass plate, i.e., the acoustic lens 11. More precisely, the drive circuit 21 is connected to the common electrode 12 and the discrete electrodes 14 by a patterned wiring (not shown) provided on the lower surface of the glass plate.

In accordance with input image data (described later in detail), the drive circuit 21 drives the piezoelectric element array 10, performing linear electronic scanning. To be more specific, the circuit 21 first supplies high-frequency drive signals delayed from one another to the n consecutive elements T(1) to T(n) of the array 10 so that an ink droplet may fly from a point P0 on the surface of the ink 18. The circuit 21 then supplies similar high-frequency drive signals the n elements T(2) to T(n+1) so that an ink droplet may fly from a point P1 spaced from point P0 by the pitch at which the piezoelectric elements are juxtaposed in the main-scanning direction. Next, the circuit 21 supplies similar high-frequency drive signals the n elements T(3) to T(n+2) so that an ink droplet may fly from a point P2 spaced from point P0 by a two-pitch distance from point P0. The circuit 21 further drives the piezoelectric elements in similar way, n elements each time. As a result, the recording head section will squirt ink droplets, one after another, onto a recording medium (not shown), forming a line thereon.

The ultrasonic beams emitted from any n piezoelectric elements of the array 10 are applied to the acoustic lens 11. The acoustic lens 11 converges the ultrasonic beams in a plane extending in the direction (sub-scanning direction) at right angles to the main-scanning direction. As a result, the beams reach a point in the surface of the ink 18. The beams applies a pressure (emission pressure) to the ink 18. A conical ink meniscus grows, and an ink droplet fly from the meniscus. The ink droplet lands on the recording medium (not shown), adheres thereto and dries, forming a dot on the medium. An image is thereby formed on the recording medium.

Figure 47:
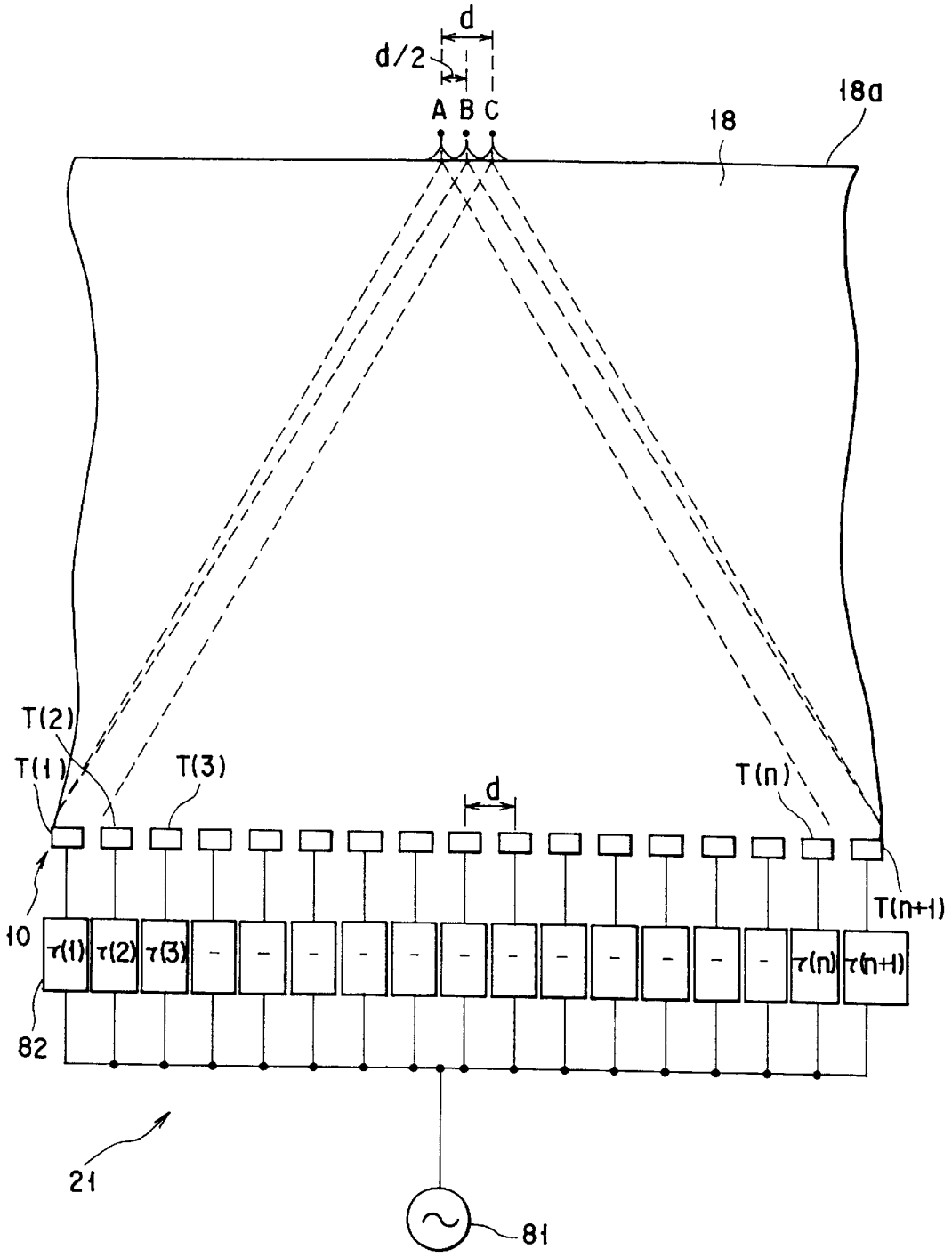
FIG. 47 is a diagram explaining how to drive the piezoelectric element array provided in Embodiment 5-1.

The method of driving the piezoelectric element array 10 will be explained in greater detail, with reference to FIG. 47. In FIG. 47 the acoustic lens 11 is not illustrated for simplicity of explanation. As shown in FIG. 47, the drive circuit 21 comprises a drive signal source 81 and a delay circuit 82. The drive signal source 81 generates drive signals in accordance with the input image data. The delay circuit 82 delays the drive signals by the time preset by a control circuit (not shown). The drive signal the circuit 82 has delayed are supplied to the piezoelectric elements of the array 10.

Assume that adjacent n piezoelectric elements T(1) to T(n) form a group. If the delay circuit 82 delays the drive signals such that the phases of the ultrasonic beams emitted from the elements T(1) to T(n) coincide at point A on the surface of the ink 18, which is located right above the midpoint of the first group of piezoelectric elements, an ink droplet will fly from point A. If the delay circuit 82 delays the drive signals such that the phases of the ultrasonic beams emitted from the elements T(2) to T(n+1) coincide at point C on the surface 18*a* of the ink 18, which is located right above the midpoint of the group consisting of the elements T(2) to T(n+1), an ink droplet will fly from point C. Obviously, point C is at a distance d from point A, the distance d being equal to the pitch at which the piezoelectric elements are juxtaposed in the main-scanning direction.

Also assume that adjacent n+1 piezoelectric elements T(1) to T(n+1) form a group. If n is an even number, the circuit 82 delays the drive signals to be supplied to the elements T(1) to T(n/2) in the same way as is necessary to fly an ink droplet from point A, delays the drive signal to be supplied to the element T(n/2+1) in the same way it delays the drive signal to the element T(n/2) as is required to fly an ink droplet from point A, and delays the drive signals to be supplied to the elements T(T/2+2) to T(n+1) more by one unit delay time than the drive signals supplied to the elements T(n/2+1) to T(n) to fly an ink droplet from point A.

In other words, if n is an even number, the pattern of delaying the signals for driving the elements T(1) to T(n) to squirt an ink droplet from point A is divided into two sub-patterns. The first sub-pattern is applied to the elements T(1) to T(n/2), while the second sub-pattern is applied to the remaining elements T(n/2+2) to T(n+1), and the same delayed drive signal as supplied to the element T(n/2) is supplied to the middle element T(n/2+1).

If n is an odd number, the pattern of delaying the signals for driving the elements T(1) to T(n) to squirt an ink droplet from point A is divided into two sub-patterns. The first sub-pattern is applied to the elements T(1) to T(n/2+0.5), while the second sub-pattern is applied to the remaining elements T(n/2+1.5) to T(n), and the same delayed drive signal as supplied to an additional element located between the elements T(n/2+0.5) and T(n/2+1.5) is supplied to the middle element T(n/2+1).

In this case, when the piezoelectric elements T(1) to T(n+1) are driven simultaneously, an ink droplet flies from point B which is at a distance d/2 from point A. The distance d/2 is equal to half the pitch at which the piezoelectric elements are juxtaposed in the main-scanning direction.

As described above, the piezoelectric elements can be driven in a first mode wherein an even number of elements forming a group emits an ultrasonic beam having an axis extending through the midpoint of the group. Alternatively, the elements can be driven in a second mode wherein an odd number of elements forming a group emit an ultrasonic beam having an axis extending through the midpoint of the group. In either case, the recording head section squirts ink droplets at half the pitch at which the piezoelectric elements are juxtaposed. Further, the recording head section squirts each ink droplet along a straight path perpendicular to the surface 18*a* of the ink 18, since the pattern (i.e., the drive-signal phase pattern) in which the drive signals are delayed to apply ink droplets from points A, B and C is symmetrical with respect to the midpoint of the group of elements driven at the same time. Still further, it is easy to delay the drive signals since the drive-signal delay pattern for the group consisting of n elements differs the drive-signal delay pattern fro the group consisting of (n+1) elements, by only one item corresponding to one piezoelectric element.

A piezoelectric element array according to Embodiment 5-1 was made, and was driven by the method described above.

The piezoelectric elements were juxtaposed at a pitch of 50 $\mu$m. Thirty-six (36) forming a group were driven simultaneously by drive signals having a frequency of 100 MHz. The focal length of the ultrasonic beam emitted from the elements of each group emitted was 3 mm. (Namely, the thickness of the ink layer was 3 mm.) The velocity of sound was 1.5 km/sec in the liquid ink 18, as in water. It follows that the wavelength the ultrasonic beam had while traveling through the liquid ink 18 was 15 $\mu$m.

The phase (delay time) for each of the ultrasonic beams emitted from the 36 piezoelectric elements forming the group was set at one of two values based on Fresnel diffraction theory. More specifically, the radius of Fresnel zone ring was determined by Equation (1) or (2):

$$r(n) = \left\{\frac{(2n-1)\lambda i}{2} \times \left(F + \frac{(2n-1)\lambda i}{8}\right)\right\}^{1/2} \quad (1)$$

(n=0, 1, 2, . . . , where when n=0, r(0)=0.)

$$r(n)=(n\lambda iF)^{1/2}(n=0, 1, 2, \ldots) \quad (2)$$

where n is an integer equal to or greater than 0 (namely, n=0, 1, 2, . . . ), $\lambda i$ is the wavelength of the ultrasonic beam, and F is the focal length (the thickness of the ink layer). Table 1 presented below shows the radii r(n) (n=0 to 19) of Fresnel zone rings, thus determined.

TABLE 1

| | |
|---|---|
| r(0) | 0 mm |
| r(1) | 0.150 mm |
| r(2) | 0.260 mm |
| r(3) | 0.336 mm |
| r(4) | 0.398 mm |
| r(5) | 0.451 mm |
| r(6) | 0.499 mm |
| r(7) | 0.543 mm |
| r(8) | 0.584 mm |
| r(9) | 0.622 mm |
| r(10) | 0.658 mm |
| r(11) | 0.692 mm |
| r(12) | 0.725 mm |
| r(13) | 0.756 mm |
| r(14) | 0.786 mm |
| r(15) | 0.815 mm |
| r(16) | 0.843 mm |
| r(17) | 0.871 mm |
| r(18) | 0.897 mm |
| r(19) | 0.923 mm |

Next, the delay time for the ultrasonic beam emitted from each piezoelectric element was set at such value that the beams emitted from the elements at a distance D greater than r(2n) and less than r(2n+1) were out of phase by half the wavelength with respect to the beams emitted from the elements at a distance D greater than r(2n+1) and less than r(2n+3), where D is the distance between each piezoelectric element and the midpoint of the cement group. The delay times $\tau(n)$ (n=1 to 36), thus set, were as shown in the second column of Table 2 presented below. When all elements of the group (i.e., the thirty-six elements) were driven at the same time, an ink droplet flew from the ink surface 18*a*, at a point located right above the midpoint between the 18th and 19th piezoelectric elements. This point corresponds to point A shown in FIG. 47.

TABLE 2

| | Flying point of First piezoelectric element group Point A | Flying point of Second piezoelectric element group Point B |
|---|---|---|
| τ(1) | 5 nsec | 5 nsec |
| τ(2) | 5 nsec | 5 nsec |
| τ(3) | 5 nsec | 5 nsec |
| τ(4) | 0 sec | 0 sec |
| τ(5) | 0 sec | 0 sec |
| τ(6) | 5 nsec | 5 nsec |
| τ(7) | 5 nsec | 5 nsec |
| τ(8) | 0 sec | 0 sec |
| τ(9) | 5 nsec | 5 nsec |
| τ(10) | 0 sec | 0 sec |
| τ(11) | 5 nsec | 5 nsec |
| τ(12) | 0 sec | 0 sec |
| τ(13) | 0 sec | 0 sec |
| τ(14) | 5 nsec | 5 nsec |
| τ(15) | 5 nsec | 5 nsec |
| τ(16) | 0 sec | 0 sec |
| τ(17) | 0 sec | 0 sec |
| τ(18) | 0 sec | 0 sec |
| τ(19) | 0 sec | 0 sec |
| τ(20) | 0 sec | 0 sec |
| τ(21) | 0 sec | 0 sec |
| τ(22) | 5 nsec | 0 sec |
| τ(23) | 5 nsec | 5 nsec |
| τ(24) | 0 sec | 5 nsec |
| τ(25) | 0 sec | 0 sec |
| τ(26) | 5 nsec | 0 sec |
| τ(27) | 0 sec | 5 nsec |
| τ(28) | 5 nsec | 0 sec |
| τ(29) | 0 sec | 5 nsec |
| τ(30) | 5 nsec | 0 sec |
| τ(31) | 5 nsec | 5 nsec |
| τ(32) | 0 sec | 5 nsec |
| τ(33) | 0 sec | 0 sec |
| τ(34) | 5 nsec | 0 sec |
| τ(35) | 5 nsec | 5 nsec |
| τ(36) | 5 nsec | 5 nsec |
| τ(37) | undriving | 5 nsec |

The array was divided into groups, each consisting of thirty-seven piezoelectric elements to be driven simultaneously to squirt an ink droplet from point B spaced from point A by half the pitch at which the piezoelectric elements were juxtaposed in the main-scanning direction. In this case, the phases (delay times) for the ultrasonic beams emitted from the elements were set at the values shown in the second column of Table 2. As evident from Table 2, the delay times for the beams from the first to 18th elements were respectively identical to those set for squirting an ink droplet from point A; the delay time for the beam from the 19th element was equal to the delay time set for squirting an ink droplet from point A; and the delay times for the beams from the 20th to 37th elements were respectively identical to the 19th to 36th elements for squirting an ink droplet from point A. When all piezoelectric elements of the group (i.e., the thirty-seven elements) were driven at the same time, an ink droplet flew from the ink surface 18*a*, at point B located right above the 19th element, or the midpoint of the group.

Figure 48:
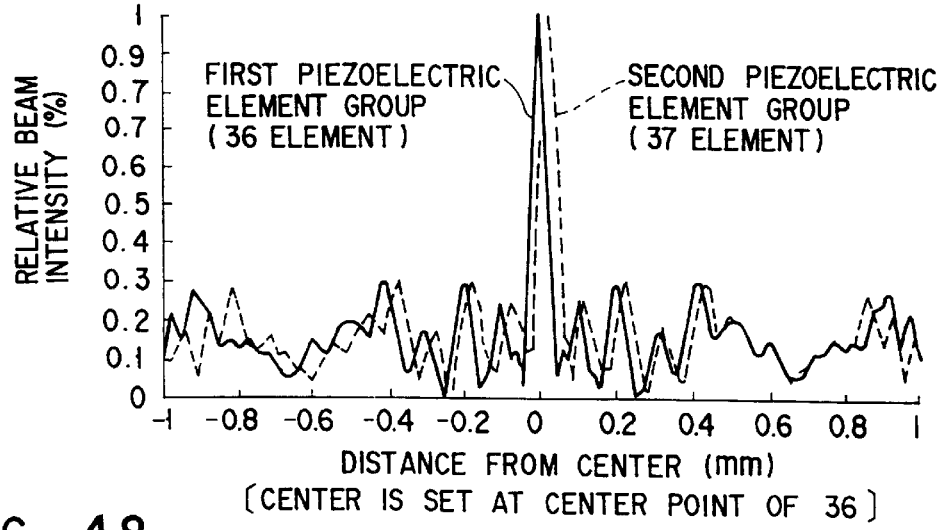
FIG. 48 is a diagram representing the acoustic distribution on the ink surface, observed in Embodiment 5-1.

FIG. 48 represents the acoustic distribution which was observed on the ink surface when the thirty-six piezoelectric elements were driven simultaneously, and also the acoustic distribution which was observed on the ink surface when the thirty-seven piezoelectric elements were driven simultaneously. In FIG. 48, plotted on the abscissa is the distance from the midpoint of the group of the elements, and plotted on the ordinate is the relative intensity of the ultrasonic beam emitted from each piezoelectric element. As can be understood from FIG. 48, the main beam was emitted from a point at a distance of 25 μm from the midpoint of either group of elements (36 or 37 elements). The side lobes emitted from the group of elements differed in intensity, but slightly. The main beam emitted when the thirty-seven elements were driven simultaneously had intensity about 3% higher than the intensity of the main beam emitted when the thirty-six elements were driven simultaneously. Nonetheless, is virtually no difference was resulted in the size of the ink droplet actually flew from the liquid ink. However, the less the piezoelectric elements of one group than those of the another group, the greater the difference in the intensity of the main beam, producing a considerable difference in the size of the ink droplet. To reduce the difference in the intensity of the main beam, it is desirable to decrease that the number of piezoelectric elements forming a larger group or to change either the drive voltage or the number of bursts.

In the method of setting the delay times at the values shown in Table 2, the delay time for imparting a π shift to the phases of the ultrasonic waves was 5 nsec. This delay time was half the one-cycle period of the drive signals. The delay time may be multiplied an odd number times to provide similar results. The phases of the ultrasonic waves may be shifted by π, not only by using the delay circuit 82 shown in FIG. 47. But also can the phases be shifted by driving the piezoelectric elements with a drive signal voltage inverted in phase. When the elements are driven with such a drive signal voltage, it suffices to use a simple changeover switch, and the drive circuit is relatively simple and, hence, can be manufactured at low cost.

In the method of setting the delay times at the values shown in Table 2, the delay times were set such that the ultrasonic beam emitted from the 19th of the thirty-seven elements had the same phase as the beams emitted from the 18th and 20th elements. Nonetheless, the 19th element need not necessarily be driven. An ink droplet will fly in the same way even if the pattern of delaying the drive signals is divided into two sub-patterns, the first sub-pattern applied to the first 18 of the thirty-six elements, and the second sub-pattern applied to the 20th to 35th or 37th elements.

In Embodiment 5-1, one piezoelectric element is added to the group consisting of thirty-six elements, thereby providing a group consisting of thirty-six elements. Instead, any other odd number of elements may be added to the group consisting of thirty-six elements. Rather, an odd number of elements may be removed from the group consisting of thirty-six elements, providing a group consisting of less piezoelectric elements. It is desirable, however, that one element be inserted in the 36-element group at the midpoint of the group so as to attain acoustic distribution on the ink surface which is symmetrical with respect to the midpoint of the element group.

Embodiment 5-2

The recording head section incorporated in an ink-jet recording device which is Embodiment 5-1 of the invention will be described. In this embodiment, the recording head section is driven by electronic focusing method. To be more precise, the groups of piezoelectric elements are driven with delay times which are quadratic functions obtained from the distances between a focal point and the piezoelectric elements a focal point. A delay time τ (n) given by Equation (3) shown below, is set for the n-th of the m piezoelectric elements forming a group.

$$\tau(n) = \frac{d^2}{2Fv} \times \left(\left(\frac{m-1}{2}\right)^2 - \left(n - \frac{m+1}{2}\right)^2\right) \tag{3}$$

where d is the pitch at which the piezoelectric elements are juxtaposed, F is the focal length (the thickness of the ink layer), and v is the velocity of sound in the liquid ink.

TABLE 3

| | Flying point of | Flying point of Second piezoelectric element group Point B | |
|---|---|---|---|
| | First piezoelectric element group Point A | Conventional Electric Focus Method | Driving of the Invention |
| τ(1) | 0 sec | 0 sec | 0 sec |
| τ(2) | 9 nsec | 10 nsec | 9 nsec |
| τ(3) | 18 nsec | 19 nsec | 18 nsec |
| τ(4) | 27 nsec | 28 nsec | 27 nsec |
| τ(5) | 34 nsec | 36 nsec | 34 nsec |
| τ(6) | 42 nsec | 43 nsec | 42 nsec |
| τ(7) | 48 nsec | 50 nsec | 48 nsec |
| τ(8) | 54 nsec | 56 nsec | 54 nsec |
| τ(9) | 60 nsec | 62 nsec | 60 nsec |
| τ(10) | 65 nsec | 68 nsec | 65 nsec |
| τ(11) | 69 nsec | 72 nsec | 69 nsec |
| τ(12) | 73 nsec | 76 nsec | 73 nsec |
| τ(13) | 77 nsec | 80 nsec | 77 nsec |
| τ(14) | 79 nsec | 83 nsec | 79 nsec |
| τ(15) | 82 nsec | 86 nsec | 82 nsec |
| τ(16) | 83 nsec | 88 nsec | 83 nsec |
| τ(17) | 84 nsec | 89 nsec | 84 nsec |
| τ(18) | 85 nsec | 90 nsec | 85 nsec |
| τ(19) | 85 nsec | 90 nsec | 85 nsec |
| τ(20) | 84 nsec | 90 nsec | 85 nsec |
| τ(21) | 83 nsec | 89 nsec | 84 nsec |
| τ(22) | 82 nsec | 88 nsec | 83 nsec |
| τ(23) | 79 nsec | 86 nsec | 82 nsec |
| τ(24) | 77 nsec | 83 nsec | 79 nsec |
| τ(25) | 73 nsec | 80 nsec | 77 nsec |
| τ(26) | 69 nsec | 76 nsec | 73 nsec |
| τ(27) | 65 nsec | 72 nsec | 69 nsec |
| τ(28) | 60 nsec | 68 nsec | 65 nsec |
| τ(29) | 54 nsec | 62 nsec | 60 nsec |
| τ(30) | 48 nsec | 56 nsec | 54 nsec |
| τ(31) | 42 nsec | 50 nsec | 48 nsec |
| τ(32) | 34 nsec | 43 nsec | 42 nsec |
| τ(33) | 27 nsec | 36 nsec | 34 nsec |
| τ(34) | 18 nsec | 28 nsec | 27 nsec |
| τ(35) | 9 nsec | 19 nsec | 18 nsec |
| τ(36) | 0 sec | 10 nsec | 9 nsec |
| τ(37) | undriving | 0 sec | 0 sec |

Shown in the first column of Table 3 presented below are the delay times τ(n) which are set for thirty-six piezoelectric elements forming a group, when the elements are juxtaposed at a pitch of 50 μm and driven simultaneously by drive signals having a frequency of 100 MHz, and the focal length of the ultrasonic beam emitted from the elements of each group emitted is 3 mm (namely, the thickness of the ink layer is 3 mm.).In this case, the minimum unit of delay time, i.e., a quantized delay time, is 1 nsec. When the thirty-six elements are driven with these time delays, an ink droplet will fly from point A (FIG. 47). With the conventional electronic focusing method it is comparatively easy to change the focal point where ultrasonic beams converge. Hence, to squirt an ink droplet from point B (FIG. 47) spaced from point A (FIG. 47) by half the pitch of the piezoelectric elements, it suffices to drive thirty-seven elements with the delay times calculated by Equation (3) and shown in the second column of Table 3. As is apparent from Table 3, the pattern of delaying the drive signals for the thirty-seven elements is quite different from the pattern of delaying the drive signals for the thirty-six elements.

In the electronic focusing method according to Embodiment 5-2, the drive signals for the thirty-seven elements are delayed in the pattern specified in the third column of Table 3. More precisely, the delay times for the first 18 elements are respectively identical to the delay times for the first 18 of the thirty-six elements, the delay time for the 19th element is the same as the delay time for the 18th of the thirty-six elements, and the delay times for the 20th to 37th elements are respectively identical to the remaining 18 of the thirty-six elements. When the thirty-seven piezoelectric elements are driven with the time delays shown in the third column of Table 3, an ink droplet will fly from point B on the ink surface, which is located right above the 19th element, i.e., the midpoint of the 37-element group.

Thus, the electronic focusing method according to Embodiment 5-2 can set the delay times for the thirty-seven elements, using only about half the amount of data required in the conventional electronic focusing method. In this respect the method of driving the piezoelectric element array, according to Embodiment 5-2, is advantageous over the conventional electronic focusing method.

As described above, both Embodiment 5-1 and Embodiment 5-2 can squirt ink droplets in paths perpendicular to the ink surface, at half the pitch at which the piezoelectric elements are juxtaposed in the main-scanning direction. Therefore, Embodiments 5-1 and 5-2 can record images which have a resolution twice as high as is possible with the conventional ink-jet recording device which performs linear electronic scanning. In addition, Embodiments 5-1 and 5-2 need only to have an element-driving circuit which is more simple in structure than its equivalent incorporated in the conventional ink-jet recording device.

Embodiment 5-3

An ink-jet recording device according to Embodiment 5-3 of the present invention has a recording head section which is similar in structure to the recording head section (FIG. 46) of Embodiment 5-1.

Figure 49:
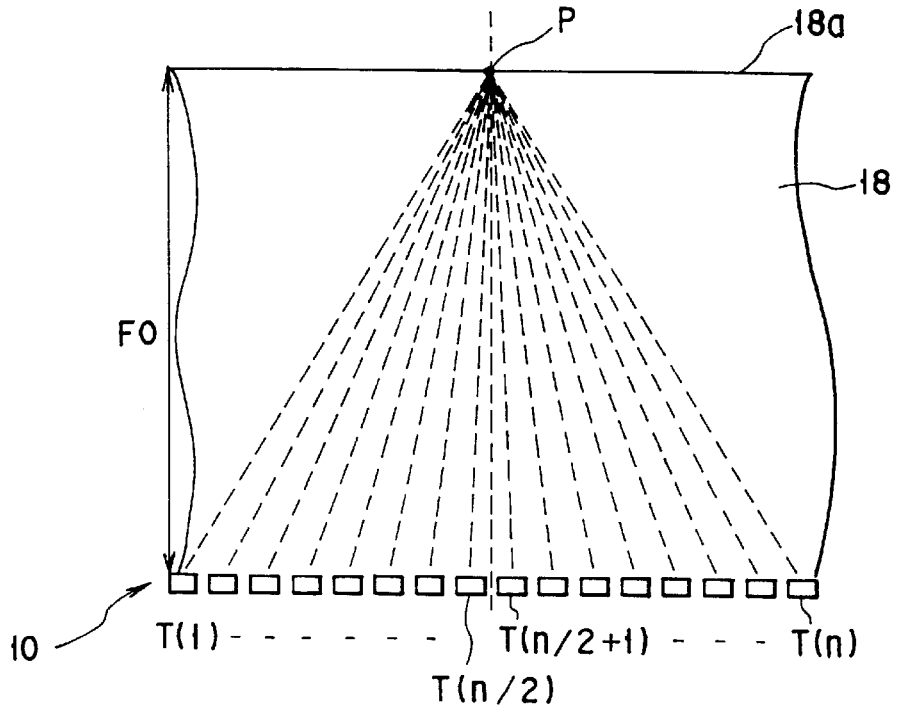
FIG. 49 is a diagram explaining a method of driving the piezoelectric element array used in Embodiment 5-3, in the first drive mode.

It differs in the way the drive circuit 21 drives the piezoelectric element array 10. In the array-driving method, the piezoelectric elements can be driven in either a first mode or a second mode. The first mode and the second mode will be explained, with reference to FIG. 49 and FIG. 50. In the first mode, delay times are set for n piezoelectric elements T(1) to T(n) forming a group, such that the ultrasonic beams emitted from the elements match in phase at point P0 where the vertical line extending from the midpoint of the group formed by the elements T(1) to T(n) intersects with the surface of liquid ink 18 as shown in FIG. 49. When the circuit 21 drives the elements T(1) to T(n) in the first mode, an ink droplet will fly from point P0. When the circuit 21 drives the elements T(2) to T(n+1) in the first mode, an ink droplet will fly from a point spaced from point P0 by the pitch of the piezoelectric elements; when the circuit 21 drives the elements T(3) to T(n+2) in the first mode, an ink droplet will fly from a point spaced from point P0 by a two-pitch distance; and so forth. As a result, the recording head section will squirt ink droplets, one after another, onto a recording medium, forming a line thereon.

Figure 50:
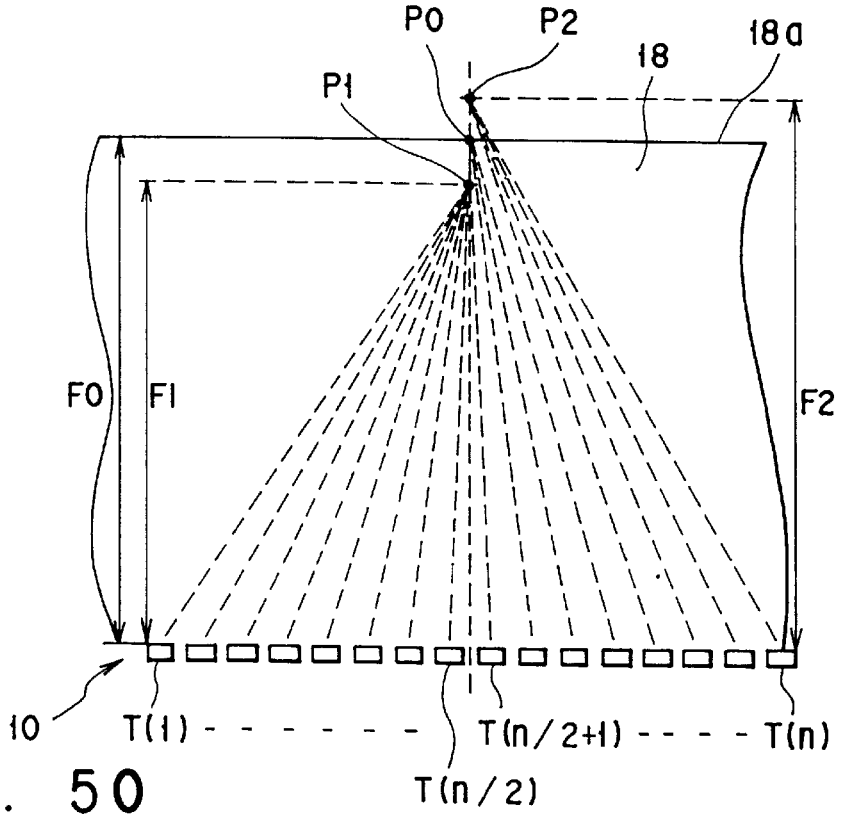
FIG. 50 is a diagram explaining a method of driving the piezoelectric element array used in Embodiment 5-3, in the second drive mode.

In the second mode, delay times are set for n piezoelectric elements T(1) to T(n) forming a group, such that the ultrasonic beams emitted from the first n/2 elements, i.e., the elements T(1) to T(n/2), match in phase at point P1 which is located right above the midpoint of the group and below the surface of the ink 18, as illustrated in FIG. 50, and that the remaining n/2 elements, i.e., the elements T(n/2+1) to T(n), match in phase at point P2 which is located right above the middle element T(n/2+1) and above the surface of the ink 18, as illustrated in FIG. 50. As a result, an ink droplet will fly from a point other than point P0 from which an ink droplet flies as shown in FIG. 49 when the drive circuit 21 drives the piezoelectric element array 10 in the first mode.

A piezoelectric element array according to Embodiment 5-3 was made and actually driven by the method explained with reference to FIG. 49 and FIG. 50.

More specifically, thirty-four piezoelectric elements forming a group were driven simultaneously by drive signals having a frequency of 7.5 MHz. (The ultrasonic beam each element emits had a wavelength of 0.2 mm in the liquid ink 18.) The thickness of the ink layer was 10 mm. The piezoelectric elements were juxtaposed at a pitch of 190 $\mu$m.

The delay time for each of the ultrasonic beams emitted from the thirty-four piezoelectric elements forming the group was set at one of two values based on Fresnel diffraction theory. More specifically, in the first mode, the focal length was set at 10 mm (hereinafter referred to as "reference focal point") so that the ultrasonic beams emitted from all elements of the group may match in phase at a point in the surface of the link 18, which is located right above the midpoint of the group. In the second mode, a focal length of 9 mm, 1 mm shorter than the reference focal length, was set for the first to 17th piezoelectric elements, and a focal length of 11 mm, 1 mm longer than the reference focal length, was set for the 18th to 34th elements. In order to set a delay time to control the phase of the ultrasonic beam emitted from each element, the radius of Fresnel zone ring was determined by Equation (4) or (5):

$$r(n) = \left\{\frac{(2n-1)\lambda i}{2} \times \left(F + \frac{(2n-1)\lambda i}{8}\right)\right\}^{1/2} \quad (4)$$

$$(n = 0, 1, 2, \ldots)$$

$$r(n) = (n\lambda i F)^{1/2} (n = 0, 1, 2, \ldots) \quad (5)$$

where n is an integer equal to or greater than 0, $\lambda i$ is the wavelength of the ultrasonic beam traveling through the ink 18, and F is the focal length. Table 4 presented below shows the radii r(n) (n=0 to 7) of Fresnel zone rings, thus determined, for the focal length of 9 mm, the focal length of 10 mm and the focal length of 11 mm.

TABLE 4

| | F = 9 mm (F1) | F = 10 mm (F0) | F = 11 mm (F2) |
|---|---|---|---|
| r(0) | 0 mm | 0 mm | 0 mm |
| r(1) | 0.950 mm | 1.001 mm | 1.050 mm |
| r(2) | 1.650 mm | 1.739 mm | 1.823 mm |
| r(3) | 2.136 mm | 2.250 mm | 2.359 mm |
| r(4) | 2.534 mm | 2.669 mm | 2.797 mm |
| r(5) | 2.881 mm | 3.034 mm | 3.178 mm |
| r(6) | 3.194 mm | 3.362 mm | 3.522 mm |
| r(7) | 3.482 mm | 3.664 mm | 3.837 mm |

Next, the delay time for the ultrasonic beam emitted from each piezoelectric element was set at such value that the beams emitted from the elements at a distance D greater than r(2n) and less than r(2n+1) were out of phase by $\pi$ with respect to the beams emitted from the elements at a distance D greater than r(2n+1) and less than r(2n+3), where D is the distance between each piezoelectric element and the midpoint of the cement group. To be more precise, a delay time of 67 nsec, which is half the one-cycle period of the drive signals, was set for the elements located at a distance D greater than r(2n) and less than r(2n+1), and a delay time of 0 nsec was set for the elements located at a distance D greater than r(2n+1) and less than r(2n+3). Instead, the delay time of 67 nsec may be set for the elements located at a distance D greater than r(2n+1) and less than r(2n+3), which the delay time of 0 nsec for the elements located at a distance D greater than r(2n) and less than r(2n+1). The delay time may be multiplied an odd number times, in which case, too, the beams emitted from the elements at a distance D greater than r(2n) and less than r(2n+1) can be out of phase by $\pi$ with respect to the beams emitted from the elements at a distance D greater than r(2n+1) and less than r(2n+3). Further, since it suffices to set only two alternative phases for the ultrasonic beam emitted from each piezoelectric element, the phase of the beam can be shifted by driving the piezoelectric elements with a drive signal voltage inverted in phase. If this is the case, the delay circuit may be replaced by a simple changeover switch, rendering the drive circuit relatively simple and inexpensive.

The delay times $\tau(n)$ (n=1 to 34), thus set, were as shown in Table 5 presented below. More precisely, the values the delay times $\tau$(1) to $\tau$(34) assume for the first mode are shown in the first column of Table 5, whereas the values the delay times assume for the second mode are shown in the second column of Table 5. As can be seen from Table 5, the delay times $\tau$(1) to $\tau$(17) are not exactly identical to the delay times $\tau$(34) to $\tau$(18), respectively.

TABLE 5

| | First Driving Mode Focal Length of all Elements: 10 mm | Second Driving Mode Focal Length of first to 17th Elements: 9 Focal Length of 18th to 34th Elements: 11 mm |
|---|---|---|
| τ(1) | 67 nsec | 67 nsec |
| τ(2) | 0 sec | 67 nsec |
| τ(3) | 0 sec | 0 sec |
| τ(4) | 67 nsec | 0 sec |
| τ(5) | 67 nsec | 67 nsec |
| τ(6) | 0 sec | 67 nsec |
| τ(7) | 0 sec | 0 sec |
| τ(8) | 0 sec | 0 sec |
| τ(9) | 67 nsec | 67 nsec |
| τ(10) | 67 nsec | 67 nsec |
| τ(11) | 67 nsec | 67 nsec |
| τ(12) | 67 nsec | 67 nsec |
| τ(13) | 0 sec | 0 sec |
| τ(14) | 0 sec | 0 sec |
| τ(15) | 0 sec | 0 sec |
| τ(16) | 0 sec | 0 sec |
| τ(17) | 0 sec | 0 sec |
| τ(18) | 0 sec | 0 sec |
| τ(19) | 0 sec | 0 sec |
| τ(20) | 0 sec | 0 sec |
| τ(21) | 0 sec | 0 sec |
| τ(22) | 0 sec | 0 sec |
| τ(23) | 67 nsec | 0 sec |
| τ(24) | 67 nsec | 67 nsec |
| τ(25) | 67 nsec | 67 nsec |
| τ(26) | 67 nsec | 67 nsec |
| τ(27) | 0 sec | 67 nsec |
| τ(28) | 0 sec | 0 sec |
| τ(29) | 0 sec | 0 sec |
| τ(30) | 67 nsec | 67 nsec |
| τ(31) | 67 nsec | 67 nsec |
| τ(32) | 0 sec | 67 sec |
| τ(33) | 0 sec | 0 sec |
| τ(34) | 67 nsec | 0 sec |

Figure 51:
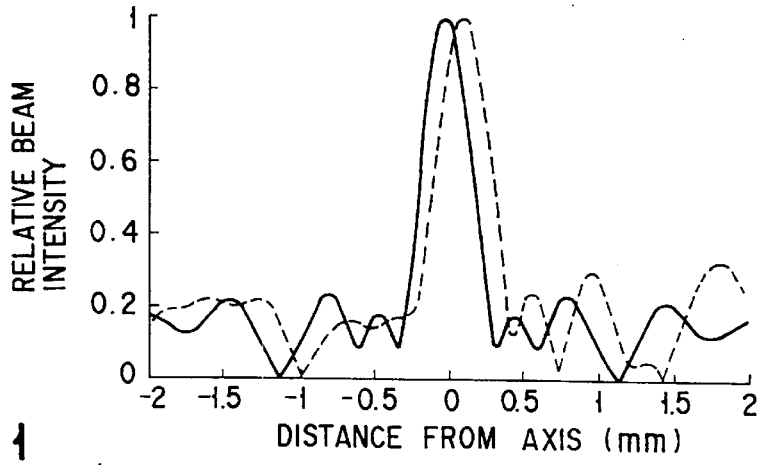
FIG. 51 is a diagram representing the acoustic distribution on the ink surface, observed in Embodiment 5-3.

FIG. 51 is a diagram representing the acoustic distribution which was observed on the ink surface when the thirty-four piezoelectric elements were driven in the first mode, and also the acoustic distribution which was observed on the ink surface when the piezoelectric elements were driven in the second mode. In FIG. 51, plotted on the abscissa is the distance from the midpoint of the group of the elements, and plotted on the ordinate is the relative intensity of the ultrasonic beam emitted from each piezoelectric element. As can be understood from FIG. 51, the main beam was emitted from the midpoint of the elements group when the elements were driven in the first mode, and the main beam was emitted from a point shifted to the right by about 110 μm when the elements were driven in the second mode. The main beam and side lobes emitted from the group of elements when the elements were driven in the second mode did differ in intensity, but slightly, from the main beam and side robes emitted when the elements were driven in the first mode. When the elements were driven in the first mode, a ink droplet flew from the ink surface 18*a*, at a point located right above the midpoint of the element group. When the elements were driven in the second mode, a ink droplet flew from the ink surface 18*a*, at a point shifted to the right by about 110 μm and located at the focal length longer than the reference focal length of 10 mm. The position where the ink droplet flies can be changed by altering the ratio of the difference between the focal distances for the first 17 elements and the remaining 17 elements to the thickness of the ink layer.

Figure 52:
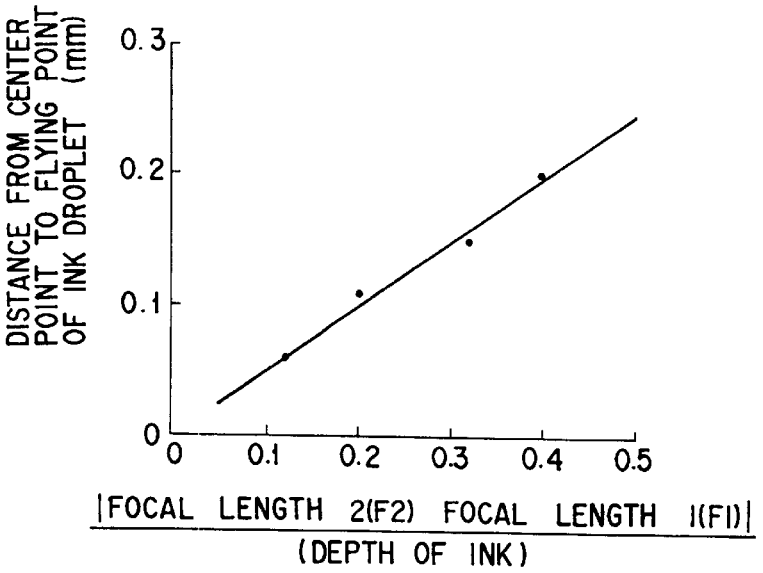
FIG. 52 is a diagram illustrating how the flying ink-droplets change their position when the piezoelectric element array of Embodiment 5-3 is driven in the second drive mode.

FIG. 52 illustrates how the position at which an ink-droplet flew changed when said ratio of the focal-distance difference to the ink-layer thickness was altered. Needless to say, thirty-four elements juxtaposed at the pitch of 190 μm were simultaneously driven in the second mode, and the layer of the ink 18 was 10 mm thick. The two focal points were above and below the ink surface 18*a*, each at the same distance therefrom.

The ratio of the of the focal-distance difference to the ink-layer thickness is preferably 0.4 or less. If the ratio is greater than 0.4, the ink droplet will fly in a path inclined to the ink surface 18*a*, making it difficult to control the landing position of the droplet on the recording medium, or the ultrasonic beams emitted from the piezoelectric elements will not be converged enough to squirt an ink droplet unless the drive voltage is increased or the number of bursts is increased. To converge the ultrasonic beams sufficiently, it is desirable that the difference between the two focal distances be an even number times the wavelength the beams have while traveling in the liquid ink 18. In Embodiment 5-3, the two focal points are located above and below the ink surface 18*a*, respectively, each at the same distance the ink surface 18*a*. Rather, they may be in the ink surface 18*a*, in which case an ink droplet flies from a point shifted from the point located right above the midpoint of the element group.

Thus, the position where an ink droplet flies can be controlled, regardless of the pitch at which the piezoelectric elements are juxtaposed in the main-scanning direction, merely by adjusting the difference between the focal distances for the first 17 elements and the remaining 17 elements. When the piezoelectric elements are driven in the first mode, Embodiment 5-3 can record a high-resolution image. On the other hand, when the piezoelectric elements are driven in the second mode, Embodiment 5-3 can form ink dots of two sizes on the recording medium, thereby recording a pseudo gray-level image thereon.

It is most desirable that two focal distances be set for exactly the halves of the element group as in Embodiment 5-3. Nevertheless, the focal distances may be set for two groups consisting of different numbers of piezoelectric elements, respectively.

As described above, Embodiment 5-3 can record images at a resolution higher than the value defined by the pitch at which the piezoelectric elements are juxtaposed, and can record a pseudo gray-level image on a recording medium. Furthermore, it requires but a simple circuit for driving the piezoelectric elements. This is because the phases of the ultrasonic beams emitted from the thirty-four piezoelectric elements are controlled based on Fresnel diffraction theory.

Embodiment 6-1

Figure 53:
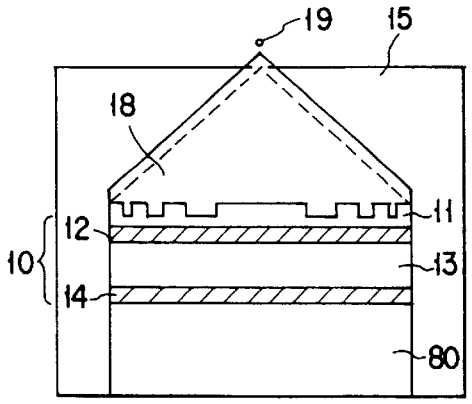
FIG. 53 is a sectional view of the recording head section incorporated in an ink-jet recording device according to Embodiment 6-1 of the present invention.

FIG. 53 is a sectional view of the recording head section incorporated in an ink-jet recording device according to Embodiment 6-1 of the present invention. As FIG. 53 shows, the recording head section comprises a piezoelectric array 10, an acoustic lens 11, an ink reservoir 15, and a backing layer 80. The piezoelectric array 10 is formed of a piezoelectric layer 13, a common electrode 12, and a plurality of discrete electrodes $\mathbf{14}_1$, to $\mathbf{14}_n$ The common electrode 12 is mounted on the upper surface of the layer 13. The discrete electrodes $\mathbf{14}_1$ to $^{14}{}_n$ are mounted on the lower surface of the layer 13, spaced apart one from another. The common electrode 13, the piezoelectric layer 13, the discrete electrodes $\mathbf{14}_1$ to $^{14}{}_n$ constitute a plurality of piezoelectric elements. The piezoelectric elements are juxtaposed in a straight line which extends in the main-scanning direction. The acoustic lens 11 is provided on the upper surface of the common electrode 12. The backing layer 80 is provided on the lower surfaces of the discrete electrode $\mathbf{14}_1$ to $\mathbf{14}_n$. The ink reservoir 15 is placed on the acoustic lens 11. The reservoir 15 has an ink chamber, opening in the top and forming a slit. The ink chamber is filled with liquid ink 18.

The piezoelectric layer 13 is made of ceramics such as lead zirconate titanate (PZT) or lead titanate, semiconductor piezoelectric substance such as ZnO or AlN, or a high-molecular piezoelectric substance such as polyvinylidine fluoride (PVDF) or a copolymer (P(VDF-TrFE)) of polyvinylidine fluoride and ethylene trifluoride. The common electrode 12 and the discrete electrodes $\mathbf{14}_1$ to $\mathbf{14}_n$ are made of Ti, Ni, Al, Cu, Cr, Au or the like, are comprised each a plurality of vapor-deposited metal films, or have been formed by print-coating a film made of glass-flit containing silver paste and then backing the film.

The acoustic lens 11 is made of plastics having a groove formed based on Fresnel diffraction theory. The lens 11 may be a convex lens. The acoustic lens 11 functions to adjust the distribution of acoustic energy in the case where the piezoelectric layer 13 is made of a substance having a higher acoustic impedance than the ink 18, such as lead zirconate titanate (PZT) or ZnO. That is, the lens 11 is made of material whose acoustic impedance is intermediate between those of the layer 13 and the ink 18, so that the ultrasonic beams emitted from the piezoelectric array 10 may be applied to the ink 18 with high efficiency. For the same purpose, the concave portions of the lens 11 have each a thickness which is an integral multiple of $\lambda/4$, where $\lambda$ is the wavelength the ultrasonic beam have while traveling through the liquid ink 18.

The backing layer 80, which is located below the piezoelectric array 10 and characterizes Embodiment 6-1, performs two functions. First, the layer 80 mechanically supports the piezoelectric array 10. Second, the layer 80 prevents the piezoelectric array 10 from vibrating excessively so that the array 10 may no longer vibrate once the supply of the drive voltage has been stopped. To perform the second function the layer 80 needs to be made of material having acoustic impedance of at least $3\times10^6$ kg/m$^2$s. The material may be glass such as quartz or Pyrex, rubber such as ferrite rubber or silicone, resin such as epoxy, ceramics such as alumina, or metal such as copper or aluminum. If made of material whose acoustic impedance is less than $3\times10^6$ kg/m$^2$s, such as porous material, the layer 80 could not prevents the array 10 from vibrating excessively. It is desirable that the layer 80 have acoustic impedance lower than that of the piezoelectric layer 13 so that the ultrasonic beam may not be reflected from the interface between the array 10 and the backing layer 80.

Figure 54:
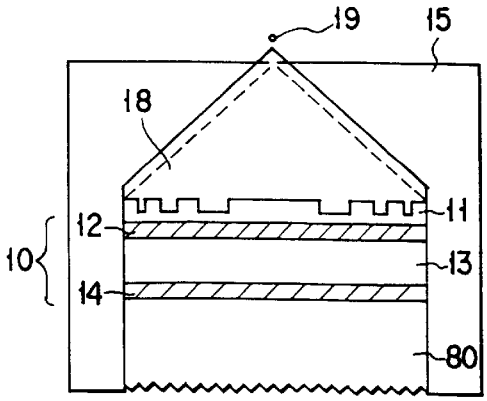
FIG. 54 is a sectional view of a modification of the recording head section shown in FIG. 53.

The backing layer 80 attenuates the ultrasonic beam traveling in it. The beam, if reflected from the lower surface of the layer 80, does not reach the piezoelectric array 10 to affect the vibration of the array 10. The layer 80 can attenuate the beam sufficiently if it is a few millimeters thick and is made of ferrite rubber, whose attenuation coefficient is as large as about 3.8 dB/MHz-mm. If the layer 80 is made of quartz glass or the like, whose attenuation coefficient is as small as about $6.5\times10^{-4}$ dB/MHz-mm, it must be made thick or its lower surface must be roughened as shown in FIG. 54 in the case where the piezoelectric array 10 generates ultrasonic waves having a low frequency of tens of magahertzes.

Figure 55:
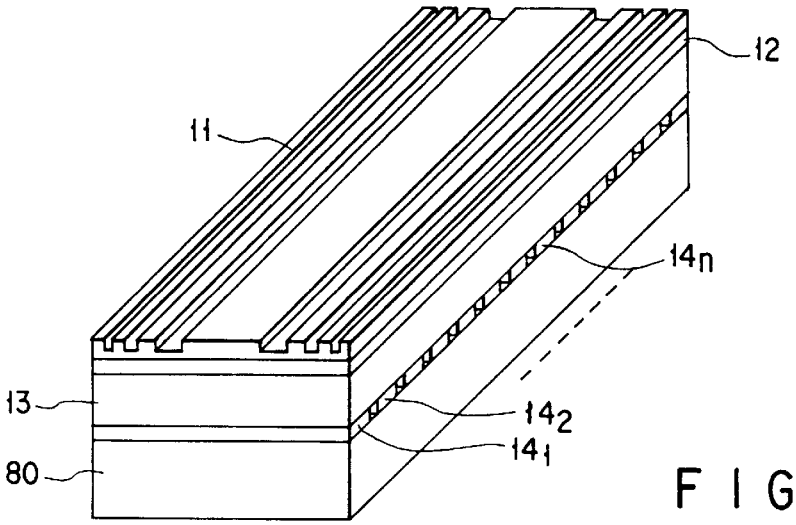
FIG. 55 is a perspective view of the piezoelectric element used in the recording head section incorporated in Embodiment 6-1.

FIG. 55 is a perspective view of the piezoelectric array 10. As shown in FIG. 55, the common electrode 12 is mounted on the upper surface of the piezoelectric layer 13 which is an elongated plate. The discrete electrodes $\mathbf{14}_1$ to $\mathbf{14}_n$ shaped like strips are provided on the lower surface of the piezoelectric layer 13 and juxtaposed, forming an array. Although the piezoelectric layer 13 is not divided into strips, its portions which are mounted on the discrete electrodes $\mathbf{14}_1$ to $\mathbf{14}_n$ can be vibrated when the drive voltage is applied between the common electrode 12 and the discrete electrodes $^{14}{}_1$ to $\mathbf{14}_n$. Needless to say, the piezoelectric layer 13 may divided into discrete strips. To do so, however, two additional manufacturing steps must be carried out, inevitably increasing the manufacturing costs of the array 10. First, parts of the layer 13 must be etched way isotropically to provide discrete piezoelectric strips. Second, the gaps between the strips must be filled with filler such as silicone resin to isolate the strips both electrically and mechanically. If the layer 13 is divided into discrete strips, the piezoelectric element array 10 will convert electric energy to mechanical energy with high efficiency (i.e., electromechanical coupling coefficient). Hence, whether or not the layer 13 should be divided into strips depends upon which is more important, the reduction of manufacturing cost or the increase in the operating efficiency of the array 10.

As indicated above, the backing layer 80 is provided on the lower surfaces of the discrete electrodes $\mathbf{14}_1$ to $^{14}{}_n$, and the acoustic lens 11 on the upper surface of the common electrode 12. The lens 11 is a Fresnel lens consisting of thin straight strips and thick straight strips. The thick strips have different widths and are spaced by different gaps, which are designed on the basis of Fresnel diffraction theory.

In operation, drive signals which differ in phase are simultaneously applied to the discrete electrodes $\mathbf{14}_1$ to $^{14}{}_n$, driving a specific number of adjacent piezoelectric elements. Driven with the drive signals, the piezoelectric elements emit ultrasonic beams to a point in the surface of liquid ink. In other words, the beams are converged in a plane extending along the axis of the array 10 (main-scanning direction). Further, the beams are converged by the acoustic lens 11 in a plane extending in the direction (sub-scanning direction) at right angles to the axis of the piezoelectric element array 10. As a result, the ultrasonic beams are converged to a point in the ink surface. The beams thus converged applies a pressure to the ink 18, developing an ink meniscus. Eventually, an ink droplet 19 flies from that point in the ink surface. An ink droplet 19 can be squirted from a different point in the ink surface by simultaneously driving a different combination of adjacent piezoelectric elements.

Embodiment 6-2

Figure 56:
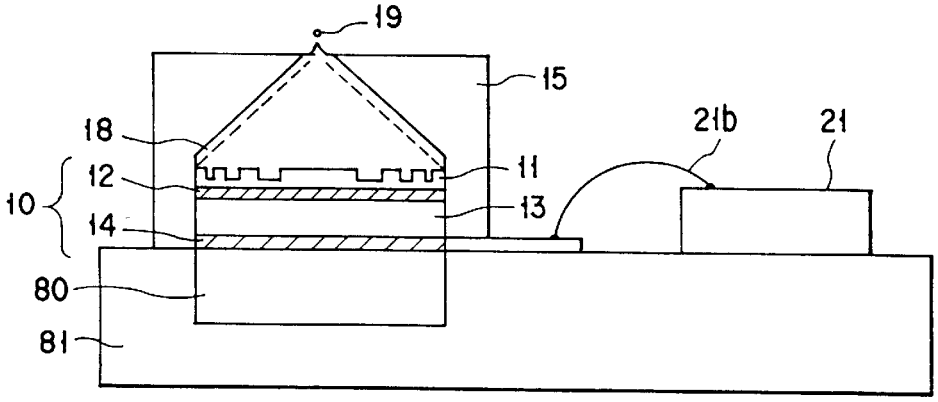
FIG. 56 is a sectional view of the recording head section incorporated in an ink-jet recording device according to Embodiment 6-2 of the invention.
Figure 57:
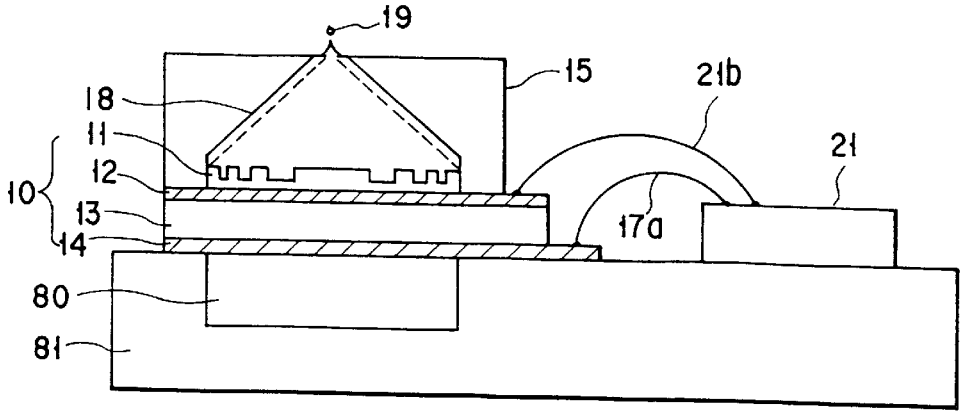
FIG. 57 is a sectional view of the recording head section incorporated in an ink-jet recording device according to Embodiment 6-3 of the invention.

FIG. 56 is a sectional view of the recording head section incorporated in an ink-jet recording device according to Embodiment 6-2 of the invention. The recording head section is mounted on the same substrate as the drive IC 21. It comprises a piezoelectric element array 10 and a backing layer 80. The layer 80 is fitted in a recess made in the upper surface of the substrate and located flush with the upper surface of the substrate. The array 10 comprises a common electrode 12, a piezoelectric layer 13 and discrete electrodes 14. The discrete electrodes 14 are provided partly on the backing layer 80 and partly on the upper surface of the substrate. The electrodes 14 therefore have no stepped portions. Each discrete electrode 14 can easily be connected to the drive IC 21 by a metal wire 21*b*. The common electrode 12 can be connected at any desired portion to the drive IC 21. The common electrode 12 may be divided into discrete ones, forming an electrode array. If this is the case, the discrete electrode 12 are made longer as shown in FIG. 57 and connected to the drive IC 21 by metal wires 21*b*, while the discrete electrodes 14 are connected to the drive IC 21 by metal wires 17*b*.

Embodiment 6-3

Figure 58:
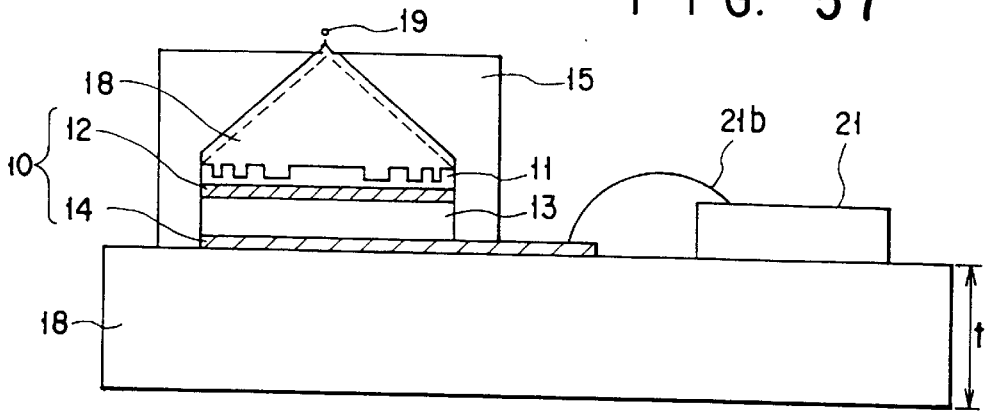
FIG. 58 is a sectional view of the recording head section incorporated in an ink-jet recording device according to Embodiment 6-4 of the invention.

FIG. 58 is a sectional view of the recording head section incorporated in an ink-jet recording device according to Embodiment 6-3 of the invention. This recording head section is characterized by a backing layer 80*a*. Made of material such as alumina or epoxy resin, the layer 80*a* has sufficient mechanical strength and large dielectric constant, so that it can serve as a wiring substrate as well. Thus, not only the piezoelectric element array 10, but also the drive IC 21 is directly mounted on the backing layer 80*a*.

It is required that the following relationship be satisfied:

$$a\times2t\times f<-20\ dB$$

where a is the attenuation coefficient of ultrasonic waves in the layer 80*a*, t is the thickness of the layer 80*a*, and f is the frequency of the ultrasonic waves. The value of 2×2t×f should be less than −60 dB for a ultrasonic probe for medical use. By contrast, the requirements for an ink-jet head is not so severe. However, the frequency f is far higher than in the medical ultrasonic probe, and appropriate values must be selected for the attenuation coefficient a and the thickness t of the layer 80*a*. The backing layer 80*a* should therefore be made of proper material and have an appropriate thickness, in order to satisfy the relationship of a×2t×f<−20 dB.

Provided at the back of the piezoelectric element array 10, the backing layer 80*a* serves to efficiently converge the ultrasonic beams emitted from the array 10 at a point in the ink surface and to control the path of a flying ink droplet 19.

Embodiment 7

Figure 59:
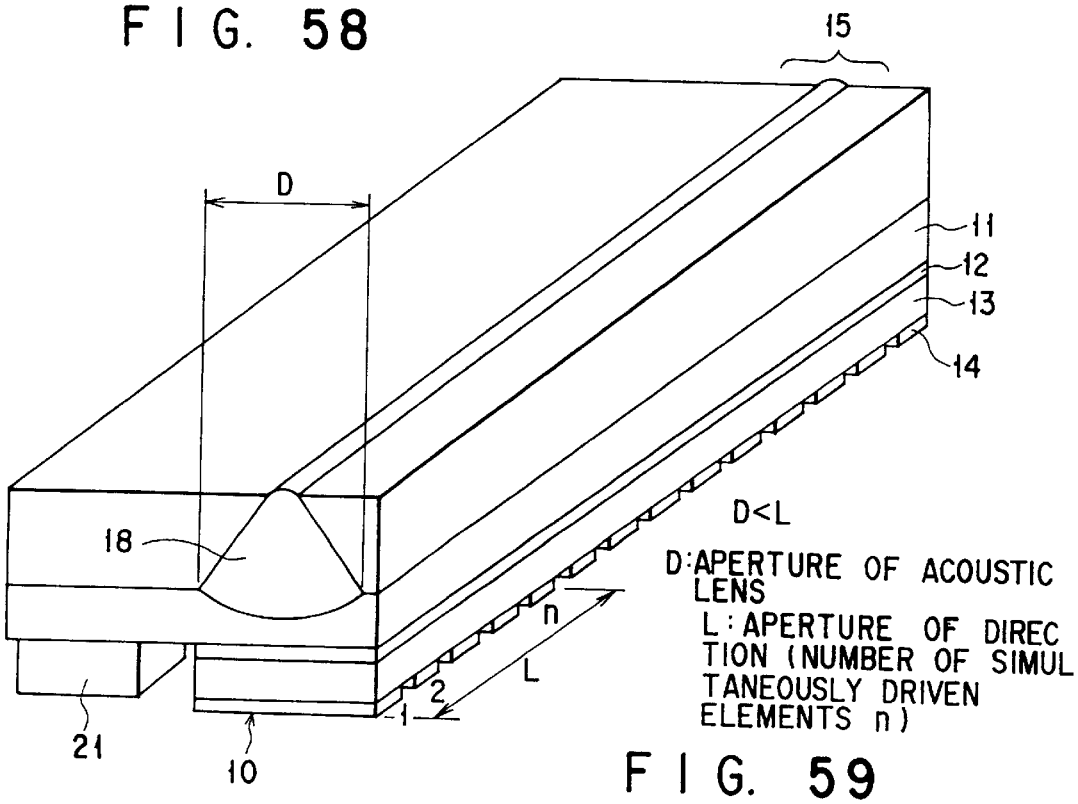
FIG. 59 is a perspective view of the recording head section provided in an ink-jet recording device according to Embodiment 7 of the present invention.

FIG. 59 is a perspective view of the recording head section provided in an ink-jet recording device according to Embodiment 7 of the present invention. The recording head section is similar in structure to the recording head section (FIG. 46) of Embodiment 5-1. It differs only in that the acoustic lens 11 has a width D less than the length L of a group of piezoelectric elements which are driven at the same time.

One of the parameters that determine the size of an ink droplet which the recording head section squirts is the frequency of the ultrasonic beams the piezoelectric elements emit. The frequency of the beams is inversely proportional to the thickness of the piezoelectric layer 13, because the piezoelectric element array 10 emits ultrasonic beams by virtue of resonance which develops vertically in the piezoelectric layer 13. Namely, the thinner the layer 12, the higher the beam frequency. Further, the higher the beam frequency, the higher the resolution of an image the head section can record. The piezoelectric layer 13 should, therefore, be made of such a material in such a method that it may be as thin as is possible.

Material for the piezoelectric layer 13 is selected in accordance with not only its desired thickness, but also its electromechanical coupling coefficient (i.e., efficiency of converting electric energy to mechanical energy) and its dielectric coefficient influencing the electrical matching between the layer 13 and the drive IC. Desired material is ceramics much as lead zirconate titanate (PZT), a copolymer of polyvinylidine fluoride and ethylene trifluoride, single crystal such as lithium niobate, or a semiconductor piezoelectric substance such as zinc oxide (ZnO), or a high-molecular piezoelectric substance such a copolymer (P(VDF-TrFE)) of polyvinylidine fluoride and ethylene trifluoride. To be more specific, the layer 13 should be made of PZT for an ink-jet printer which records images of resolution of 600 dpi or less, and made of ZnO for an ink-jet printer which records images of resolution higher than 600 dpi. In the case where the layer 13 is prepared by polishing a bulk of PZT or the like, an adhesion layer is interposed between the acoustic lens 11 and the common electrode 12. The recording head section (FIG. 46) of Embodiment 5-1 does not have such an adhesion layer.

The common electrode 12 and the discrete electrodes 14 are made of Ti, Ni, Al, Cu, Cr, Au or the like, are comprised each a plurality of metal films formed by either vapor deposition or sputtering, or have been formed by print-coating a film made of silver paste containing glass flits and then by backing the film. The acoustic lens 11 is made of glass, resin or the like. If a layer of PZT or the like is bonded to the acoustic lens 11 by an adhesive, the lens 11 must be made of material which is easy to process, and the piezoelectric layer 13 must be made of material which achieves acoustic matching with the ink 18. If a layer of ZnO or the like is formed by sputtering, the lens 11 must be made of materials which not only is easy to process but also can withstand the sputtering temperature, and the piezoelectric layer 13 must be made of material which not only achieves acoustic matching with the ink 18 but also is easy to orient its grains.

In Embodiment 7, the driving IC 21 sequentially performs the linear electronic scanning by driving the piezoelectric element array 10 with unit block of which a single block consists of piezoelectric element group having n piezoelectric elements adjacent in the array direction (extending direction of piezoelectric elements, or main -scanning direction) according to the image data to be recorded.

In operation, the drive circuit 21 drives the piezoelectric element array 10 in accordance with the input image data, thereby performing liner electronic scanning. To be more specific, the circuit 17 simultaneously drives the first to n-th piezoelectric elements with high-frequency drive signals which differ in phase, as is illustrated in FIG. 60. Next, the circuit 17 simultaneously drives the second to (n+1)th piezoelectric elements with high-frequency drive signals which differ in phase. Then, the circuit 17 simultaneously drives the third to (n+2)th piezoelectric elements with high-frequency drive signals which differ in phase, and so forth. As a result, the point at which the ultrasonic beams emitted from the piezoelectric elements converge linearly moves in the main scanning direction. The drive signals are either rectangular bursts as shown in FIG. 61 or sine-wave bursts. As described above, the drive signals have differ in phase. This means that the signals have leading edges at different times. A piezoelectric element array 10 according to Embodiment 7 (FIG. 46) was made. More precisely, a piezoelectric layer 13 was prepared, which had a thickness of 100 $\mu$m, made of PZT-based ceramic having a dielectric coefficient of 2000 and a resonance frequency of 20 MHz. Two electrodes were formed by sputtering on the surfaces of the piezoelectric layer 13, respectively. Each electrode was comprises of three metal layers formed one on another, i.e., an Ti layer having a thickness of 0.05 $\mu$m, an Ni layer having a thickness of 0.05 $\mu$m and an Au layer having a thickness of 0.2 $\mu$m. An electric field of 2 kv/mm was applied to the electrodes, thereby polarizing the electrodes. Thereafter, the electrode on one surface of the piezoelectric layer 13 was divided by etching, into discrete electrodes 14. The discrete electrodes 14 had a width of 120 $\mu$m, with gaps of 30 $\mu$m among them. The discrete electrodes 14 were juxtaposed at the pitch of 150 $\mu$m. The piezoelectric element array 10 thus made comprised the piezoelectric layer 13, a common electrode 12 provided on one surface of the layer 13, and discrete electrodes 14 provided on the opposite surface of the layer 13.

An acoustic lens 11 was made of a Pyrex glass plate having a thickness of 2 mm. The lens 11 had a straight groove having a width of 1.5 mm and a concave bottom. The curvature of the concave bottom was 2.3 mm. The acoustic lens 11 and the piezoelectric element array 10 were adhered together by an epoxy-resin adhesive, with the common electrode 12 set in axial alignment with the straight groove of the lens 11. Then, an ink reservoir 15 and a drive circuit 71 were mounted on the upper and lower surfaces of the acoustic lens 11, respectively. An ink-jet head was thereby manufactured. The ink reservoir 15 had a depth of 3 mm and was filled with liquid ink 18. The surface of the ink 18 was 5 mm above the common electrode 12 of the array 10. The acoustic lens 11 satisfied the relationship of $t<D1/\lambda$, where t is the thickness (2 mm) of the lens 11, D is the width (1.5 mm) of the groove and $\lambda$ is the wavelength of the ultrasonic waves traveling through the lens 11.

The ink-jet head was driven repeatedly, each time by driving a different number n of piezoelectric elements simultaneously, thereby squirting an ink droplet onto a recording medium. The numbers n were 10 (10 elements driven simultaneously forming a group extending 1.5 mm in the main scanning direction) and 24 (24 elements driven simultaneously forming a group extending 3.6 mm in the main scanning direction). The ultrasonic beam pattern formed at the same distance as the ink surface were examined. A −10 dB beam had a width of 0.33 mm at that position in the sound field which is central in the sub-scanning direction. When n=24, the resultant beam had a width of 0.34 mm, almost equal to the width of the −10 dB beam. When n=10, the resultant beam had a width of 0.76 mm, much greater than the width of the −10 dB beam. When various combinations of elements, each consisting of 16 elements (n=16), were sequentially driven, ink droplets having a size of about 80 $\mu$m flew from the ink surface, forming circular dots on the recording medium in the density of about 200 dpi. When various combinations of elements, each consisting of 10 elements (n=10), were driven with a drive voltage about 1.3 times higher, ink droplets shaped like a rugby ball flew from the ink surface, forming elliptical dots on the recording medium in the density of about 130 dpi.

The acoustic lens 11 which is of the type shown in FIG. 46 may be replaced by a Fresnel lens of the type shown in FIG. 62, which has straight grooves made in the upper surface and located at specific positions. The distance r(n) of each groove from the center of the lens and the depth d of each groove are given as follows:

$$ri = \left\{\left(\frac{i \times \lambda w}{2}\right) \times \left(F + \frac{i \times \lambda w}{8}\right)\right\}^{1/2} \quad (6)$$

($i$: natural number)

$$d = \frac{1}{2 \times \left(\frac{1}{\lambda w} - \frac{1}{\lambda 1}\right)}$$

where λw is the wavelength the ultrasonic beams have while traveling through the ink, F is the focal length, and λl is the wavelength the ultrasonic beams have while traveling through the lens 11.

As shown in FIG. 46 and FIG. 62, the acoustic lens 11 functions as a support for the piezoelectric layer 13. Instead, as shown in FIG. 63, an acoustic matching layer 11' may be interposed between the lens 11 and the common electrode 12, to support the piezoelectric layer 13.

As described above, the ink-jet head according to Embodiment 7 can effectively perform line scanning, due to the use of an piezoelectric element array and an acoustic lens. The acoustic lens 11 extends in the sub-scanning direction for a distance shorter than the group of simultaneously driven elements extends in the main-scanning direction. Ink droplets can, therefore, fly efficiently, forming a high-resolution image on a recording medium.

Embodiment 8-1

Figure 65:
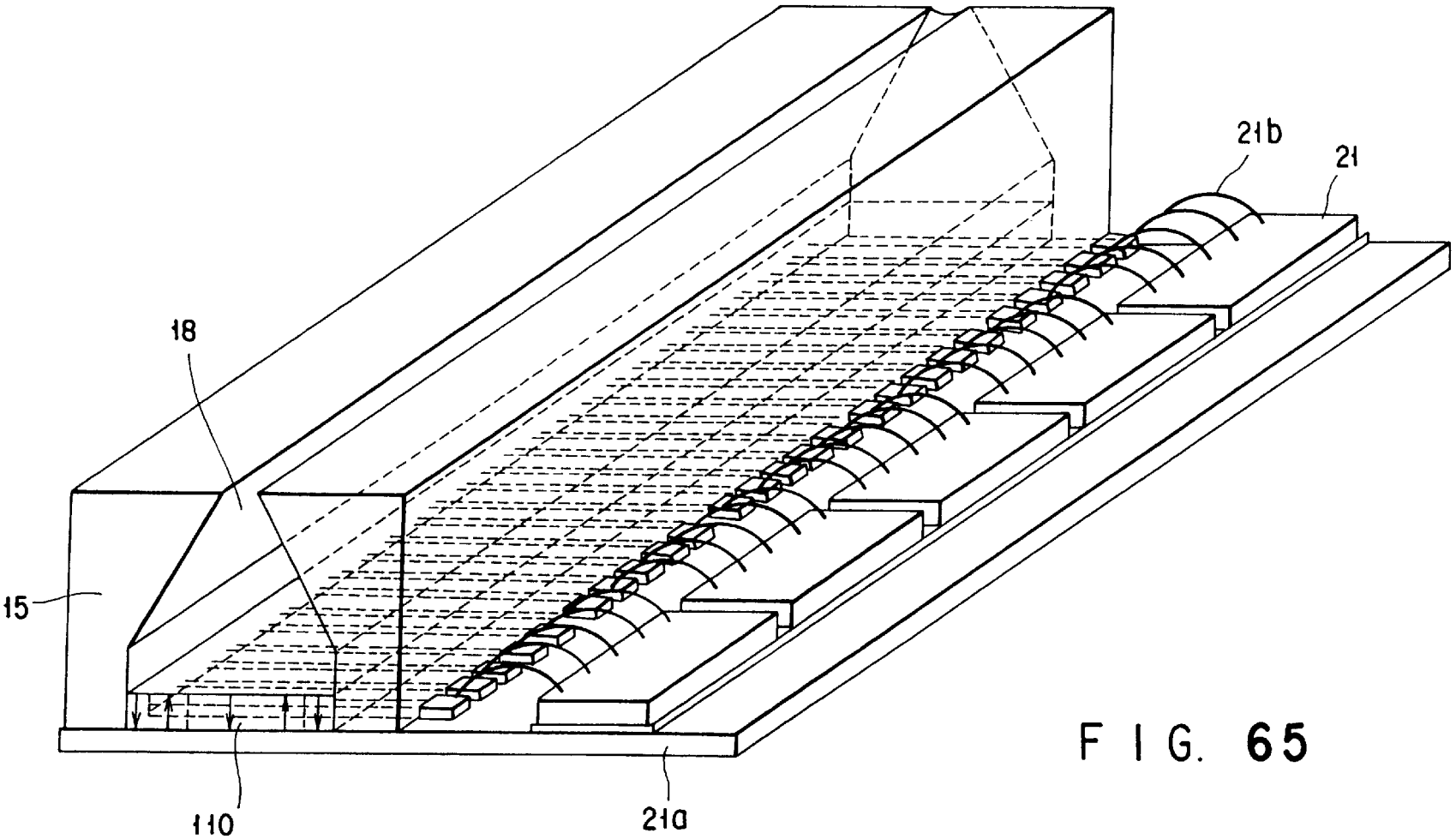
FIG. 65 is a perspective view of the recording section incorporated in an ink-jet recording device according to Embodiment 8-1 of the present invention.

FIG. 65 is a perspective view of the recording section incorporated in an ink-jet recording device according to Embodiment 8-1 of the present invention. Embodiment 8-1 is characterized by discrete electrodes 14 which are concentric annular members located near the ink reservoir. Except for this feature, Embodiment 8-1 is identical to any other embodiment described above. The arrows shown in FIG. 65 indicate the directions in which piezoelectric elements are polarized.

Figure 66A:
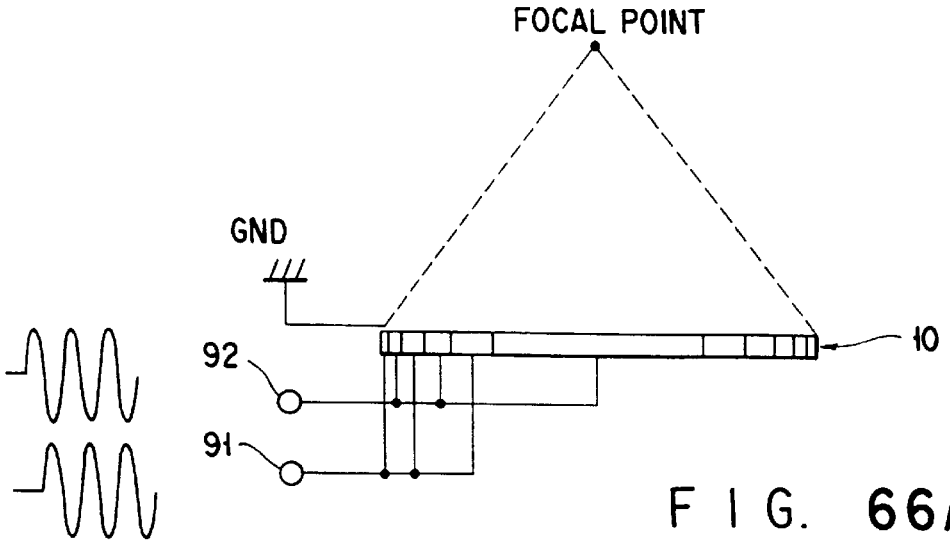
FIGS. 66A and 66B are diagrams showing the main components of the recording head section of Embodiment 8-1.
Figure 66B:
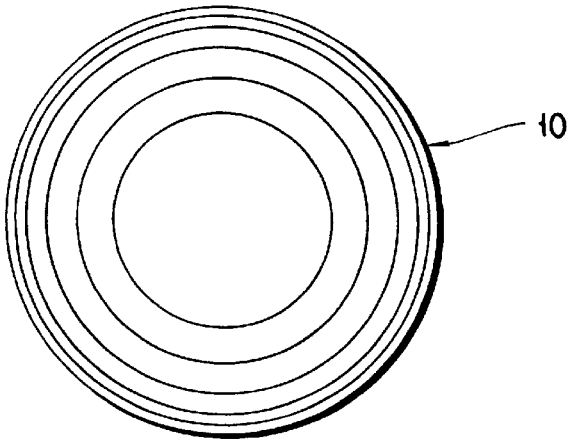

FIGS. 66A and 66B are diagrams showing a piezoelectric element 10 incorporated in recording head section. Although shaped like a thin disc, the element 10 can emit a converged ultrasonic beam. The piezoelectric element 10 comprises a plurality of concentric annular members. Of these annular members, the odd-numbered ones form a first group, and the even-numbered ones form a second group. Two drive voltages in different phases are applied to the first group and the second group, respectively, through terminals 91 and 92. To be more specific, a 0-phase drive voltage is applied to the terminal 91, and a π-phase drive voltage to the terminal 92.

Figure 67:
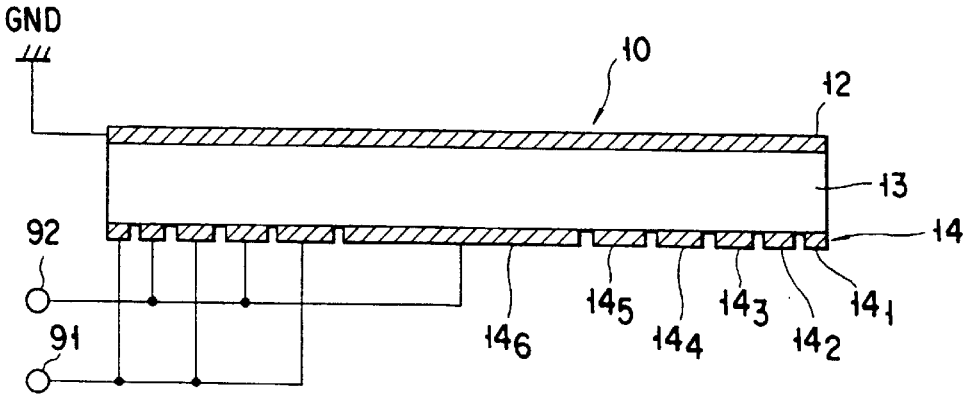
FIG. 67 is a sectional view of the piezoelectric element used in Embodiment 8-1.

FIG. 67 is a sectional view showing the piezoelectric element 10 in detail. As FIG. 67 shows, the element 10 comprises a piezoelectric disc 13, a common electrode 12 mounted on one surface of the disc 13, and concentric annular discrete electrodes 14 provided on the other surface of the disc 13.

Figure 68:
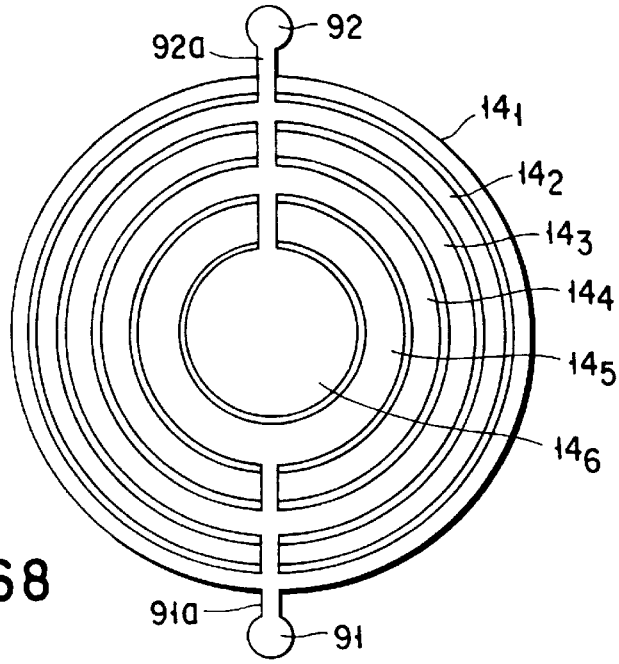
FIG. 68 is a plan view showing the electrodes provided on the piezoelectric element shown in FIG. 67.

FIG. 68 is a plan view illustrating the discrete electrodes 14. As shown in FIG. 68, the odd-numbered electrodes $\mathbf{14}_1$, $\mathbf{14}_3$ and $\mathbf{14}_5$ form a first group, while the even-numbered electrodes $\mathbf{14}_2$, $\mathbf{14}_4$ and $\mathbf{14}_6$ form a second group. The discrete electrodes of the first group are connected by a conductor 91*a*, which is connected to the terminal 91. Similarly, the discrete electrodes of the second group are connected by a conductor 92*a*, which is connected to the terminal 92.

A drive circuit (not shown) applies two drive voltages, which differ in phase by π as shown in FIG. 66A, to the terminals 91 and 92, respectively. As a result, the piezoelectric element 10 emits a converged ultrasonic beam.

It will be explained how the piezoelectric element 10 is manufactured.

First, the electrode pattern 14 shown in FIG. 68 is formed on a substrate (not shown). The annular elements of the pattern 14 are electrically isolated by angular insulating layers (not shown, either) between the conductor 91A and the electrodes of even number $\mathbf{14}_2$, $\mathbf{14}_4$ and $\mathbf{14}_6$ and between the conductor 92*a* and the electrodes $\mathbf{14}_1$, $\mathbf{14}_3$ and $\mathbf{14}_5$. Then, the piezoelectric disc 13 having a uniform thickness is formed on the electrode pattern 14, covering neither the terminal 91 nor the terminal 92, by means of thing-film forming process such as sputtering. The disc 13 is made of piezoelectric material such as ZnO (zinc oxide), PZT (lead zirconate titanate) or PT (lead titanate). The common electrode 12 is then formed on the piezoelectric disc 13. Next, the disc 13 is uniformly polarized. Thus completes the manufacture of the piezoelectric element 10 (i.e., ink-jet head).

In Embodiment 8-1, only the electrode pattern 14 is Fresnel-divided, forming discrete electrodes $\mathbf{14}_1$ to $\mathbf{14}_6$. The piezoelectric disc 13 may also be divided into concentric annular members, of which the odd-numbered ones form a first group and the even-numbered ones form a second group.

The recording head section of Embodiment 8-1 may have a plurality of ink-jet heads each having a discrete electrode pattern 14 shown in FIG. 68. In this case, a single piezoelectric layer may be provided, covering all discrete electrode patterns 14 and exposing the terminals 91 and 92 which are integral with the patterns 14.

Embodiment 8-2

Figure 69A:
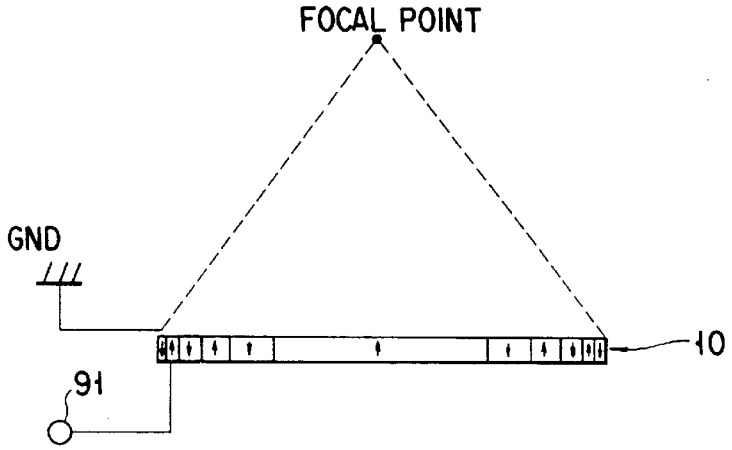
FIGS. 69A and 69B are diagrams showing the recording head section provided in an ink-jet recording device according to Embodiment 8-2 of the invention.
Figure 69B:
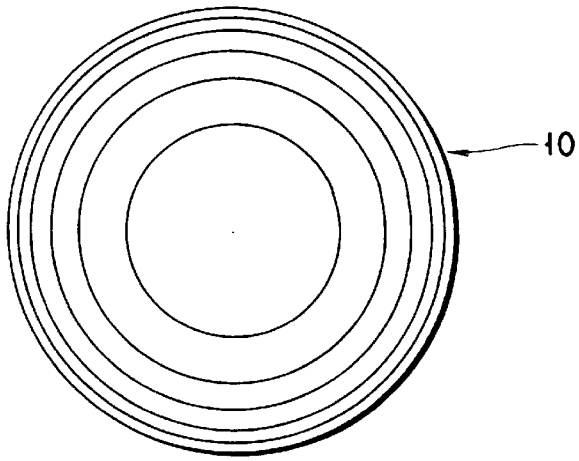

FIGS. 69A and 69B are diagrams showing the recording head section provided in an ink-jet recording device according to Embodiment 8-2 of the invention. Like its counterpart of Embodiment 8-1, the recording head section has a piezoelectric element 10 which is shaped like a thin disc and which can yet emit a converged ultrasonic beam. As shown in FIGS. 69A and 69B, the element 10 is divided into concentric annular regions. Of these annular regions, the odd-numbered ones form a first group, and the even-numbered ones form a second group. The regions of the first group are polarized in one direction, whereas the regions of the second group are polarized in the opposite direction as indicated by arrow. Thus, the ultrasonic beams emitted from the annular regions of the first group are out of phase with respect to the ultrasonic beams emitted from the annular regions of the second group.

Figure 70:
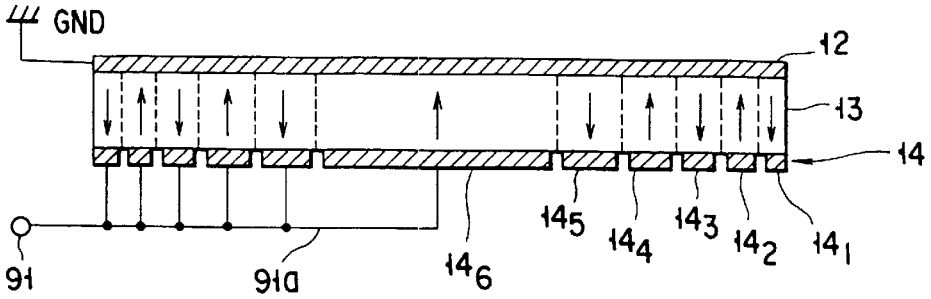
FIG. 70 is a sectional view of the piezoelectric element used in Embodiment 8-2.

FIG. 70 is a sectional view of the piezoelectric element 10 shown in FIGS. 69A and 69B. As illustrated in FIG. 70, the element 10 comprises a piezoelectric disc 13, a common electrode 12 mounted on one surface of the disc 13, and concentric annular discrete electrodes $\mathbf{14}_1$ to $\mathbf{14}_6$ provided on the other surface of the disc 13. As may be understood from in FIG. 68, the discrete electrodes $\mathbf{14}_1$ to $\mathbf{14}_6$ have been formed by Fresnel-dividing a disc-shaped electrode pattern 14. Those annular regions of the disc 13 which contact the odd-numbered electrodes $\mathbf{14}_1$, $\mathbf{14}_3$ and $\mathbf{14}_5$ are polarized downwards, whereas the annular regions of the disc 13 which contact the even-numbered electrodes $\mathbf{14}_2$, $\mathbf{14}_4$ and $\mathbf{14}_6$ are polarized upwards. All discrete electrodes are connected by a conductor 91*a*, which is connected to a terminal 91.

The terminal 91 is connected to a drive circuit (not shown). The drive circuit applies the same drive voltage to the discrete electrodes $\mathbf{14}_1$ to $\mathbf{14}_6$ of the piezoelectric element 10. Nonetheless, the ultrasonic beams emitted from the odd-numbered annular regions of the piezoelectric disc 13 differ in phase by π from the ultrasonic beams emitted from the even-numbered annular regions of the disc 13. This is because, as mentioned above, the odd-numbered annular regions are polarized downwards, whereas the even-numbered annular regions are polarized upwards. Thus, Embodiment 8-2 achieves the same result as Embodiment 8-1. Embodiment 8-2 is more advantageous in that the drive circuit need not generate two drive voltages and can be more simple in structure.

In Embodiment 8-2, only the electrode pattern 14 is Fresnel-divided, forming discrete electrodes $\mathbf{14}_1$ to $\mathbf{14}_6$. The piezoelectric disc 13 may also be divided into concentric annular members, of which the odd-numbered ones form a first group and the even-numbered ones form a second group. Furthermore, the recording head section of Embodiment 8-2 may be modified to have a plurality of ink-jet heads.

It will be explained how the piezoelectric element 10 shown in FIG. 70 is manufactured.

To manufacture the element 10 shown in FIG. 70 it is necessary to apply a high voltage to the odd-numbered annular regions of the piezoelectric disc 13, and to apply a high voltage of the opposite polarity to the even-numbered annular regions of the disc 13. This step of applying high voltages is unnecessary to manufacture the piezoelectric element 10 shown in FIG. 67, since two drive voltages of different phases are applied to the two groups of annular electrodes through the terminals 91 and 92.

It will now be explained how to manufacture the piezoelectric element 10 shown in FIG. 70. First, the odd-numbered annular electrodes $\mathbf{14}_1$, $\mathbf{14}_3$ and $\mathbf{14}_5$ are connected by a conductor (not shown), and the even-numbered annular electrodes $\mathbf{14}_2$, $\mathbf{14}_4$ and $\mathbf{14}_6$ are connected by a conductor (not shown) as FIG. 67 and FIG. 68. The conductors are connected to two terminals, respectively. This done, the common electrode 12 is formed on the piezoelectric disc 13. Next, a DC high voltage of one polarity is applied between the common electrode 12 and the first electrode, thereby polarizing the odd-numbered annular regions of the disc 13. Further, a DC high voltage of the opposite polarity is applied between the common electrode 12 and the second electrode, thereby polarizing the even-numbered annular regions of the disc 13. Now that the annular regions of the disc 13 of two groups have been polarized, the first and second terminals are connected together to the terminal 91.

The piezoelectric element 10 may be manufactured in another method. First, a disc-shaped electrode is be formed on the lower surface of the piezoelectric disc 13. Then, concentric annular electrodes are formed on the upper surface of the disk 13. Next, the odd-numbered annular electrodes are polarized in one direction, and the even-numbered annular electrodes are polarized in the opposite direction. This done, a disc-shaped common electrode is formed on the annular electrodes, by means of sputtering or the like.

Embodiment 8-3

Figure 71:
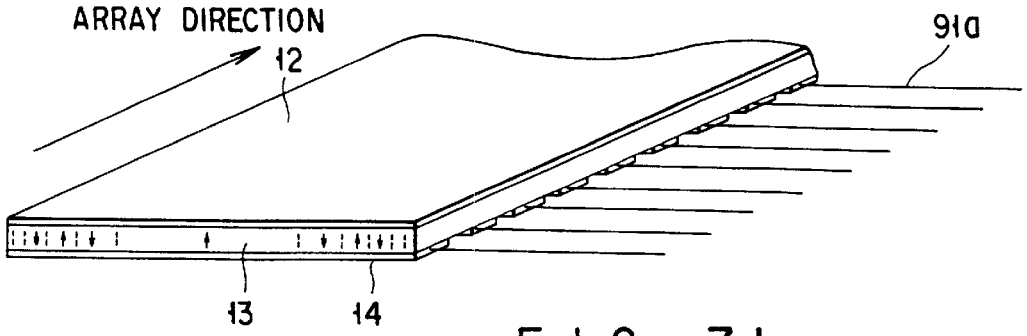
FIG. 71 is a perspective view of an array-type ink-jet head used in an ink-jet recording device according to Embodiment 8-3 of the present invention.

FIG. 71 is a perspective view of an array-type ink-jet head used in an ink-jet recording device according to Embodiment 8-3 of the present invention. This ink-jet head is a modification of the recording heads of Embodiments 8-1 and 8-2. As shown in FIG. 71, the array-type ink-jet head comprises a piezoelectric layer 13, a common electrode 12 formed on the upper surface of the layer 13, and discrete electrodes 14 provided on the lower surface of the layer 13. The discrete electrodes 14 are juxtaposed at regular intervals in main-scanning direction, forming an array. The piezoelectric layer 13 is divided into strip-shaped regions in sub-canning direction, which is perpendicular to the main-scanning direction. Of these regions, the odd-numbered ones are polarized in one direction, and the even-numbered ones are polarized in the opposite direction, as indicated by the arrows shown in FIG. 71. The common electrode 12, the piezoelectric layer 13 and the discrete electrodes 14 form a plurality of piezoelectric elements.

The common electrode 12 is connected to the ground. The discrete electrodes 14 are connected to a lead 91*a*, which in turn is connected to a drive circuit (not shown). The drive circuit drives n adjacent ones of the piezoelectric elements in accordance with the input image data, thereby performing phased array scanning. More precisely, the circuit simultaneously drives the first to n-th piezoelectric elements with high-frequency drive signals which differ in phase. Thus driven, the first to n-th elements emit the elements emits ultrasonic beams, which are converged in a plane extending in the sub-scanning direction and further in a plane extending in the main-scanning direction. Next, the drive circuit simultaneously drives the second to (n+1)th piezoelectric elements with high-frequency drive signals which differ in phase. Then, the drive circuit simultaneously drives the third to (n+2)th piezoelectric elements with high-frequency drive signals which differ in phase, and so forth. As a result, the point at which the ultrasonic beams emitted from the piezoelectric elements converge linearly moves in the main scanning direction.

Converted twice, in two planes perpendicular to each other, the ultrasonic beams emitted from the array 10 of piezoelectric elements reach one point in the surface of the liquid ink filled in an ink reservoir (not shown). As a result, an ink droplet flies from that point onto a recording medium. Since, the point linearly moves by virtue of phased array scanning, the array-type ink-jet head can serve to provide a line printer. In this case, ink droplets can form dots on the recording medium at a density higher than determined by the pitch at which the piezoelectric elements are juxtaposed in the main-scanning direction.

Figure 72:
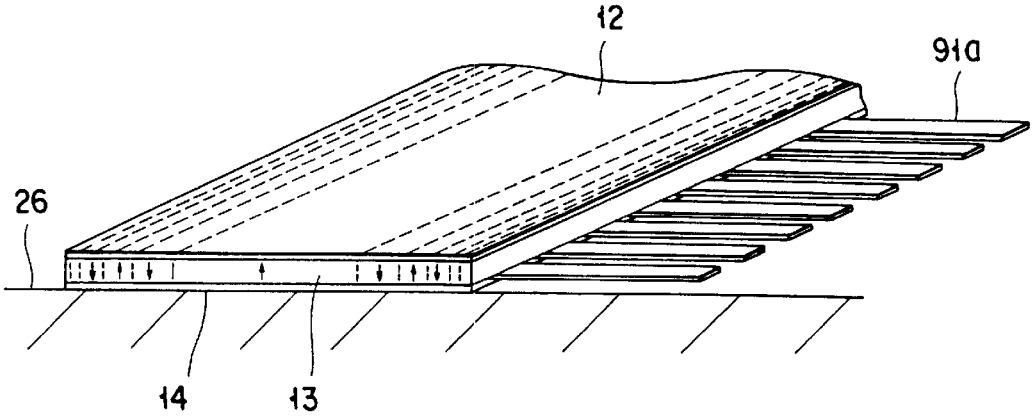
FIG. 72 is a perspective view showing, in more detail, the array-type ink-jet head shown in FIG. 71.

It will be explained how the array-type ink-jet head is manufactured, with reference to FIG. 72 which is a perspective view showing, in more detail, the ink-jet head shown in FIG. 71.

First, the discrete electrodes 14 are formed on a substrate 26. Then, the piezoelectric layer 13 is formed on the substrate 26, covering the discrete electrodes 14. Next, an electrode is formed on the piezoelectric layer 13 and Fresnel-divided into strips, as is indicated by the broken lines shown in FIG. 72. The discrete electrodes 14 are then connected together, and the piezoelectric layer 13 is polarized as indicated by the arrows shown in FIG. 72. Thereafter, the electrodes on the upper surface of the layer 13 are connected together, or an electrode is formed on these electrodes, thereby forming the common electrode 12.

The array-type ink-jet head may be manufactured in another method. At first, Fresnel-divided, strip-shaped electrodes are formed on the substrate 26. Next, the piezoelectric layer 13 is formed on the substrate 26, covering the strip-shaped electrodes. Then, an electrode is formed on the piezoelectric layer 13, and the layer 13 is polarized in the same way as described above. This done, the strip-shaped electrodes are connected together, forming the common electrode 12. Finally, the electrode on the upper surface of the piezoelectric layer 13 is partly etched, forming the discrete electrodes 14 spaced apart at regular intervals.

Since the strip-shaped piezoelectric elements can emit converged ultrasonic beams, the array-type ink-jet head according to Embodiment 8-3 is energy-efficient, can be manufactured at low cost, and can yet record high-resolution images.

Embodiment 9

Figure 73A:
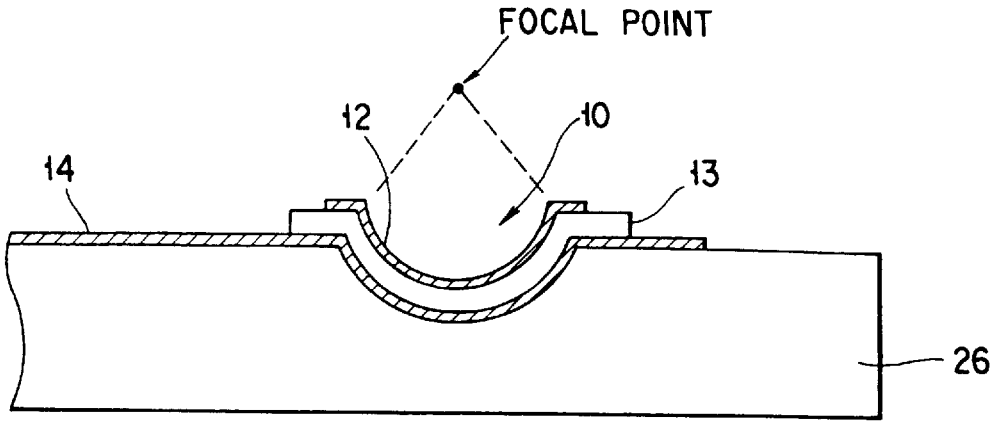
FIGS. 73A and 73B are a sectional view and a plan view of the ink-jet head used in an ink-jet recording device according to Embodiment 9 of the present invention.
Figure 73B:
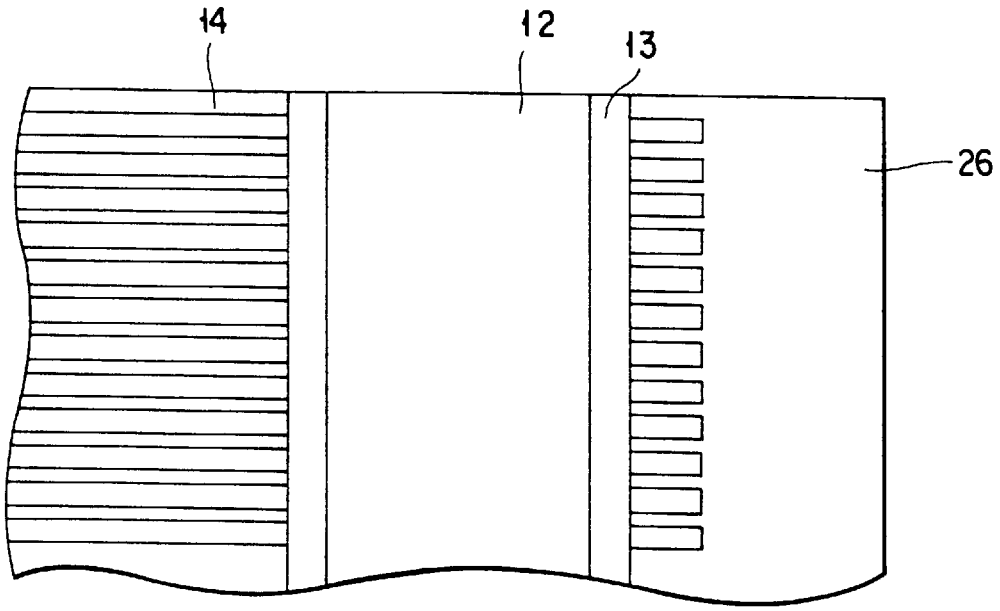

FIGS. 73A and 73B are a sectional view and a plan view of the ink-jet heat used in an ink-jet recording device according to Embodiment 9 of the present invention. As seen from FIGS. 73A and 73B, the ink-jet head comprises an insulating substrate 26 made of glass or the like and having a trough-like groove, and a piezoelectric element array 10 provided in the groove. The array 10 comprises a thin-film piezoelectric layer 13, a common electrode 12 mounted on one surface of the layer 13, and discrete electrodes 14 provided on the opposite surface of the layer 13. The discrete electrodes 14 extend onto the flat part of the substrate 26.

The piezoelectric layer 13 is made of piezoelectric material such as ZnO (zinc oxide), PZT (lead zirconate titanate) or PT (lead titanate), formed by means of thin-film forming process such as sputtering. The common electrode 12 has been formed by sputtering metal on the piezoelectric layer 13. If necessary, an acoustic matching layer or an waterproof coating is provided on the common electrode 12. The end portions of the discrete electrodes 14, located on the flat part of the substrate 26, are connected to a drive IC (not shown) which is mounted on the substrate 26.

How to form the discrete electrodes 14 in the groove of the substrate 26 will be explained, with reference to FIGS. 74A to 74D.

Figure 74A:
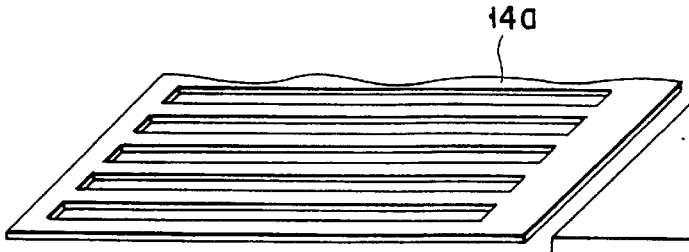
FIGS. 74A to 74D are perspective views, explaining the steps of manufacturing the ink-jet head shown in FIGS. 73A and 73B.
Figure 74B:
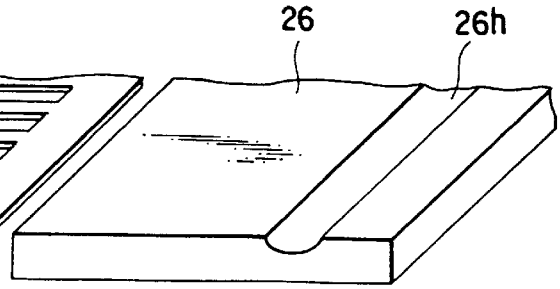

First, as shown in FIG. 74A, metal foil 14*a* is patterned, forming having parallel elongated slits. Meanwhile, a glass substrate 26 is prepared, which has a trough-like groove 26*h* as illustrated in FIG. 74B. An electrode (not shown) is provided on the lower surface of the substrate 26.

Figure 74C:
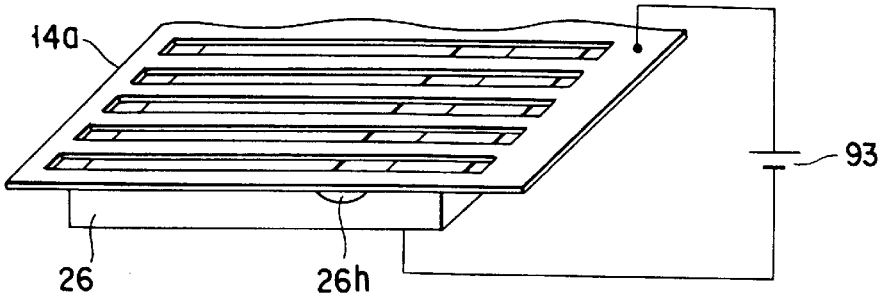
Figure 74D:
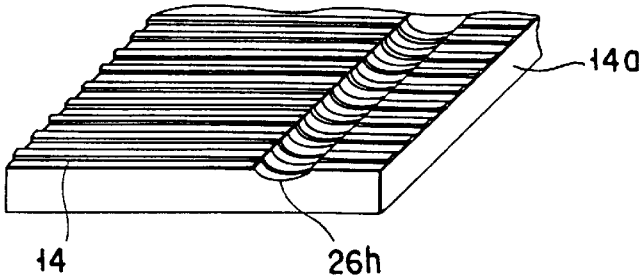

Next, as shown in FIG. 74C, the metal foil 14*a* is placed on the substrate 26. An electric field from a DC power supply 93 is applied between the foil 14*a* and the substrate 26 at high temperature ranging from 300 to 500° C. The metal foil 14*a* is thereby pressed onto the substrate 26 by virtue of electrostatic force. This press-bonding of a metal layer to a glass substrate is known as "anode bonding." The edge portions of the foil 14*a*, which connect the strip-shaped portions, are then cut off. The discrete electrodes 14 are thereby provided partly in the trough-like groove 26*h* and partly on the flat portion of the substrate 26.

If the case where the discrete electrodes 14 need to be thinner than can be formed from processing metal foil, they will be formed by forming a metal film by sputtering on a film of, for example, polyimide, and then by patterning the metal film thus formed. In this case, the metal film is fixed to the polyimide film. Hence, it be patterned, in its entirety, into strips, without necessity of leaving the edge portions. Despite this, the metal film is patterned, forming having parallel elongated slits, and its edge portions are cut off after the strip-shaped portions have been bonded to the glass substrate by bonding and the polyimide film has been etched away.

Another method of forming the discrete electrodes 14 on the substrate 26 will be explained with reference to FIGS. 75A to 75F. First, as shown in FIG. 75A, a light-shielding mask 101 is prepared. The mask 101 is made of resin film 102, designed to pattern a metal film into discrete electrodes 14. Then, as shown in FIG. 75B, the mask 101 is bent, forming a bulging portion which will fit into the trough-like groove 26*h* of the substrate 26. The light-shielding mask 101 is mounted on the substrate 26, with the bulging portion fitted in the groove 26*h*, as illustrated in FIG. 75C. Next, as shown in FIG. 75D, a metal film 103 is formed on the substrate 26 by means of sputtering, and a resist 104 is spin-coated on the metal film 102.

Further, as shown in FIG. 75E, the mask 101 is mounted on the resist 104, with the bulging portion aligned with the groove 26*h* of the substrate 26. The resist is exposed to light, and selective etching is performed on the metal film 103. As a result, the discrete electrodes 14 are formed in the groove 26*h* and on the substrate 26 with high precision, as illustrated in FIG. 75F.

With Embodiment 9 it is easy to form U-shaped piezoelectric elements, by forming a piezoelectric layer on the substrate 26 after the discrete electrodes have been formed partly in the trough-like groove 26*h* of the substrate 26. In addition, the discrete electrodes can be formed with high precision, either by bonding the patterned metal foil in the groove 27*h* through anode bonding, or by fitting the bulging portion of the patterned mask 101 into the trough-like groove 27*h*. Formed with high precision, the discrete electrodes serve to record images of resolution as high as hundreds of dots per inch.

Embodiment 10

Figure 76A:
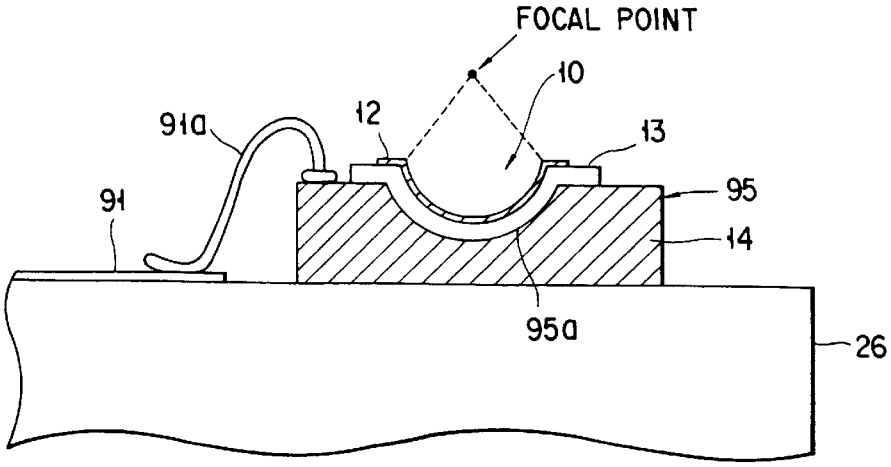
FIGS. 76A and 76B are a sectional view and a plan view of an ink-jet heat provided in an ink-jet recording device according to Embodiment 10 of the present invention.
Figure 76B:
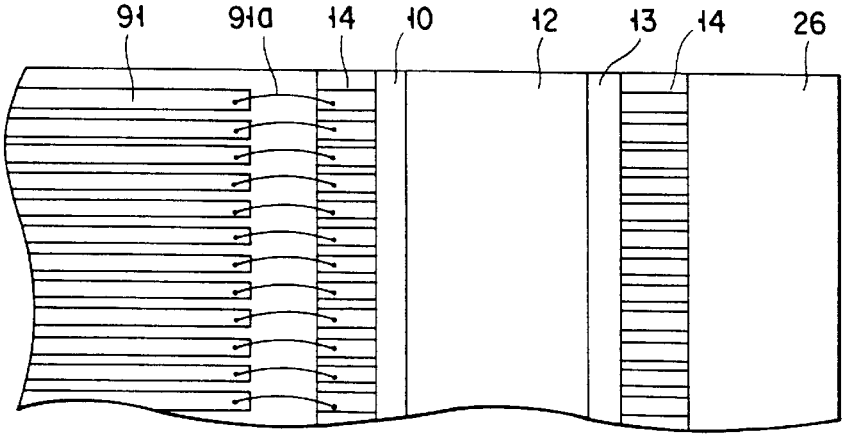

FIGS. 76A and 76B are a sectional view and a plan view of an ink-jet heat used an ink-jet recording device according to Embodiment 10 of the invention. As shown in FIG. 76A, the ink-jet head comprises a flat substrate 26 and a piezoelectric element array 10 mounted on the substrate 26. The array 10 comprises a piezoelectric layer 13, a common electrode 12 provided on one surface of the layer 13, and discrete electrodes 14 provided on the opposite surface of the layer 13. Each discrete electrode 14 has a U-groove made in its upper surface. Located in the U-groove, the common electrode 12 and the piezoelectric layer 13 are U-shaped, too.

Figure 77A:
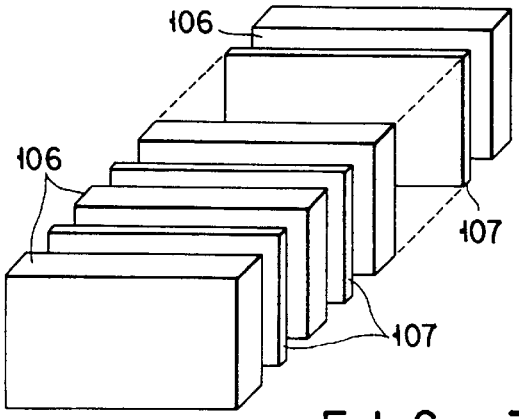
FIGS. 77A and 77B are perspective views explaining a method of manufacturing the recording head section shown in FIGS. 76A and 76B.
Figure 77B:
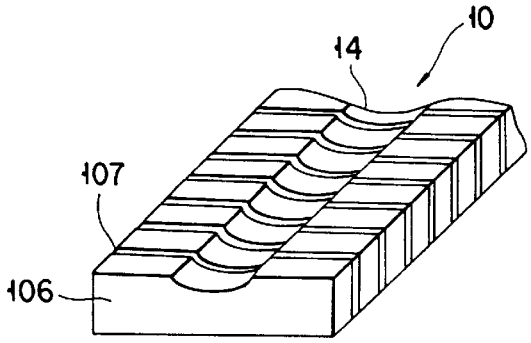

The discrete electrodes 14 have been formed by alternately combining plate-shaped conductors 106 and plate-shaped insulators 107, forming a rectangular block 95, and by forming a trough-like groove 95*a* in the upper surface of the block 95 as shown in FIG. 77B. The piezoelectric layer 13 is mounted in the groove 95*a*, and the common electrode 12 is placed on the layer 13, whereby the array 10 is provided. The block 95 is secured on the substrate 26. The piezoelectric layer 13 is made of piezoelectric material such as ZnO (zinc oxide), PZT (lead zirconate titanate) or PT (lead titanate), formed by means of thin-film forming process such as sputtering. The common electrode 12 has been formed by sputtering metal on the piezoelectric layer 13. If necessary, an acoustic matching layer or an waterproof coating is provided on the common electrode 12.

As shown in FIG. 76A, the plate-shaped conductors 106 (i.e., discrete electrodes 14) have their ends connected by bonding wires 91*a* to electrodes 91 provided on the substrate 26. The electrodes 91 are connected to a drive IC (not shown) which is mounted on the substrate 26.

A method of forming the block 95 having the groove 95*a* will be explained, with reference to FIGS. 77A and 77B. At first, as shown in FIG. 77A, the conductors 106 (e.g., 35 $\mu$m thick) and the insulators 107 (e.g., 4 $\mu$m thick), each shaped like a plate, are alternately juxtaposed and bonded together with an adhesive, thus forming a block. Thus, the conductors 106 (i.e., discrete electrodes 14) are arranged at the pitch of 40 $\mu$m. The block is cut, into an elongated block 95 which is, for example, 10 mm wide and 1 mm thick. A trough-like groove 95*a* is formed in on surface of the block 95. The groove 95*a* extends in the same direction as the conductors 106 and the insulators 107 are juxtaposed. The bottom of the groove 95*a* has a radius of curvature of, for example, 4 mm.

The block 95, thus formed, is placed on and secured to the substrate 26 as shown in FIGS. 76A and 76B. The piezoelectric layer 13 is formed in the trough-like groove of the substrate 26. If necessary, the upper surface of each conductor 106 is plated to orient the crystals of the layer 13 and to facilitate the wire-bonding of the conductor 106 to the electrode 91. Finally, the common electrode 12 is formed on the piezoelectric layer 13.

The block 95 described above can be formed by anisotropic etching of silicon. More specifically, an electrically conductive silicon substrate directly bonded to a glass substrate is anisotropically etched, forming deep, narrow parallel grooves. Due to the grooves, the silicon substrate is divided into a plurality of plate-shaped conductors. These grooves are filled with insulating resin, thus forming plate-shaped insulators. The conductors and the insulator, which are alternately juxtaposed, constitute a block. The block is mechanically processed to have a trough-like groove in its the upper surface.

As described above, the discrete electrodes of the ink-jet head used in Embodiment 10 are formed by alternately juxtaposing conductors and insulators, each shaped like a plate, by bonding them together, forming an elongated block, and by mechanically forming a trough-like groove in the upper surface of the block. The discrete electrodes are therefore formed with precision in the order of microns. Provided with high-precision discrete electrodes, the ink-jet head can record images of resolution as high as hundreds of dots per inch.

Embodiment 11

The recording head section incorporated in an ink-jet recording device according to Embodiment 11 of the invention will be described. The recording head section is similar in structure to the recording head section (FIG. 46) of Embodiment 5-1. It differs only in the piezoelectric element array and the connection between the array and the drive circuit.

Figure 78:
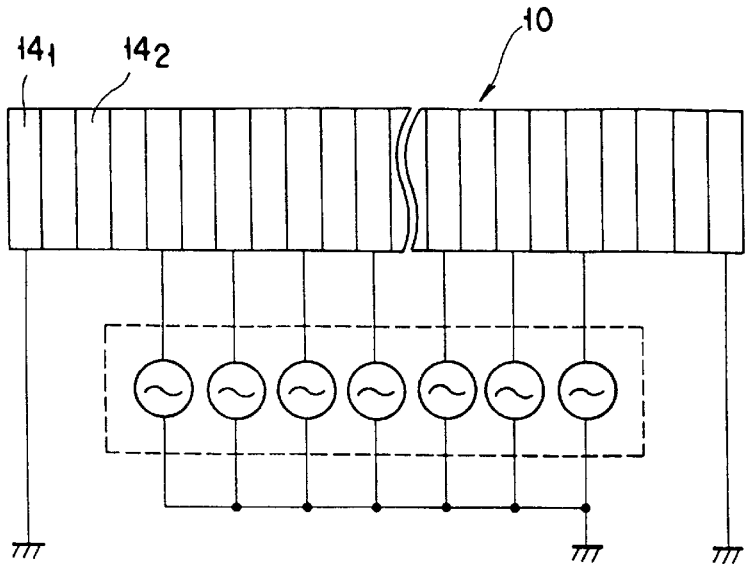
FIG. 78 is a diagram illustrating the main components of the recording head section incorporated in an ink-jet recording device according to Embodiment 11.

FIG. 78 shows the discrete electrodes 14 of the piezoelectric element array 10. As seen from FIG. 78, all discrete electrodes, but the electrodes $\mathbf{14}_1$ and $\mathbf{14}_2$ at either end, are connected to drive signal sources S1 to Si provided in the drive circuit 21. The drive circuit 21 has delay circuits, which are not shown in FIG. 78. In other words, the drive circuit 21 does not drive the electrode $\mathbf{14}_1$ and $\mathbf{14}_2$ at either end of the array 10. These discrete electrodes are set at the same potential as the common electrode (not shown), e.g., at the ground potential.

Namely, Embodiment 11 is characterized in that at least two of the piezoelectric elements of the array 10, which are located at the ends of the array 10, do not emit ultrasonic beams, not serving to squirt ink droplets. These elements help to reduce the average capacitive load for the piezoelectric elements which serve to squirt ink droplets. In addition, the acoustic couplings of the elements driven by the drive circuit 21 are averaged since the associated discrete electrodes are juxtaposed at regular intervals. As a result of this, cross-talk noise is far less than in the recording head section of the conventional ink-jet recording device.

This advantage will be described in more detail, with reference to FIGS. 79A and 79B.

Figure 79A:
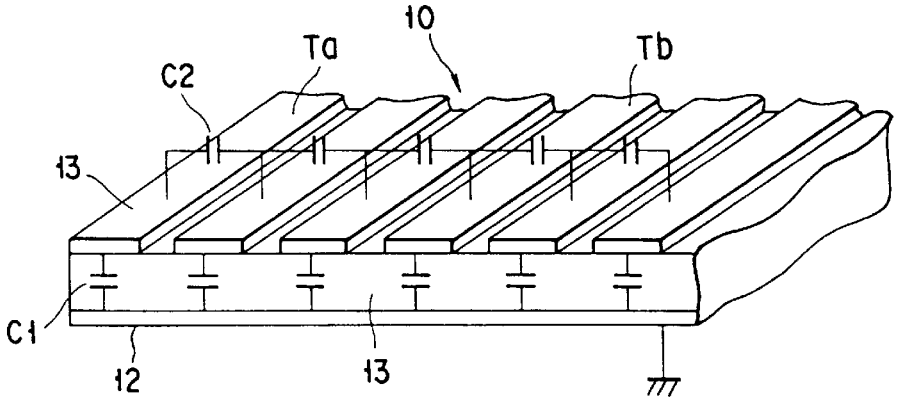
FIGS. 79A and 79B are diagrams explaining the capacitive loads and acoustic couplings present in the piezoelectric element array used in the recording head section of Embodiment 11.
Figure 79B:
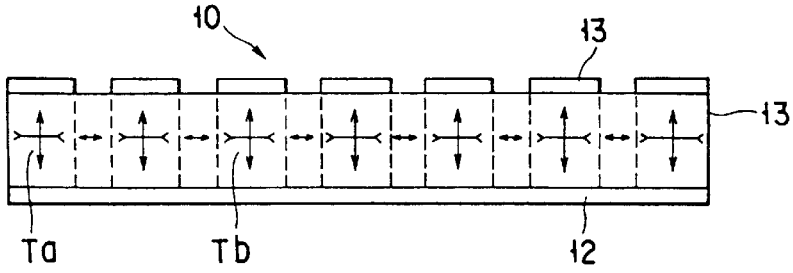

As shown in FIG. 79A, not only capacitive load C1 between the common electrode 12 and each discrete electrodes 14, but also capacitive load C2 between any two adjacent discrete electrodes 14 is present in the piezoelectric element array 10. A piezoelectric element array identical to the array 10 shown in FIG. 79A was made and driven. The element Ta located at one end of the array had capacitive load about 13% less than that of the element Tb located at either end. The capacitive load C2 is calculated to be about a fifth (⅕) of the capacitive load C1. The less the pitch of the discrete electrodes 14, the greater the difference between the capacitive loads C1 and C2 and the greater the difference between the capacitive loads of the elements Ta and Tb. Even if the elements Ta and Tb are driven by the same drive signal, they will generate different cross-talk noises. These noises will influence the ultrasonic waves the elements Ta and Tb emit.

How much the piezoelectric member of each piezoelectric element is deformed depends on the drive voltage applied to the piezoelectric member and the strain in the piezoelectric member. As shown in FIG. 79B, the element Ta is deformed to one side, quite differently from the element Tb located at neither end of the piezoelectric element array. The acoustic coupling of the element Ta influences the ultrasonic beams emitted from the elements (including Tb) driven by the drive circuit 21.

The ultrasonic beam emitted from any piezoelectric element located near the element Ta is reflected by the wall of the ink reservoir. This impairs the convergence of the ultrasonic beams emitted from the driven piezoelectric elements.

An ink-jet head similar to the recording head section (FIG. 46) of Embodiment 5-1 and incorporating a piezoelectric element array 10 of the type shown in FIG. 78 was manufactured. All piezoelectric elements, except those located at the ends of the array 10, were driven repeatedly, each time n elements, as in the embodiments described above, thereby forming a line of dots on recording paper. The dots were uniform in size and ink concentration, even at the end portions of the line.

Figure 80:
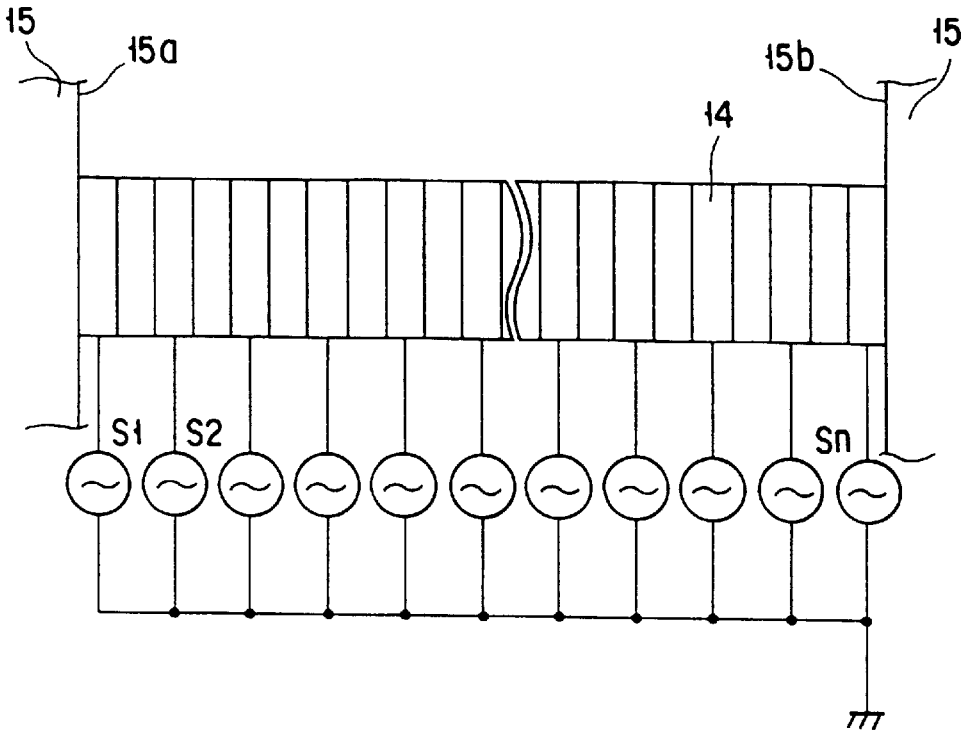
FIG. 80 is a diagram showing the main components of a conventional recording head section, for comparison with the recording head section of Embodiment 11.

A conventional ink-jet head shown in FIG. 80 was manufactured and driven, for comparison with the ink-jet head according to Embodiment 11. As can be understood from FIG. 80, all piezoelectric elements of the conventional ink-jet head, including those located at the ends of the array, were driven repeatedly, each time n elements, thereby forming a line of dots on recording paper. The dots forming the end portions of the line were neither uniform in ink concentration nor aligned with the middle portion of the line. This may be attributed to two facts. First, the piezoelectric elements at the ends of the array generated cross-talk noise different from the cross-talk noise the other elements generated, as has been explained with reference to FIG. 79A and 79B. Second, the ultrasonic beam emitted from the elements were reflected by the walls 15*a* and 15*b* of the ink reservoir, impairing the convergence of the ultrasonic beams emitted from the driven piezoelectric elements.

In Embodiment 11, the number of piezoelectric elements located at either end of the array 10 and not driven is optional. Furthermore, the number of elements located at one end of the array 10 and not driven may either be the same or different from the number of elements located at the other end of the array 10 and not driven. Still further, wires may be connected to the elements located at either end of the array 10 and not driven, for a particular purpose.

Figure 81:
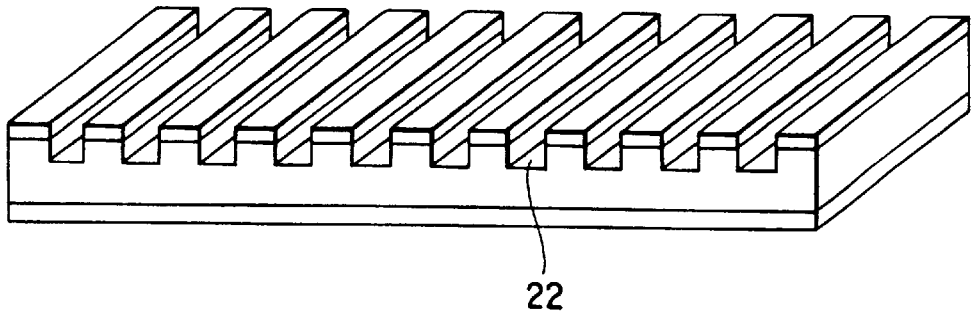
FIG. 81 is a perspective view illustrating a modification of the recording head section according to Embodiment 11.

Moreover, as illustrated in FIG. 81, grooves 22 may be cut in one surface of the piezoelectric layer 13 in order to minimize the influence of the acoustic coupling of the piezoelectric elements. The drive signals generated by the drive signal sources S1 to Si can be of any type that can drive the piezoelectric elements such that the ultrasonic beams emitted from the elements may converge at a point.

In Embodiment 11, the cross-talk noise and acoustic coupling of each piezoelectric element can be reduced easily since the piezoelectric elements driven simultaneously have the same cross-talk noise and the same acoustic coupling. The drive circuit can be one having a simple structure, and the convergence of the ultrasonic beams emitted from the simultaneously driven piezoelectric elements is influenced but very little by the ultrasonic beam emitted from the elements and reflected by the walls of the ink reservoir.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An ink-jet recording apparatus, for recording an image onto a recording medium by flying an ink-droplet from an ink surface by a pressure of an ultrasonic beam, comprising:

first converging means having an ultrasonic generating element array which has ultrasonic generating elements arranged in a linear array for emitting ultrasonic beams by applying a plurality of pulses having different phases from each other to converge said ultrasonic beams, in a first direction along a linear array direction of said ultrasonic generating elements, by interfering said ultrasonic beams with each other; emitted from said ultrasonic generating elements of a part of said ultrasonic generating element array, which are simultaneously driven, by sequentially shifting said ultrasonic generating elements simultaneously driven in the array direction; and second converging means for converging each of said ultrasonic beams to a predetermined point in a direction parallel to said first direction.

2. The ink-jet recording apparatus according to claim 1, wherein said first converging means includes:

a shift register for transferring an input image data, a latch for temporarily storing an image data parallel output from said shift register, and data selector/driver for selecting one of a plurality of pulse series, which have different phases, input from a plurality of common signal lines corresponding to the image data temporarily stored in said latch and for driving said at least one ultrasonic generating element according to the corresponding pulse series.

3. The ink-jet recording apparatus according to claim 1, wherein said first converging means includes:

a first driving mode for simultaneously driving said at least one ultrasonic generating element to converge said ultrasonic beams emitted from said at least one ultrasonic generating element at a first point of said surface of said ink along a center axis of said at least one ultrasonic generating element perpendicular to an ultrasonic generating surface of said ultrasonic generating elements, and a second driving mode for simultaneously driving said at least one ultrasonic generating element to converge said ultrasonic beams emitted from regions divided into at least a right region and a left region of said at least one ultrasonic generating element at a second point different from said first point of said center axis.

4. The ink-jet recording apparatus according to claim 1, wherein said at least one ultrasonic generating element includes a plurality of discrete electrodes and a plurality of discrete piezoelectric elements.

5. The ink-jet recording apparatus according to claim 1, wherein said at least one ultrasonic generating element includes a plurality of discrete electrodes and at least one piezoelectric layer.

6. The ink-jet recording apparatus to claim 5, wherein said piezoelectric layer has at least one gap which crosses the array direction of said ultrasonic generating element array.

7. An ink-jet recording apparatus, for recording an image onto a recording medium by flying an ink-droplet from an ink surface by a pressure of an ultrasonic beam, comprising:

first converging means having an ultrasonic generating element array which has a plurality of ultrasonic generating elements arranged in a linear array for emitting ultrasonic beams by applying a plurality of pulses having different phases from each other to converge said ultrasonic beams in a first direction along a linear array direction of said ultrasonic generating elements, by interfering said ultrasonic beams with each other, emitted from said plurality of ultrasonic generating elements;

second converging means for converging said ultrasonic beams to a predetermined point in a direction parallel to said first direction; and third converging means including a Fresnel zone plate having a plurality of parallel stripe patterns extending in a second direction, which is perpendicular to the first direction, for converging the ultrasonic beams emitted from said plurality of ultrasonic generating elements in the second direction into said ink surface.

8. An ink-jet recording apparatus, for recording an image onto a recording medium by flying an ink-droplet from an ink surface by a pressure of an ultrasonic beam, comprising:

an ultrasonic generating element array which has ultrasonic generating elements arranged in an array for emitting a plurality of ultrasonic beams; and a Fresnel zone plate having a plurality of parallel stripe patterns extending in a same direction as an array direction of said ultrasonic generating elements and for converging the plurality of ultrasonic beams emitted from said ultrasonic generating elements into said ink surface.

9. An ink jet recording apparatus, for recording an image onto a recording medium by flying an ink-droplet from an ink surface by a pressure of an ultrasonic beam, comprising:

an ultrasonic generating element array which has a plurality of ultrasonic generating elements arranged in an array for emitting ultrasonic beams;

driving means for applying a plurality of pulses having different phases from each other to converge said ultrasonic beams, by interfering said ultrasonic beams with each other, emitted from said plurality of ultrasonic generating elements; and converging means for converging said ultrasonic beams to a predetermined point along an axis perpendicular to an array direction, wherein said converging means includes means for selecting a predetermined number of continuous ultrasonic generating element groups to be simultaneously driven from said ultrasonic generating element array, said groups including, a first ultrasonic generating element group comprising a first group of ultrasonic generating elements of said plurality of ultrasonic generating elements arranged at a center of an array direction of said first ultrasonic generating element group, and a second ultrasonic generating element group comprising a second group of ultrasonic generating elements of said plurality of ultrasonic generating elements arranged at sides of said array direction of said first ultrasonic generating element group, and said converging means further, includes, means for supplying two-phase driving signals having opposite phases than phases of said first and second ultrasonic generating element groups, means for shifting a position of said ultrasonic generating element groups, and means for repeating the two-phase driving signals supplying operation.

10. An ink-jet recording apparatus, for recording an image onto a recording medium by flying an ink-droplet from an ink surface by a pressure of an ultrasonic beam, comprising:

an ultrasonic generating element array which has a plurality of ultrasonic generating elements arranged in an array for emitting ultrasonic beams;

driving means for applying a plurality of pulses having different phases from each other to converge said ultrasonic beams, by interfering said ultrasonic beams with each other, emitted from said plurality of ultrasonic generating elements; and converging means for converging said ultrasonic beams to a predetermined point along an axis perpendicular to an array direction, wherein said converging means includes means for selecting a predetermined number of continuous ultrasonic generating element groups to be simultaneously driven from said ultrasonic generating element array, said groups, including, a first ultrasonic generating element group comprising a first group of ultrasonic generating elements of said plurality of ultrasonic generating elements arranged at a center of an array direction of said first ultrasonic generating element group, and a second ultrasonic generating element group comprising a second group of ultrasonic generating elements of said plurality of ultrasonic generating elements arranged at sides of said array direction of said first ultrasonic generating element group, and said converging means further includes means for supplying two-phase driving signals having opposite phases than phases of said first and second ultrasonic generating element groups.

11. An ink-jet recording apparatus, for recording an image onto a recording medium by flying an ink-droplet from an ink surface by a pressure of an ultrasonic beam, comprising:

an ultrasonic generating element array which has a plurality of ultrasonic generating elements arranged in an array for emitting ultrasonic beams;

driving means for selecting a predetermined number of continuous ultrasonic generating element groups to be simultaneously driven from said ultrasonic generating element array, said groups, including, a first ultrasonic generating element group comprising a first group of ultrasonic generating elements of said plurality of ultrasonic generating elements arranged at a center of an array direction of said first ultrasonic generating element group, and a second ultrasonic generating element group comprising a second group of ultrasonic generating elements of said plurality of ultrasonic generating elements arranged at sides of said array direction of said first ultrasonic generating element group, said driving means further, includes, means for supplying two-phase driving signals having opposite phases than phases of said first and second ultrasonic generating element groups, and means for repeating the two-phase driving signals supplying operation.

12. The ink-jet recording apparatus according to claim 11, further comprising control means for controlling whether or not said driving means supplies said two-phase driving signals on a basis of an image signal to be recorded.

13. The ink-jet recording apparatus according to claim 12, further comprising means for controlling a time period of supplying said two-phase driving signals on a basis of an image signal of a pixel corresponding to said ultrasonic generating element groups.

14. The ink-jet recording apparatus according to claim 13, wherein said control means is arranged corresponding to each ultrasonic generating element of said ultrasonic generating element array, and inputs said two-phase driving signals and a non-driving signal and controls each corresponding ultrasonic generating element by selecting one of a driving signal and the non-driving signal from said two-phase driving signals on a basis of select information of said ultrasonic generating element groups according to an image signal to be recorded and a select information of the two-phase driving signals.

15. The ink-jet recording apparatus according to claim 13, wherein a total number of ultrasonic generating elements of said ultrasonic generating element array is a number comprising the number of ultrasonic generating elements in said ultrasonic generating element groups added to at least a number of pixels of a single line to be recorded.

16. The ink-jet recording apparatus according to claim 13, wherein a total number of ultrasonic generating elements of said ultrasonic generating element array is a number comprising the number of ultrasonic generating elements in said ultrasonic generating element groups added to at least a number of pixels of a single line to be recorded.

17. The ink-jet recording apparatus according to claim 12, wherein said control means is arranged corresponding to each ultrasonic generating element of said ultrasonic generating element array, and inputs said two-phase driving signals and a non-driving signal and controls each corresponding ultrasonic generating element by selecting one of a driving signal and the non-driving signal from said two-phase driving signals on a basis of select information of said ultrasonic generating element groups according to an image signal to be recorded and a select information of the two-phase driving signals.

18. The ink-jet recording apparatus according to claim 12, wherein a total number of ultrasonic generating elements of said ultrasonic generating element array is a number comprising the number of ultrasonic generating elements in said ultrasonic generating element groups added to at least a number of pixels of a single line to be recorded.

19. The ink-jet recording apparatus according to claim 11, wherein said driving means includes means for alternatively setting a number of ultrasonic elements in said ultrasonic generating element groups to an even-number or an odd-number in the array direction of an ultrasonic generating element of said ultrasonic generating element array.

20. The ink-jet recording apparatus according to claim 11, wherein a total number of ultrasonic generating elements of said ultrasonic generating element array is a number comprising the number of ultrasonic generating elements in said ultrasonic generating element groups added to at least a number of pixels of a single line to be recorded.

21. An ink-jet recording apparatus comprising:

ink holding means for holding liquid ink to keep a predetermined liquid surface;

an ultrasonic generating element array which has ultrasonic generating elements, arranged at a predetermined pitch, for converging ultrasonic beams onto said liquid ink with a predetermined driving signal and for emitting ultrasonic beams moving along said liquid surface; and driving means for selecting a predetermined number of continuous ultrasonic generating element groups to be simultaneously driven from said ultrasonic generating element array, for assigning each ultrasonic generating element of said ultrasonic generating elements of said ultrasonic generating element groups one of a first region obtained by a Fresnel diffraction equation in which the ultrasonic beams should pass and a second region in which a phase of the ultrasonic beams should shift a half wave length, for assigning a first group of said groups to said first region and assigning a second group of said groups to said second region, for supplying two-phase driving signals having opposite phases to said first and second groups for shifting a position of said ultrasonic generating element groups, and for repeating the two-phase driving signals supplying operation.

22. The ink-jet recording apparatus according to claim 21, further comprising control means for controlling whether or not said driving means supplies said two-phase driving signals on a basis of an image signal to be recorded.

23. The ink-jet recording apparatus according to claim 22, further comprising means for controlling a time period of supplying said two-phase driving signals on a basis of an image signal of a pixel corresponding to said ultrasonic generating element groups.

24. The ink-jet recording apparatus according to claim 23, wherein said control means is arranged corresponding to each ultrasonic generating element of said ultrasonic generating element array, and inputs said two-phase driving signals and a non-driving signal and controls each corresponding ultrasonic generating element by selecting one of a driving signal and the non-driving signal from said two-phase driving signals on a basis of select information of said ultrasonic generating element groups according to an image signal to be recorded and a select information of the two-phase driving signals.

25. The ink-jet recording apparatus according to claim 23, wherein a total number of ultrasonic generating elements of said ultrasonic generating element array is a number comprising the number of ultrasonic generating elements in said ultrasonic generating element groups added to at least a number of pixels of a single line to be recorded.

26. The ink-jet recording apparatus according to claim 23, wherein a total number of ultrasonic generating elements of said ultrasonic generating element array is a number comprising the number of ultrasonic generating elements in said ultrasonic generating element groups added to at least a number of pixels of a single line to be recorded.

27. The ink-jet recording apparatus according to claim 22, wherein said control means is arranged corresponding to each ultrasonic generating element of said ultrasonic generating element array, and inputs said two-phase driving signals and a non-driving signal and controls each corresponding ultrasonic generating element by selecting one of a driving signal and the non-driving signal from said two-phase driving signals on a basis of select information of said ultrasonic generating element groups according to an image signal to be recorded and a select information of the two-phase driving signals.

28. The ink-jet recording apparatus according to claim 21, wherein a total number of ultrasonic generating elements of said ultrasonic generating element array is a number comprising the number of ultrasonic generating elements in said ultrasonic generating element groups added to at least a number of pixels of a single line to be recorded.

29. The ink-jet recording apparatus according to claim 21, wherein said driving means includes means for alternatively setting a number of ultrasonic elements in said ultrasonic generating element groups to an even-number or an odd-number in the array direction of an ultrasonic generating element of said ultrasonic generating element array.

30. The ink-jet recording apparatus according to claim 21, wherein a total number of ultrasonic generating elements of said ultrasonic generating element array is a number comprising the number of ultrasonic generating elements in said ultrasonic generating element groups added to at least a number of pixels of a single line to be recorded.

31. An ink-jet recording apparatus, for recording an image onto a recording medium by flying an ink-droplet from an ink surface by a pressure of an ultrasonic beam, comprising:

an ultrasonic generating element array which has a plurality of ultrasonic generating elements arranged in an array for emitting a plurality of ultrasonic beams;

driving means for selecting a predetermined number of continuous ultrasonic generating element groups to be simultaneously driven from said ultrasonic generating element array, for supplying driving signal to each of said ultrasonic generating element groups and shifting a position of said ultrasonic generating element groups and repeating the driving signal supply operation; and a plurality of control means arranged corresponding to each of said ultrasonic generating element groups for controlling whether or not said driving means supplies said driving signal to said ultrasonic generating element groups on a basis of corresponding image signals of pixels of said ultrasonic generating element groups, wherein said control means inputs said image signals corresponding to said plurality of ultrasonic generating elements overlapping two ultrasonic generating element groups of said ultrasonic generating element groups, when said ultrasonic generating element group overlaps two ultrasonic generating element groups of said ultrasonic generating element array.

32. The ink-jet recording apparatus according to claim 31, further comprising:

memory means for storing at least an image signal of said image signals of a same number of a line as a number of said ultrasonic generating element group; and transfer means for transferring and shifting by a single line image signals corresponding to each of said ultrasonic generating element group of the same line stored in said memory means.

33. An ink-jet recording apparatus, for recording an image onto a recording medium by flying an ink-droplet from an ink surface by a pressure of an ultrasonic beam, comprising:

an ultrasonic generating element array, comprising a plurality of ultrasonic generating means, for emitting a plurality of ultrasonic beams; and driving means having a first driving mode for simultaneously driving a first group of ultrasonic generating means comprising of an even number of said ultrasonic generating means to converge ultrasonic beams emitted from said first group of ultrasonic generating means to a center of said first group of ultrasonic generating means, and second driving mode for simultaneously driving a second group of ultrasonic generating means comprising of an odd number of said ultrasonic generating means to converge ultrasonic beams emitted from said second group of ultrasonic generating means to a center of said second group of ultrasonic generating means.

34. An ink-jet recording apparatus, for recording an image onto a recording medium by flying an ink-droplet from an ink surface by a pressure of an ultrasonic beam, comprising:

an ultrasonic generating element array which has ultrasonic generating elements arranged at a predetermined pitch, for converging ultrasonic beams onto said ink with a predetermined driving signal and for emitting ultrasonic beams moving along said ink surface; and driving means for simultaneously driving an adjacent plurality of ultrasonic generating elements of said ultrasonic generating elements with a predetermined delay time and for shifting a position of ultrasonic generating element groups of said ultrasonic generating elements; and an acoustic lens or Fresnel zone plate for converging ultrasonic beams emitted from said ultrasonic generating elements to said surface of said ink in a direction perpendicular to an array direction of said ultrasonic generating element array, wherein an aperture of said acoustic lens is smaller than a length of said simultaneously driven ultrasonic generating elements of one of said ultrasonic generating element groups.

* * * * *